US006287704B1

(12) United States Patent
Preikschat et al.

(10) Patent No.: US 6,287,704 B1
(45) Date of Patent: Sep. 11, 2001

(54) CHROMATE-FREE CONVERSION LAYER AND PROCESS FOR PRODUCING THE SAME

(75) Inventors: Patricia Preikschat; Rolf Jansen; Peter Hulser, all of Trebur (DE)

(73) Assignee: Surtec Produkte und System fur die Oberflachenbehandlung GmbH (DE)

( * ) Notice: Subject to any disclaimer, the term of this patent is extended or adjusted under 35 U.S.C. 154(b) by 0 days.

(21) Appl. No.: 09/171,558

(22) PCT Filed: Apr. 18, 1997

(86) PCT No.: PCT/DE97/00800

§ 371 Date: Mar. 29, 1999

§ 102(e) Date: Mar. 29, 1999

(87) PCT Pub. No.: WO97/40208

PCT Pub. Date: Oct. 30, 1997

(30) Foreign Application Priority Data

Apr. 19, 1996 (DE) ..... 196 15 664

(51) Int. Cl.[7] ..... B32B 15/04; C23C 22/00

(52) U.S. Cl. ..... 428/472.1; 106/14.21; 148/247; 148/251; 148/258; 148/265; 148/267; 148/268; 148/273; 148/274; 148/283; 148/284; 427/430.1; 427/435; 428/628; 428/629; 428/632; 428/658; 428/659

(58) Field of Search ..... 428/472.1, 628, 428/629, 632, 658, 659; 148/247, 251, 258, 259, 261, 262, 264, 265, 267, 268, 273, 274, 283, 284; 106/14.21; 427/430.1, 435

(56) References Cited

U.S. PATENT DOCUMENTS

Re. 26,130 12/1966 Bellinger et al. .
2,035,380 3/1936 Wilhelm .
2,035,385 3/1936 McLean .

(List continued on next page.)

FOREIGN PATENT DOCUMENTS 21 66737 A1 5/1975 (DE) .
21 66 737 6/1975 (DE) .
29 00 099 B2 7/1981 (DE) .
30 38 699 A1 7/1981 (DE) .
34 23 990 A1 1/1985 (DE) .
32 13 384 C2 1/1991 (DE) .
41 35 524 A1 4/1993 (DE) .
0034040 A1 8/1981 (EP) .
0 337 411 10/1989 (EP) .
0 337 411 A2 10/1989 (EP) .
14 61 244 1/1977 (GB) .
2 097 024 A 10/1982 (GB) .
1781316A1 12/1992 (RU) .

OTHER PUBLICATIONS

"Some Metal Derivatives of Azo and Azomethine Dyes", Journal of the American Chemical Society, vol. 74, No. 14, Jul. 20, 1952, pp. 3461 and 3509–3512.

Database WPI, Section Ch, Week 9402, Derwent Publications Ltd., London, GB; AN 94–014365, XP002038536 & SU 1 781 316 A (Magn Mining Metal Inst), Dec. 15, 1992, siehe Zusammenfassung.

PCT International Search Report for PCT International Appl. PCT/DE97/00800, Sep. 5, 1997.

*Primary Examiner*—Robert R. Koehler
(74) *Attorney, Agent, or Firm*—Pearne & Gordon LLP

(57) ABSTRACT

A chromium(VI)-free, chromium(III)-containing and substantially coherent conversion layer on zinc or zinc alloys presenting, even in the absence of further components such as silicate, cerium, aluminum and borate, a corrosion protection of approx. 100 to 1000 h in the salt spray test according to DIN 50021 SS or ASTM B 117-73 until first attack according to DIN 50961 Chapter 10; being clear, transparent and substantially colorless and presenting multicolored iridescence; having a layer thickness of approx. 100 nm to 1000 nm; and being hard, adhering well and being resistant to wiping.

62 Claims, 38 Drawing Sheets

Computer simulation of the kinetic model of chromate coating of zinc for various rate constants

U.S. PATENT DOCUMENTS

| | | | |
|---|---|---|---|
| 2,106,904 | 2/1938 | Wilhelm . | |
| 2,559,878 | 7/1951 | Johnson . | |
| 2,563,431 | 8/1951 | Spruance, Jr. . | |
| 2,620,265 | 12/1952 | Hesch . | |
| 2,904,413 | 9/1959 | Hampel . | |
| 3,072,516 | 1/1963 | Bellinger et al. . | |
| 3,382,111 | 5/1968 | Tongyai et al. . | |
| 3,477,882 | 11/1969 | Coulman . | |
| 3,553,034 | 1/1971 | Harvey et al. . | |
| 3,556,868 | 1/1971 | Ziemba . | |
| 3,843,430 | 10/1974 | Kinder | 252/79.3 |
| 3,857,739 | 12/1974 | Prust et al. . | |
| 3,932,198 | 1/1976 | Schneider . | |
| 4,126,490 | 11/1978 | Aoki . | |
| 4,141,758 | 2/1979 | Glassman et al. . | |
| 4,171,231 | 10/1979 | Bishop et al. . | |
| 4,263,059 | 4/1981 | Guhde et al. . | |
| 4,349,392 | 9/1982 | Huvar . | |
| 4,359,345 | 11/1982 | DaFonte, Jr. . | |
| 4,359,346 | 11/1982 | DaFonte, Jr. . | |
| 4,359,347 | 11/1982 | DaFonte, Jr. . | |
| 4,359,348 | 11/1982 | Crotty . | |
| 4,367,099 | 1/1983 | Lash et al. . | |
| 4,384,902 | 5/1983 | Crotty et al. . | |
| 4,539,348 | 9/1985 | Gajria et al. . | |
| 4,578,122 | 3/1986 | Crotty . | |
| 4,705,576 | 11/1987 | Klos et al. . | |
| 4,749,418 | 6/1988 | Saeki et al. . | |
| 4,801,337 * | 1/1989 | Higgins | 148/267 |
| 5,091,023 | 2/1992 | Saeki et al. . | |
| 5,141,575 | 8/1992 | Yoshitake et al. . | |
| 5,230,750 | 7/1993 | Shindou et al. . | |
| 5,368,655 | 11/1994 | Klos | 148/250 |
| 5,393,354 | 2/1995 | Bishop . | |
| 5,407,749 | 4/1995 | Bishop . | |
| 5,415,702 | 5/1995 | Bishop et al. . | |
| 5,807,442 | 9/1998 | Goodreau . | |
| 5,820,741 | 10/1998 | Bibber | 205/287 |
| 5,876,517 | 3/1999 | Jeannier | 148/264 |

* cited by examiner

FIG. 37

| | Methods | | | | | | | |
|---|---|---|---|---|---|---|---|---|
| | Ellipsometry nm | SEM nm | Glow-discharge spectrometer nm (Cr > 1%) | with Cr (%) | chromium index | nm (Cr > Zn) | nm (Cr > 30%) | Sample No. |
| **1. Prior Art** | | | | | | | | |
| **Yellow chromation** Cr(III) + Cr(VI) | - | 300 | 440 | 11 | 48 | 17 | 25 | 9 |
| **Blue chromation** Cr(III) | 98 | 60 | 60 | 8 | 5 | 0 | 0 | 8 |
| **2. Invention (Chromitation)** | | | | | | | | |
| **60°C** Cr(III) | 432 | 300 | 344 | 7 | 23 | 2 | 15 | 1,2,3,4,5 |
| **100°C** Cr(III) | 595 | - | 358 | 10 | 38 | 22 | 28 | 6 |
| **60°C on Zn/Fe** Cr(III) | - | - | 282 | 6 | 16 | 0 | 16 | 7 |
| **100°C, two-fold concentration** Cr(III) | 953 | - | - | - | - | - | - | |

Computer simulation of the kinetic model of chromate coating of zinc for various rate constants

CHROMATE-FREE CONVERSION LAYER AND PROCESS FOR PRODUCING THE SAME

FIELD OF THE INVENTION

The present invention relates to chromium(VI)-free, chromium(III)-containing, substantially coherent conversion layers, a method for producing them, a concentrate, a passivation bath, a passivating method, a passive layer, and a conversion layer.

BACKGROUND OF THE INVENTION

Metallic materials, in particular iron and steel, are plated with zinc or cadmium in order to protect them from corrosive environmental influences. The corrosion protection of zinc resides in the fact that it is even less precious than the base metal and therefore at first exclusively draws the corrosive attack; it acts as a sacrificial layer. The base metal of the respective zinc-plated component remains unimpaired as long as it is continuously covered with zinc, and the mechanical functionality remains preserved over longer periods of time than in the case of parts not plated with zinc. Thicker zinc layers naturally afford higher corrosion protection than thin layers inasmuch as corrosive erosion of thicker layers simply takes more time.

The corrosive attack on the zinc layer, in turn, can be greatly delayed by application of a chromation, or chromate coating, whereby corrosion of the base metal is even further postponed than by mere zinc plating. A considerably better corrosion protection is afforded by the zinc/chromate layer system is than by a mere zinc layer of identical thickness. Moreover by means of chromation the optical deterioration of a component due to environmental influences is further postponed—the corrosion products of zinc, referred to as "white rust", equally interfere with the optical appearance of a component.

The advantages of an applied chromation are so important that almost any galvanically zinc-plated surface is in addition chromate coated as well. The prior art knows four chromations named after their colorations, which are each applied by treating (immersion, spraying, rolling) a zinc-plated surface with the corresponding aqueous chromate coating solution. Moreover yellow and green chromations for aluminum are known which are produced analogously. In any case, these are variously thick layers of substantially amorphous zinc/chromium oxide (or aluminum/chromium oxide) with non-stoichiometric compositions, a certain water content, and inserted foreign ions. These are known and classified into method groups in accordance with German Industrial Standard (DIN) 50960, Part 1:

1) Colorless and Blue Chromations, Groups A and B

The blue chromate layer has a thickness of up to 80 nm, is weakly blue in its inherent color and presents a golden, reddish, bluish, greenish or yellow iridescent coloring brought about by refraction of light in accordance with layer thicknesses. Very thin chromate layers lacking almost any inherent color are referred to as colorless chromations (Group A). The chromate coating solution may in either case consist of hexavalent as well as trivalent chromates and mixtures of both, moreover conducting salts and mineral acids. There are fluoride-containing and fluoride-free variants. Application of the chromate coating solutions is performed at room temperature. The corrosion protection of unmarred blue chromations amounts to 10–40 h in the salt spray cabinet according to DIN 50021 SS until the first appearance of corrosion products. The minimum requirement for Method Groups A and B according to DIN 50961 Chapter 10 Table 3 is 8 h for drumware and 16 h for shelfware.

2) Yellow Chromations, Group C

The yellow chromate layer has a thickness of approx. 0.25–1 $\mu$m, a golden yellow coloring, and frequently a strongly red-green iridescent coloring. The chromate coating solution substantially consists of hexavalent chromate, conducting salts and mineral acids dissolved in water. The yellow coloring is caused by the significant proportion (80–220 mg/m$^2$) of hexavalent chromium which is inserted besides the trivalent chromium produced by reduction in the course of the layer formation reaction. Application of the chromate coating solutions is performed at room temperature. The corrosion protection of unmarred yellow chromations amounts to 100–200 h in the salt spray cabinet according to DIN 50021 SS until the first appearance of corrosion products. The minimum requirement for Method Group C according to DIN 50961 Chapter 10 Table 3 amounts to 72 h for drumware and 96 h for shelfware.

3) Olive Chromations, Group D

The typical olive chromate layer has a thickness of up to 1.5.$\mu$m and is opaquely olive green to olive brown. The chromate coating solution substantially consists of hexavalent chromate, conducting salts and mineral acids dissolved in water, in particular phosphates or phosphoric acid, and may also contain formates. Into the layer considerable amounts of chromium(VI) (300–400 mg/m$^2$) are inserted. Application of the chromate coating solutions is performed at room temperature. The corrosion protection of unmarred olive chromations amounts to 200–400 h in the salt spray cabinet according to DIN 50021 SS until the first appearance of corrosion products. The minimum requirement for Method Group D according to DIN 50961 Chapter 10 Table 3 is 72 h for drumware and 120 h for shelfware.

4) Black Chromations, Group F

The black chromate layer is fundamentally a yellow or olive chromation having colloidal silver inserted as a pigment. The chromate coating solutions have about the same composition as yellow or olive chromations and additionally contain silver ions. With a suitable composition of the chromate coating solution on zinc alloy layers such as Zn/Fe, Zn/Ni or Zn/Co, iron, nickel or cobalt oxide will be incorporated into the chromate layer as a black pigment so that silver is not required in these cases. Into the chromate layers considerable amounts of chromium(VI) are inserted, namely between 80 and 400 mg/m$^2$ depending on whether the basis is a yellow or olive chromation. Application of the chromate coating solutions is performed at room temperature. The corrosion protection of unmarred black chromations on zinc amounts to 50–150 h in the salt spray cabinet according to DIN 50021 SS until the first appearance of corrosion products. The minimum requirement for Method Group E according to DIN 50961 Chapter 10 Table 3 is 24 h for drumware and 48 h for shelfware. Black chromations on zinc alloys are considerably above the specified values.

5) Green Chromations for Aluminum, Group E

The green chromation on aluminum (known under the name of aluminum green) is of a matt green and not iridescent. The chromate coating solution substantially consists of hexavalent chromate, conducting salts and mineral acids dissolved in water as well as particularly phosphates and silicofluorides. Contrary to a prevailing opinion the formed chromate/phosphate layer is, as evidenced by iodised starch tests, not always 100% chromium(VI)-free. The production of aluminum green in chromate coating solutions exclusively on the basis of chromium(III) is not known.

In accordance with the prior art, thick chromate layers affording high corrosion protection>100 h in the salt spray cabinet according to DIN 50021 SS or ASTM B 117-73 until the appearance of first corrosion products according to DIN 50961 (June 1987) Chapter 10, in particular Chapter 10.2.1.2, in the absence of sealing or any other particular aftertreatment (DIN 50961, Chapter 9) may only be produced by treatment with dissolved, markedly toxic chromium(VI) compounds. Accordingly the chromate layers having the named requirements to corrosion protection still retain these markedly toxic and carcinogenic chromium(VI) compounds, which are, moreover, not entirely immobilised in the layer. Chromate coating with chromium(VI) compounds is problematic with respect to workplace safety. Use of zinc-plated chromations produced with chromium(VI) compounds, such as the widespread yellow chromations e.g. on screws, constitutes a potential hazard to the population and increases the general cancer risk.

U.S. Pat. No. 4,384,902, in particular with Examples 1, 2, 4 and 5, describes conversion layers which satisfy the requirements in the salt spray test. In all of the cases, these are cerium-containing layers presenting a yellowish coloration which is accentuated by the cerium(IV) ion. The examples only contain cerium(III), and hydrogen peroxide as an oxidant, in the bath solution. In the description it is set forth that hydrogen peroxide in the acidic medium does not represent an oxidant for Ce(III), however during deposition the pH value nevertheless rises so high at the surface that a sufficient amount of Ce(IV) may be generated. The yellowish coloration achieved by this bath composition indeed appears to indicate that an oxidation has taken place—however, only an oxidation from Ce(III) to Ce(IV). Tetravalent cerium is an even more powerful oxidant than hexavalent chromium, for which reason Ce(IV) will produce from Cr(III) the Cr(VI) which is to be avoided. Cr(VI) has a very strong yellow coloration and is known as an anticorrosion agent. The layer described in U.S. Pat. No. 4,384,902 is thus not free of hexavalent chromium.

BRIEF DESCRIPTION OF THE DRAWINGS

The file of this patent contains at least one drawing executed in color. Copies of this patent with color drawings will be provided by the Patent Office upon request and payment of the necessary fee.

FIG. 37 is a table containing the evaluation of the depth profile analyses of FIGS. 5 to 36.

DETAILED DESCRIPTION OF THE PREFERRED EMBODIMENTS OF THE INVENTION

Figure 1:
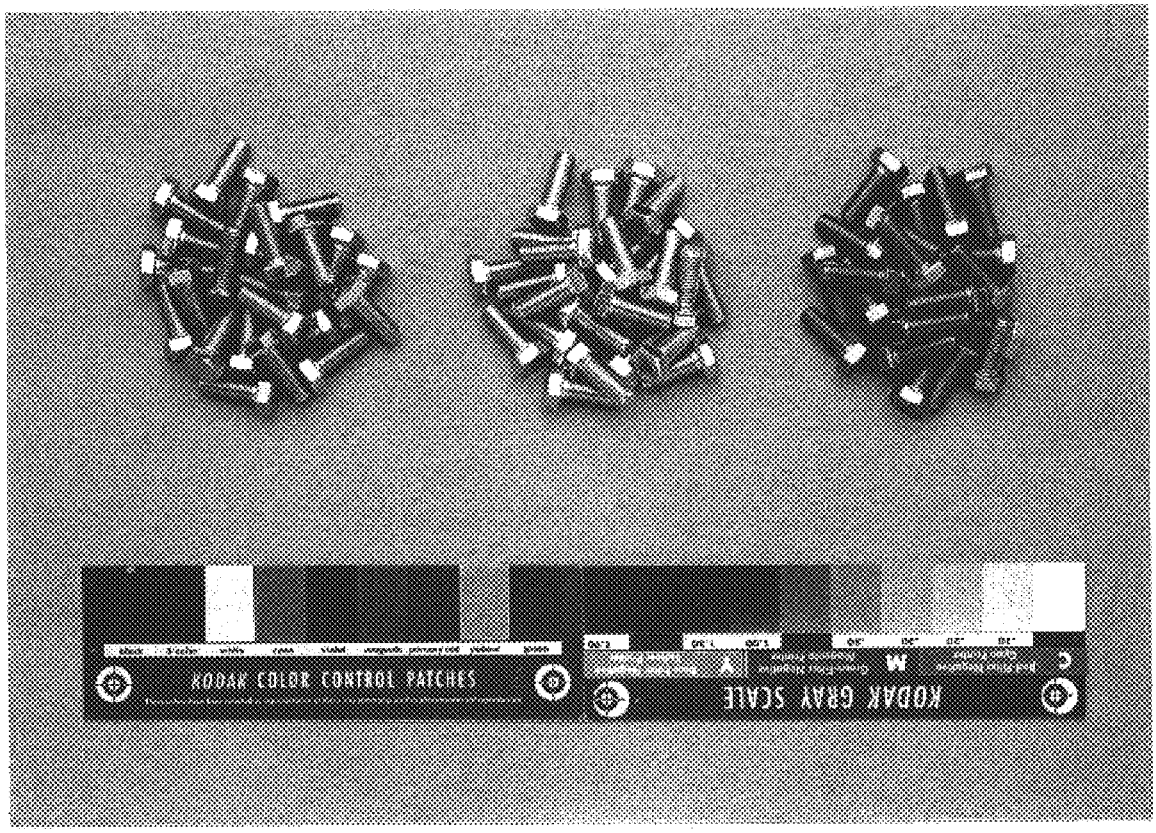
FIG. 1 is a color comparison of various passive layers; it shows a comparison of the present invention with blue and yellow chromations. The substrate is zinc-plated screws. The left picture half is blue chromation; the center is the invention; the right picture half is yellow chromation.

The layer according to the invention is, however, produced in the absence of any oxidant and consequently free of hexavalent chromium. This can in particular be seen from the fact that the layer according to the invention is not yellow.

Even where the yellow coloration and the enhanced corrosion protection should be brought about by nothing but Ce(IV), the layer according to the invention affords the desired corrosion protection even without this very costly and rare addition.

U.S. Pat. No. 4,359,348 also describes conversion layers which satisfy the above mentioned requirements in the salt spray test. These, too, in all cases are cerium-containing layers which present the yellowish coloration accentuated by the cerium(IV) ion. This document thus does not exceed U.S. Pat. No. 4,384,902.

It is therefore an object of the present invention to furnish a chromium(VI)-free, thick conversion layer having a high chromium content on zinc or zinc alloys.

For the purposes of the present inventions the applicant coined the term "chromitation" in order to clearly distinguish the present invention from the chromations which are customary in the prior art, and in order to make clear that neither the obtained conversion layer nor the compositions (concentrates/passivation baths) whereby the coatings according to the invention are produced contain the toxic chromium(VI), whereas the obtained corrosion protection nevertheless is superior to that of yellow chromation.

EP 00 34 040 A1 does describe a multiplicity of layers, of the larger group of which (produced under the standard conditions set forth by Barnes/Ward) the color is not specified, however referred to as clear. Two Examples, namely Nos. 16 and 17, describe a greenish borate-containing layer described as cloudy-dull to non-transparent.

Example 14 describes a layer affording a corrosion protection of only 4 hours.

Concerning the features of the invention, the following should be noted:

In glow-discharge spectrometry several elements could not be detected while others could not be calibrated. Therefore the chromium/(chromium+zinc) phases were compared to each other. The chromium index is the average chromium content in the layer>1% Cr, multiplied by the layer thickness. The chromium index is proportional to the chromium quantity on the surface ($mg/m^2$).

Further advantages and features of the present invention result from the description of embodiments and from theoretical reflections which are not binding on the one hand and were, on the other hand, carried out by the inventors while having knowledge of the present invention, and by referring to the drawings.

The conversion layer preferably has a layer thickness of about 100 to 1000 nm, the conversion layer having across the conversion layer thickness a chromium content of greater than 1% based upon zinc and chromium, the conversion layer having an average chromium content of more than approximately 5% based on zinc and chromium, and the conversion layer having a chromium index greater than approximately 10, wherein the chromium index is defined as the average chromium content (chromium/(chromium+zinc)) in the layer greater than 1% Cr, multiplied by the layer thickness in nm.

Preferably the conversion layer has a chromium-rich zone greater than approximately 20% chromium, based upon zinc and chromium in the conversion layer, of more than approximately 15 nm.

The conversion layer may be transparent, clear, or substantially colorless. The conversion layer may be iridescent, and may present multi-colored iridescence.

For enhanced corrosion protection the conversion layer may additionally contain one or more components selected from the group consisting of silicate, cerium, aluminum, and borate. The conversion layer may contain cobalt or one or more metal compounds having valences of 1 to 6. The conversion layer may include one or more metal compounds selected from the group consisting of Na, Ag, Al, Co, Ni, Fe, Ga, In, La, Ce, Pr, Nd, Pm, Sm, Eu, Gd, Tb, Dy, Ho, Er, Tm, Yb, Lu, Zr, Sc, Ti, V, Cr, Mn, Cu, Zn, Y, Nb, Mo, Hf, Ta, and W.

The conversion layer may include one or more ions selected from the group consisting of anions and may include one or more ions selected from the group consisting of halide ions, sulfurous ions, nitrate ions, phosphorus-containing ions, carboxylic acid anions, and silicon-containing anions.

The conversion layer may include one or more ions selected from the group consisting of chloride ions, sulfate ions, phosphate ions, diphosphate ions, linear and cyclic oligophosphate ions, linear and cyclic polyphosphate ions, hydrogen phosphate ions, and silicate anions.

The conversion layer may include one or more materials selected from the group consisting of polymers, corrosion inhibitors, silicic acids, surfactants, polyols, organic acids, amines, plastics dispersions, dyes, pigments, chromogenic agents, amino acids, siccatives, and dispersing agents.

The conversion layer may include one or more materials selected from the group consisting of organic polymers, colloidal or disperse silicic acids, diols, triols, monocarboxylic acids, carbon black, metal chromogenic agents, glycin, and cobalt siccatives.

The conversion layer may include one or more materials selected from the group consisting of dyes and color pigments.

In a method according to the invention, a metallic surface preferably is treated with a solution of at least one chromium (III) complex and at least one salt, wherein chromium (III) is present in the solution in a concentration of approximately 5 to 100 g/l; and the chromium (III) complex has ligand replacement kinetics more rapid than the fluoride replacement kinetics in chromium (III)-fluorocomplexes. This method produces a chromium (VI)-free conversion layer affording at least the corrosion protection of conventional chromium (VI)-containing yellow chromations.

Metallic surfaces suitable for application of the conversion layer include zinc, zinc alloy, and zinc alloy with iron.

In the method the treating is preferably carried out at an elevated temperature, or at a temperature of 20–100° C., more preferably 20–80° C., more preferably 30–60° C., more preferably 40–60° C.

In the method the chromium (III) complex preferably has chelate ligands which are selected from the group consisting of dicarboxylic acids, tricarboxylic acids, hydroxycarboxylic acids, acetylacetone, urea, urea derivatives, mixtures thereof, among each other as well as in mixed complexes with inorganic anions and $H_2O$.

In the method the chromium (III) complex preferably has chelate ligands which are selected from the group consisting of oxalic, malonic, succinic, glutaric, adipic, pimelic, suberic, azelaic and sebacic acids, mixtures thereof, and in mixed complexes with inorganic anions and $H_2O$.

In the method the chromium (III) complex preferably has chelate ligands which are selected from the group consisting of maleic acid, phthalic acid, terephthalic acid, tartaric acid, citric acid, malic acid, ascorbic acid, mixtures thereof, and in mixed complexes with inorganic anions and $H_2O$.

In the method the chromium (III) complex preferably has chelate ligands which are selected from the group consisting of malonic acid and malonic acid in mixed complexes with inorganic anions and $H_2O$.

The method may be performed repeatedly on the metallic surface.

In the method the treating may be carried out at a temperature of 20 to 100° C. with rinsing water recycling over at least 2 cascaded rinsing stages; a blue chromation may be performed in one of the rinsing stages.

The method may include an immersion period of between approximately 15 and 200 seconds or of between approx. 15 and 100 seconds or an immersion period of approx. 30 seconds.

A passivation bath for passivating a metal surface preferably comprises chromium (III) in a concentration of approximately 5 to 100 g/l; the chromium (III) being present in the bath in the form of at least one chromium (III) complex having ligand replacement kinetics more rapid than the fluoride replacement kinetics in chromium (III)-fluorocomplexes. The bath preferably substantially contains chromium (III) as a passivating component.

The chromium (III) complex in the bath preferably is selected from complexes with chromium (III) and at least one chelate ligand selected from the group consisting of dicarboxylic acids, tricarboxylic acids, hydroxycarboxylic acids, acetylacetone, urea, urea derivatives, mixtures thereof, among each other as well as in mixed complexes with inorganic anions and $H_2O$.

The chromium (III) complex in the bath may be selected from complexes with chromium(III) and at least one chelate ligand selected from the group consisting of oxalic, malonic, succinic, glutaric, adipic, pimelic, suberic, azelaic and sebacic acids, mixtures thereof, and in mixed complexes with inorganic anions and $H_2O$.

The chromium (III) complex in the bath may be selected from complexes with chromium(III) and at least one chelate ligand selected from the group consisting of maleic acid, phthalic acid, terephthalic acid, tartaric acid, citric acid, malic acid, ascorbic acid, mixtures thereof, and in mixed complexes with inorganic anions and $H_2O$.

The chromium (III) complex in the bath may be selected from complexes with chromium (III) and at least one chelate ligand selected from the group consisting of malonic acid and malonic acid in mixed complexes with inorganic anions and $H_2O$.

The bath may also include one or more components selected from the group consisting of sealers, dewatering fluids, additional metal compounds, anions, polymers, corrosion inhibitors, silicic acids, surfactants, polyols, organic acids, amines, plastics dispersions, dyes, pigments, chromogenic agents, amino acids, siccatives and dispersing agents. The bath may also include one or more components selected from the group consisting of 1- to 6-valent metal compounds, halide ions, sulfurous ions, nitrate ions, phosphoric ions, carboxylic acid anions, silicon-containing anions, organic polymers, colloidal or disperse silicic acids, diols, triols, monocarboxylic acids, carbon black, metallic chromogenic agents, glycin, and cobalt siccatives. The bath may also include one or more components selected from the group consisting of metal compounds of Na, Ag, Al, Co, Ni, Fe, Ga, In, La, Ce, Pr, Nd, Pm, Sm, Eu, Gd, Tb, Dy, Ho, Er, Tm, Yb, Lu, Zr, Sc, Ti, V, Mn, Cu, Zn, Y, Nb, Mo, Hf, Ta, and W, chloride ions, sulfate ions, phosphate ions, diphosphate ions, linear and cyclic oligophosphate ions, linear and cyclic polyphosphate ions, hydrogen phosphate ions and silicate anions. Chromium (III) is preferably present in the bath in a concentration of approximately 5 g/l to 80 g/l, more preferably approximately 5 g/l to 60 g/l, more preferably approximately 10 g/l to 30 g/l, more preferably approximately 20 g/l. The bath preferably has a pH between approximately 1.5 and 3, more preferably approximately 2 to 2.5. The temperature of the bath is preferably approx. 20 to 100° C., more preferably approximately 20 to 80° C., more preferably approximately 30 to 60 ° C., more preferably approx. 40 to 60° C.

To facilitate preparation of a passivation solution, a concentrate may be prepared. The concentrate preferably substantially contains chromium (III) for a passivating component, wherein the chromium (III) is present in the form of at least one complex having ligand replacement kinetics more rapid than the fluoride replacement kinetics in chromium (III)-fluorocomplexes. The concentrate is preferably in either liquid or solid form. The concentrate may be used for producing a passivation solution for passivating a metal surface such as a metal surface selected from the group consisting of zinc, cadmium, aluminum and alloys of these metals among each other and/or with iron or other metals.

EXAMPLE 1

The following experiment was carried out:

Small steel parts were bright-zinc coated electrolytically (approx. 15 m) and, following galvanisation, singly immersed in a boiling (approx. 100° C.), aqueous solution containing:

| | |
|---|---|
| 100 g/l | $CrCl_3 \cdot 6H_2O$ (trivalent chromium salt) |
| 100 g/l | $NaNO_3$ |
| 15.75 g/l | NaF |
| 26.5 g/l | citric acid · 1 aq |

which had previously been adjusted to a pH value of 2.5 with sodium hydroxide solution. The immersion time was 30 s. The parts were then rinsed with water and dried in air flow. On the parts a greenish, strongly iridescent layer had formed which later on turned out to be comprised of zinc/chromium oxide. In the corrosion test in the salt spray cabinet according to DIN 50021 SS it was surprisingly found that the chromate layer formed presented a spectacular corrosion protection until the appearance of first corrosion products of 1000 h according to DIN 50961 Chapter 10, in particular Chapter 10.2.1.2.

The novel greenish chromate layer had a layer thickness of approx. 800 nm and was produced by a process not involving any chromium(VI) and could be proven to be chromium(VI)-free.

The production method according to Example 1 for the novel, greenish chromium(VI)-free chromation is not very economical for conventional plants due to the relatively high temperature of the process solution. Further theoretical reflections concerning chromium(VI)-free chromate coating and further trials finally resulted in economical production conditions.

Theoretical Reflections Concerning Chromium(VI)-Free Chromation

Chromate coating of zinc takes place by the formation of a so-called conversion layer on the zinc surface, i.e. the zinc surface chemically reacts with the chromate coating solution and is converted into a chromate layer. The formation of conversion layers is a dynamic process beyond chemical equilibrium. In order to describe the underlying processes, one must therefore employ chemical kinetics. By the especially established kinetic model it was possible to obtain starting points in order to optimise the present invention.

Conversion layer formation in a chromium(III)-based chromate coating solution may be described by means of two reaction equations:

I Elementary zinc passes into solution due to acid attack:

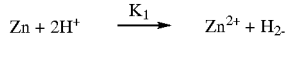

$$Zn + 2H^+ \xrightarrow{K_1} Zn^{2+} + H_2.$$

II and precipitates on the zinc surface as zinc chromium oxide together with chromium(III):

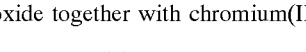

$$Zn^{2+} + xCr^{(III)} + yH_2O \rightarrow ZnCr_xO_y + 2yH^+$$

The kinetic model must encompass differential equations for the concentration developments of $Zn^2$, $H^{+,\ Cr(III)}$ and for the thickness growth of the ZnCrO layer. In the reaction rate starting points it was taken into consideration by inserting the term $1/(1+p_1 \cdot m_{ZnCrO})^2$ that Reaction I is increasingly slowed down by the growing passive layer. P1 is a measure for tightness of the layer.

$$\frac{dc_{Zn^{2+}}}{dt} = k_1 \times c_{H^+}/a + p_1 \times m_{ZnCrO})^2 - \quad \text{Reaction I}$$

$$k_2 \times c_{Zn^{2+}} \times c_{Cr(III)} + k_3 \times c_{H^+} \times \tanh(p_2 \times m_{ZnCrO}) + \quad \text{Reaction II}$$

$$k_T \times (c_{0,Zn^{2+}} - c_{Zn^{2+}}) \quad \text{Mass transfer}$$

$$\frac{dc_{H^+}}{dt} = -2k_1 \times c_{H^+}/a + p_1 \times m_{ZnCrO})^2 + \quad \text{Reaction I}$$

$$2yk_2 \times c_{Zn^{2+}} \times c_{Cr(III)} - 2yk_3 \times 3_{H^+} \times \tanh(p_2 \times m_{ZnCrO}) + \quad \text{Reaction II}$$

-continued $$k_T \times (c_{0,H^+} - c_{H^+})$$ Mass transfer $$\frac{dc_{Cr(III)}}{dt} = -xk_2 \times c_{Zn^{2+}} \times c_{Cr(III)} + xk_3 \times c_{H^+} \times \tanh(p_2 \times m_{ZnCrO}) + k_T \times (c_{0,Cr(III)} - c_{Cr(III)} - c_{Cr(III)})$$ Reaction II; Mass transfer $$\frac{dm_{ZnCrO}}{dt} = k_2 \times c_{Zn^{2+}} \times c_{Cr(III)} - k_3 \times c_{H^+} \times \tanh(p_2 \times m_{ZnCrO})$$ Reaction II The term tan h($p_2 \cdot m_{ZnCrO}$) represents the indispensable precondition of reverse reaction II namely the presence of ZnCrO. The tan h function provides for a smooth transition from 0 to 1, which may be adjusted with P2. The differential equation system was resolved numerically by means of a computer. As a result, the layer thickness developments and the concentration developments over time were obtained. As starting values for time $t_0$=0 there were employed:

$$c_{0,Zn^{2+}} = 0$$

$$c_{0,H^+} = 10^{-2}\text{mol/l (pH 2)}$$

$$c_{0,Cr(III)} = 0{,}5 \text{ mol/l}$$

$$m_{0,ZnCrO} = 0$$

Figure 38:
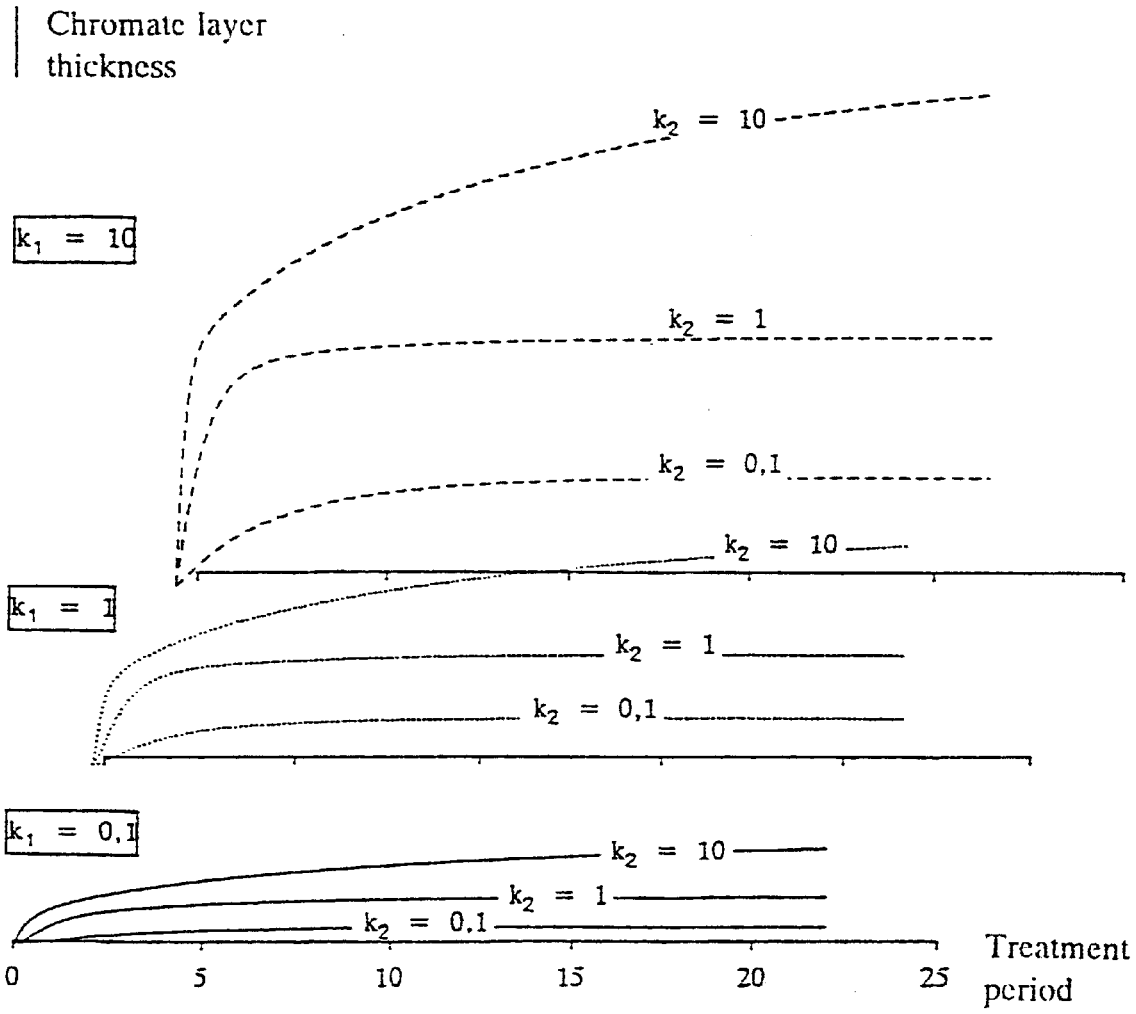
FIG. 38 is a computer simulation of the kinetic model of chromate coating of zinc for various rate constants.

In FIG. 38 the layer thickness developments for various values of the rate constant kj are represented. For good corrosion protection, the passive layer should have maximum possible thickness and at the same time compactness.

FIG. 38 shows a computer simulation of the kinetic model for chromate coating of zinc for various rate constants.

The faster the initial dissolution of zinc (rate constant $k_1$) is and the faster the dissolved zinc precipitates with the chromium(III) (rate constant $k_2$), the thicker the chromate layer will become. Layer growth is strongly favored by the presence of zinc already dissolved in the bath, which fact resulted from simulations with $c_{O,Zn}2+>0$. A lower pH value favors dissolution of zinc but also brings about increased redissolution of the layer.

Based on the model, basically two demands may be established for producing a maximum possible thickness chromate layer. Reaction I and forward reaction II must take place as rapidly as possible, the reverse reaction II must remain slow. In this sense, there result the following starting points:

| Reaction I | |
|---|---|
| a | pH optimisation |
| b | Avoiding carrying over of inhibitors from the zinc bath |
| c | Addition of oxidants for accelerating zinc dissolution |
| d | Acceleration of zinc dissolution by formation of galvanic elements |

Forward Reaction II e The rate constant $k_2$ should be as high as possible. Chromium(III) complexes generally have slow kinetics. By using suitable ligands it should be possible to accelerate the reaction rate.

f Upon use of further transition metal cations in the chromate coating solution there also result i.a. higher rate constants than for Cr(III). Moreover these transition metal cations may act as catalysts in ligand replacement on chromium(III).

Reverse Reaction II g Insertion of poorly redissolvable hydroxides, e.g. nickel, cobalt and/or copper hydroxide.

Serial investigations were carried out. Starting points a and b are known to the skilled person. Acceleration of zinc dissolution via points c and d did also result in thick coatings, however yellowish ones having a chromium/zinc ratio of 1:4 to 1:3, which only afforded low corrosion protection. It was found that good corrosion protection values may only be obtained at chromium/zinc ratios above 1:2.

A higher chromium/zinc ratio at concurrently thicker chromate layers is obtained when the rate constant $k_2$ (starting point e) is raised, or the forward reaction II is accelerated. After the inventors of the present application had realised that hot chromium(III) solutions result in surprising passive layers, there are the following possibilities in connection with the inventors' theoretical reflections:

Raising the temperature of the chromate coating solution and/or of the partial surface Raising the chromium(III) concentration in the process solution Acceleration of ligand replacement kinetics at the chromium(III).

Herefor one should know that chromium(III) in aqueous solutions is essentially present in the form of hexagonal complexes generally having high kinetic stability, and moreover that ligand replacement is the step determining the rate in forward reaction II. By the selection of suitable complex ligands, with which the chromium(III) forms kinetically less stable complexes, $k_2$ is accordingly increased.

Addition of elements having a catalytic effect on ligand replacement into the chromate coating solution.

In serial investigations chelate ligands (such as di- and tricarboxylic acids as well as hydroxydi- and hydroxytricarboxylic acids) as such forming kinetically less stable complexes with chromium(III), whereas the fluoride complexes are kinetically very stable. When using only such chelate ligands for complexing the chromium(III) and omitting fluoride in the passivation solution, excellent results were obtained even at a treatment temperature of only 60° C., as is shown by Examples 2 and 3.

EXAMPLE 2

Electrolytically bright-zinc coated (15 m) steel parts were immersed in an aqueous chromate coating solution containing:

50 g/l $CrCl_3.6\ H_2O$ (trivalent chromium salt)

100 g/l $NaNO_3$ 31,2 g/l malonic acid the pH of which had previously been adjusted to 2.0 with sodium hydroxide solution. The immersion time was 60 s. Following rinsing and drying there resulted in the salt spray cabinet according to DIN 50021 SS a corrosion protection of 250 h until first attack according to DIN 50961.

Malonic acid is a ligand enabling more rapid ligand replacement kinetics at the chromium(III) than the fluoride of Example 1. Good corrosion protection by far exceeding the minimum requirement of DIN 50961 for Method Group C (yellow chromation) may thus already be achieved at 60° C.

EXAMPLE 3

Electrolytically bright-zinc coated (15 m) steel parts were immersed in an aqueous chromate coating solution consisting of:

50 g/l $CrCl_3.6\ H_2O$ (trivalent chromium salt)

3 g/l $Co(NO_3)_2$ 100 g/l $NaNO_3$ 31,2 g/l malonic acid previously adjusted to pH 2.0 with sodium hydroxide solution. Immersion time was 60 s. Following rinsing and drying there resulted in the salt spray cabinet according to DIN 50021 SS a corrosion protection of 350 h until first attack according to DIN 50961.

Cobalt is an element which was capable, in accordance with the model concept, of catalysing ligand replacement and moreover reducing reverse reaction II owing to insertion of kinetically stable oxides into the chromate layer, so that the chromate layer altogether should become thicker. In this point, as well, the model concept established for the present invention is verified under practical conditions. Corrosion protection could once more clearly be enhanced in comparison with Example 3 by nothing but the addition of cobalt into the chromate coating solution.

Novel greenish chromate layers on zinc were produced in analogy with Example 2 at 40, 60, 80 and 100° C. The layer thicknesses of the respective chromate layers were determined by RBS (=Rutherford-Backscattering) testing. In the Table the corresponding corrosion protection values in hours of salt spray cabinet according to DIN 50021 SS until first attack according to DIN 50961 Chapter 10 are additionally listed.

| J/° C. | thickness/nm | Corr. Prot./h |
|---|---|---|
| 40 | 100 | 50–60 |
| 60 | 260 | 220–270 |
| 80 | 400 | 350 450 |
| 100 | 800 | 800–1200 |

Depending on the complex ligands used, which is malonate in Examples 2 and 3, it is partly possible to achieve even considerably higher layer thicknesses and corrosion protection values. By complex ligands containing as the complexing functional group nitrogen, phosphorus or sulfur, (—$NR_2$, —$PR_2$ wherein R independently is an organic, in particular aliphatic radical and/or H, and/or —SR, wherein R is an organic, in particular aliphatic radical or H,), it is possible to even produce the indicated layer properties within limits at room temperatures.

EXAMPLE 4

Steel parts electrolytically coated with a zinc/iron alloy (0.4–0.6% iron) were immersed at 60° C. in the following aqueous chromate coating solution:

50 g/l $CrCl_3.6\ H_2O$ 100 g/l $NaNO_3$ 31.2 g/l malonic acid

The solution was beforehand adjusted to pH 2.0 with NaOH. Immersion time was 60 s. Following rinsing and drying a transparent, greenish, slightly grey, strongly iridescent layer was visible on the zinc/iron. In the salt spray cabinet in accordance with the above specified DIN and ASTM standards there resulted a corrosion protection of 360 h until first attack according to DIN 50961.

EXAMPLE 5

Steel parts electrolytically coated with a zinc/nickel alloy (8–13% nickel) were immersed at 60° C. into the following aqueous chromate coating solution:

50 g/l $CrCl_3.6\ H_2O$ 100 g/l $NaNO_3$ 31.2 g/l malonic acid

The solution was beforehand adjusted to pH 2.0 with NaOH. Immersion time was 60 s. Following rinsing and drying a transparent, greenish, dark-grey, strongly iridescent layer was visible on the zinc/nickel. In the salt spray cabinet in accordance with the above specified DIN and ASTM standards there resulted a corrosion protection of 504 h until first attack according to DIN 50961.

The novel greenish chromium(VI)-free chromate layer accordingly depending on the production temperature has a thickness of between 100 and 1000 nm, has a weakly green inherent color and a red-green iridescent coloring. The chromate coating solution consists of trivalent chromates, moreover of conducting salts and mineral acids. Application of the chromate coating solutions is generally performed at temperatures above 40° C. The corrosion protection of unmarred greenish chromium(VI)-free chromate coatings depending on the production temperature amounts to 100–1200 h in the salt spray cabinet according to DIN 50021 SS until the first appearance of corrosion products. Thus the novel chromation satisfies the minimum requirements to corrosion protection for Method Groups C and D according to DIN 50961 (Chapter 10, Table 3), i.e. without chromium (VI) either in production or in the product.

By the present invention it is for the first time made possible to provide chromium(VI)-free conversion layers or passive layers on the basis of chromium(III), which do, however, furnish the corrosion protection of yellow chromations customary in the prior art—i.e., of chromium(VI)-containing passive layers.

This is a singular novelty in the entire galvanisation industry.

Hitherto on a chromium(III) basis only clear to blue layers, referred to as "blue passivation" in technical circles, were known which are variously applied practically.

Moreover yellowish-transparent layers with an addition of cerium are known which are, however, not used practically owing to the very costly cerium addition and their poor corrosion protection properties.

Moreover powdery-greenish layers are known for which the applicant—one of the leading enterprises in the field of surface technology—is not aware of any practical applications.

Even the difference in terms of color of the conversion layers of the present invention is conspicuous in FIG. 1, wherein three treatment methods were performed on zinc-plated screws.

The left-hand pile of screws in accordance with the illustration of FIG. 1 was subjected to a classical blue chromation in accordance with the standard of Method Group B according to DIN 50961 Chapter 10 table 3.

The right-hand pile of screws on the photograph according to FIG. 1 was subjected to a conventional yellow chromation in accordance with the standard of Method Group C according to DIN 50961 Chapter 10 table 3.

The center pile of screws shows the result of passivation of the screws by means of the method in accordance with the invention.

This is consequently a greenish-iridescent, transparent conversion layer, or passive layer.

Moreover the colors represented in FIG. 1 are the true colors, which can be seen from the fact that a color plate and moreover a grey wedge was jointly photographed for the purpose of neutral color representation.

As can be seen from the white test field "White" and from the corresponding field having the density "0.00" from the grey wedge, both test fields are pure white, making evident the neutral filtering and the resulting realistic color representation.

Figure 2:
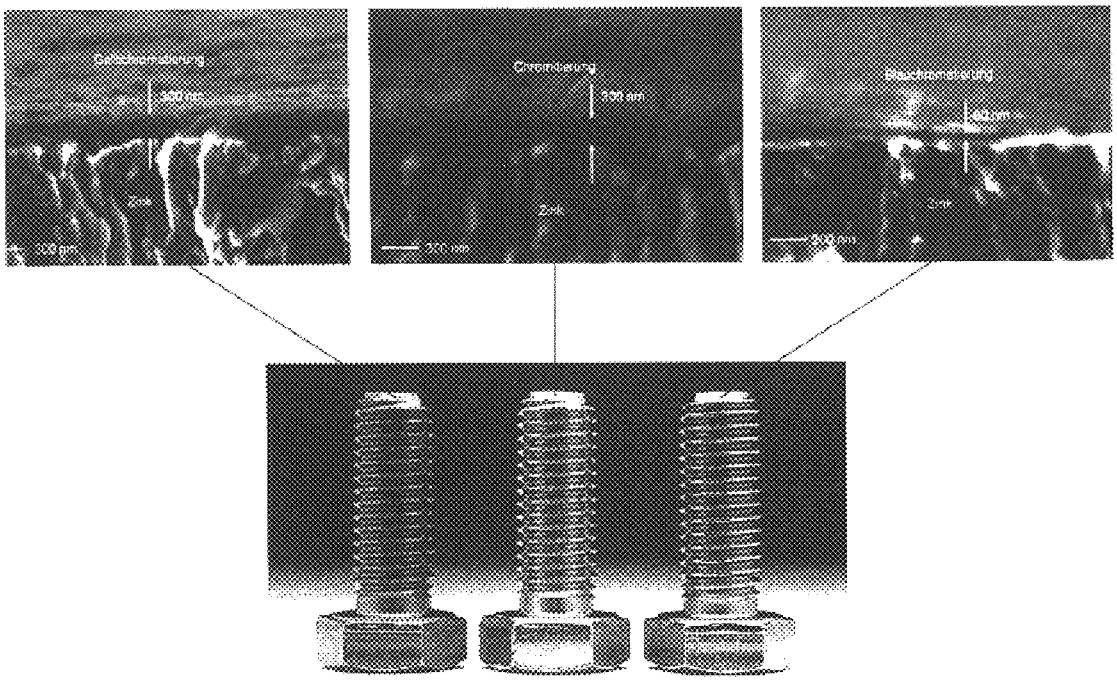
FIG. 2 is a scanning electron microscope image (40,000×) showing a comparison of the present invention ("chromitation") with blue and yellow chromations. "Gelbchromatierung" means yellow chromation; "Chromitierung" means chromitation; "Blauchromatierung" means blue chromation; "Zink" means zinc.

In FIG. 2 scanning electron microscope (SEM) images of the conversion layers of a yellow chromation and of a blue chromation in accordance with the prior art are shown in comparison with the "chromitation" of the present invention.

The layer samples are derived from the correspondingly passivated zinc-plated iron screws shown in FIG. 2, lower half.

The samples treated in accordance with the invention (by "chromitation") presented a chromium(VI)-free conversion layer having a thickness of approx. 300 nm. In the photographs of FIG. 2 it should be considered that the layers were photographed in a viewing angle of approx. 40°, resulting in foreshortening by approx. cos (40°)=0.77.

Based on the SEM images of the chromitation layer of the invention it therefore results that conversion layer thicknesses like in yellow chromation are obtained, however with the difference that the conversion layer of the invention does not contain any toxic chromium(VI).

Figure 3:
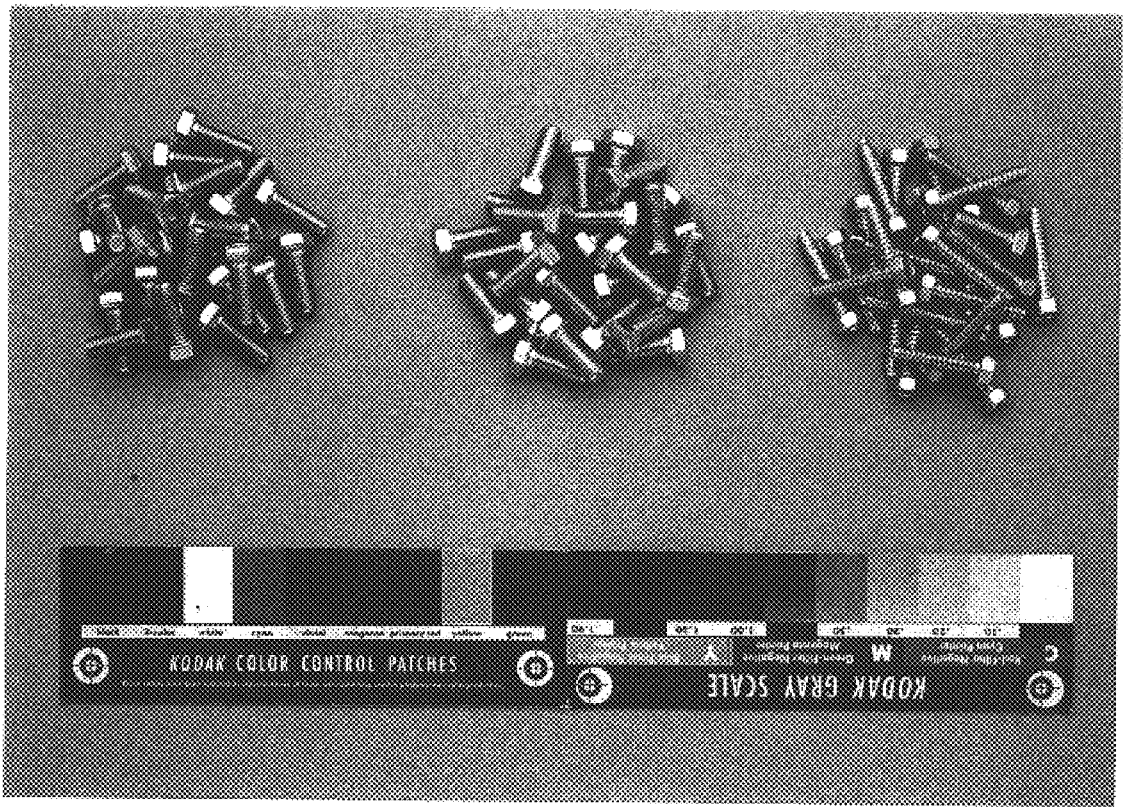
FIG. 3 is a color photo showing the band width of the iridescent coloring in accordance with the present invention on zinc surfaces (zinc-plated screws)

The color photograph of FIG. 3 moreover shows the bandwidth of the iridescent coloring of the passive layer according to the invention under practical conditions.

It can already be seen in the photographs of FIGS. 1 and 3 that the passive layer according to the invention does not contain any chromium(VI) ions as it lacks the typically yellow color (cf. right-hand pile of screws of the color photograph of FIG. 1).

Objects according to the photograph of FIGS. 1 and 3 as well as zinc-plated steel sheets passivated by the method of the invention were tested in the salt spray cabinet according to DIN50021SS or ASTM B 117-73, respectively, until the occurrence of first corrosion products according to DIN50961 Chapter 10. Herein it was surprisingly found that the passive layers of the present invention, and thus the objects passivated by the present method, fulfilled the corrosion protection of chromium(VI) passivations, i.e. yellow chromations, although not containing any chromium(VI).

It is worth mentioning that a typical yellow chromation of the prior art affords resistance for approx. 100 hours of exposure to saltwater in accordance with the above specified DIN or ASTN standard, whereas even the tenfold corrosion protection was achieved by the passive layers of the present invention.

The layers of the present invention as well as the methods for producing this layer, or the method for passivation of metal surfaces, thus satisfy the long-standing demand in this technical field for conversion layers doing without any toxic and carcinogenic chromium(VI) compounds while nevertheless even presenting and generally even excelling the corrosion protection of yellow chromations.

EP 00 34 040 A1 does describe a multitude of layers, wherein the colorations of the larger group thereof (produced under the standard conditions set forth by Barnes/Ward) are not specified, however which are referred to as clear. Two examples, i.e. Nos. 16 and 17, describe a greenish, borate-containing layer referred to as cloudy-dull to non-transparent.

Example 14 describes a layer affording a corrosion protection of no more than 4 hours.

In Example 15 of EP 00 34 040, an aluminum-containing layer is described which attains a corrosion protection of 100 hours. This is achieved—in comparison with the remaining examples—merely by the corrosion protection additive aluminum which is lacking in the present invention. Aluminum-free layers of identical or similar baths do, however, only present poor corrosion protection. The layer according to the invention offers significantly higher corrosion protection, namely up to 1000 h, even without this addition.

Examples 16 and 17 describe layers affording a corrosion protection of 300 and 200 hours in the salt spray test and thus in the range claimed by the applicant. Description page 19, line 7 sets forth that layers of more than 1000 nm are required for good corrosion protection. It is thus understandable that these layers, without exception moreover produced from solutions containing boric acid, are described to be cloudy and rather non-transparent (page 14, line 10). The enhanced corrosion protection, in accordance with page 15, lines 1–5, is due to the insertion of borate-containing species.

The layer according to the invention, on the other hand, also offers high (and even higher) corrosion protection without this addition.

There is, however, another difference that is relevant in terms of patent law as well as in practical application: namely, the layers described in Examples 16 and 17 of EP 00 34 040 are soft and come off when wiped and consequently require some sort of hardening process as an after-treatment (page 17, lines 12–21).

The present layers according to the invention are hard and resistant to wiping even without a hardening process, and adhere well. Corrosion protection layers which come off when wiped and which do not adhere to the substrate are useless for practical application.

Figure 4:
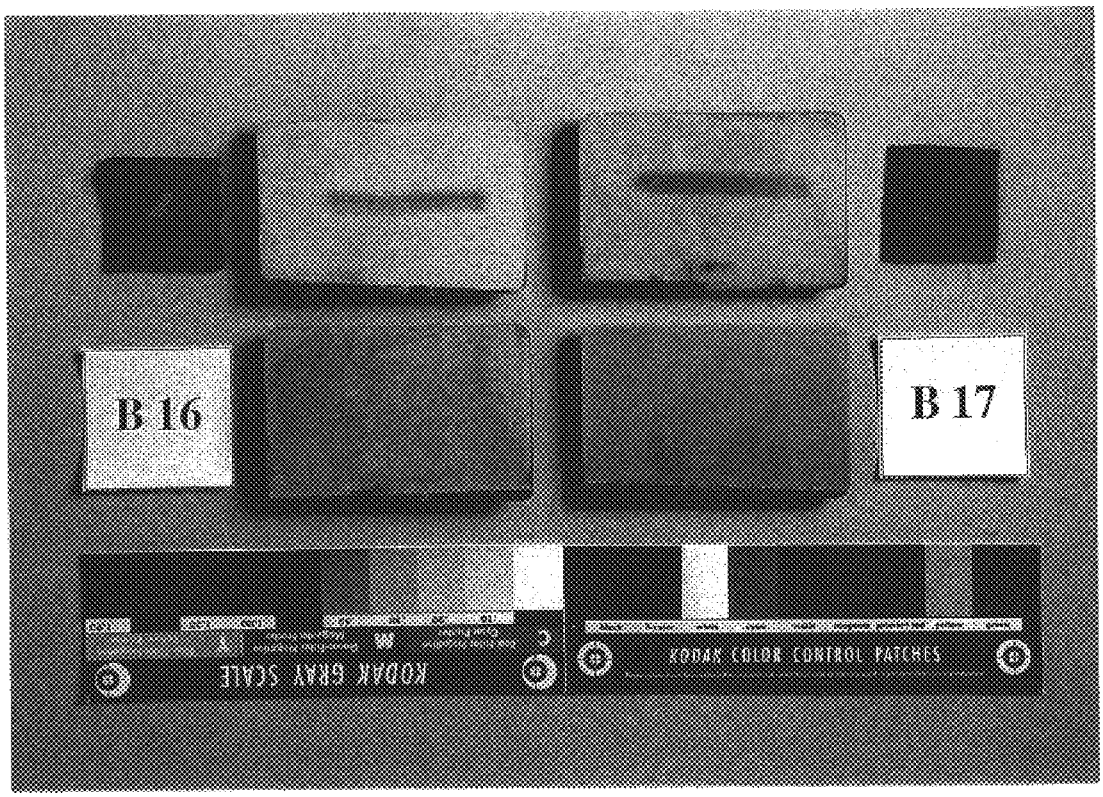
FIG. 4 a comparison test with EP 0 034 040, shows coatings of the prior art in accordance with EP 0 034 040. Example 16 is on the left hand side, Example 17 is on the right hand side. The upper picture half, on the outer left and right, shows a black cloth whereby the abrasions on the metal sheets shown in the top picture half were obtained. Layer portions—discernible as whitish stains—are on both pieces of cloth. The lower picture half shows the unmarred layers of the prior art. The substrate is zinc-plated steel sheet.
Figure 5:
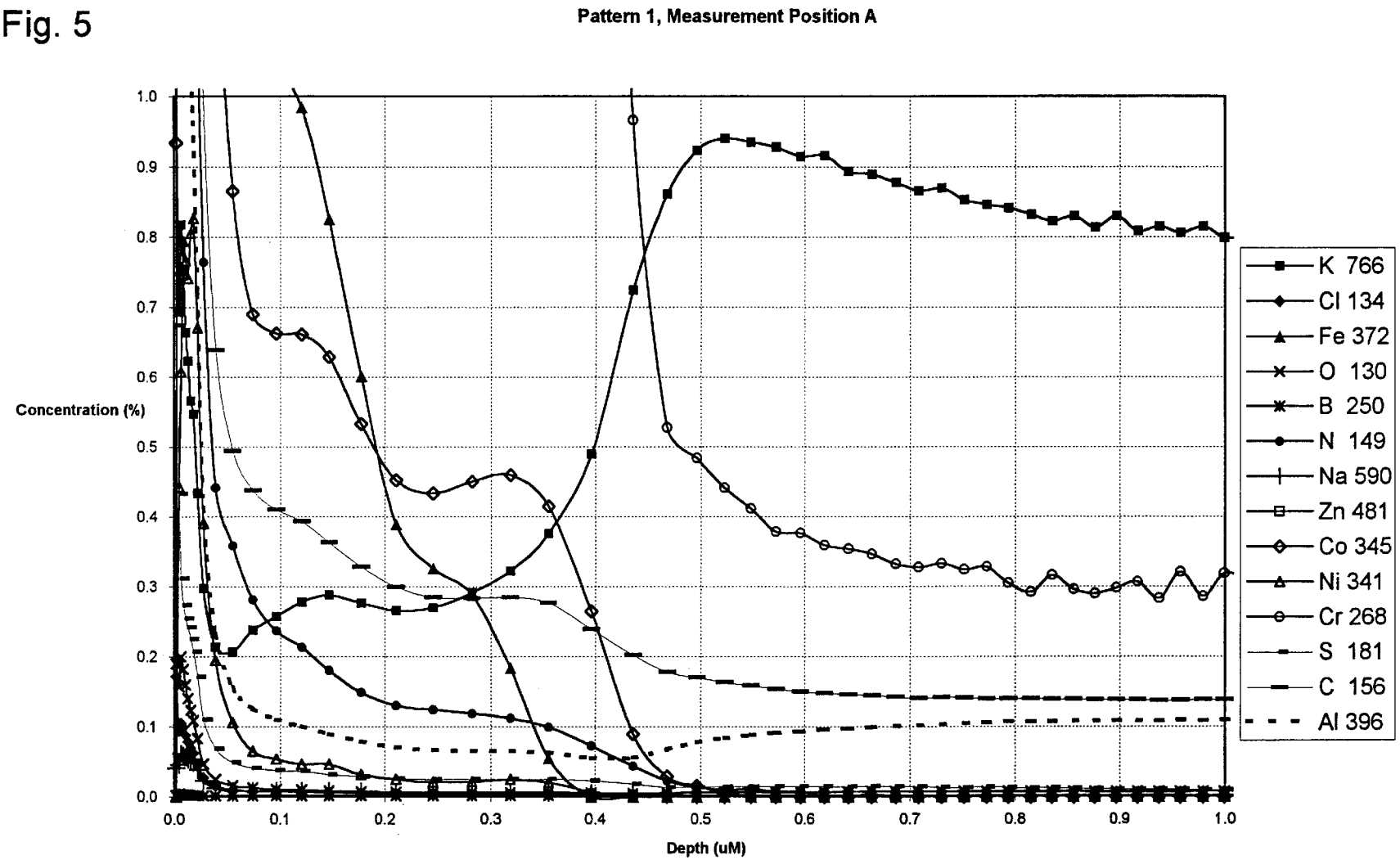
FIGS. 5 to 36 show depth profile analyses of layers according to the invention and layers resulting from the conventional blue and yellow chromations, wherein the depth profile analyses were measured by glow-discharge spectrometry (spectrometer: JY5000RF)
Figure 6:
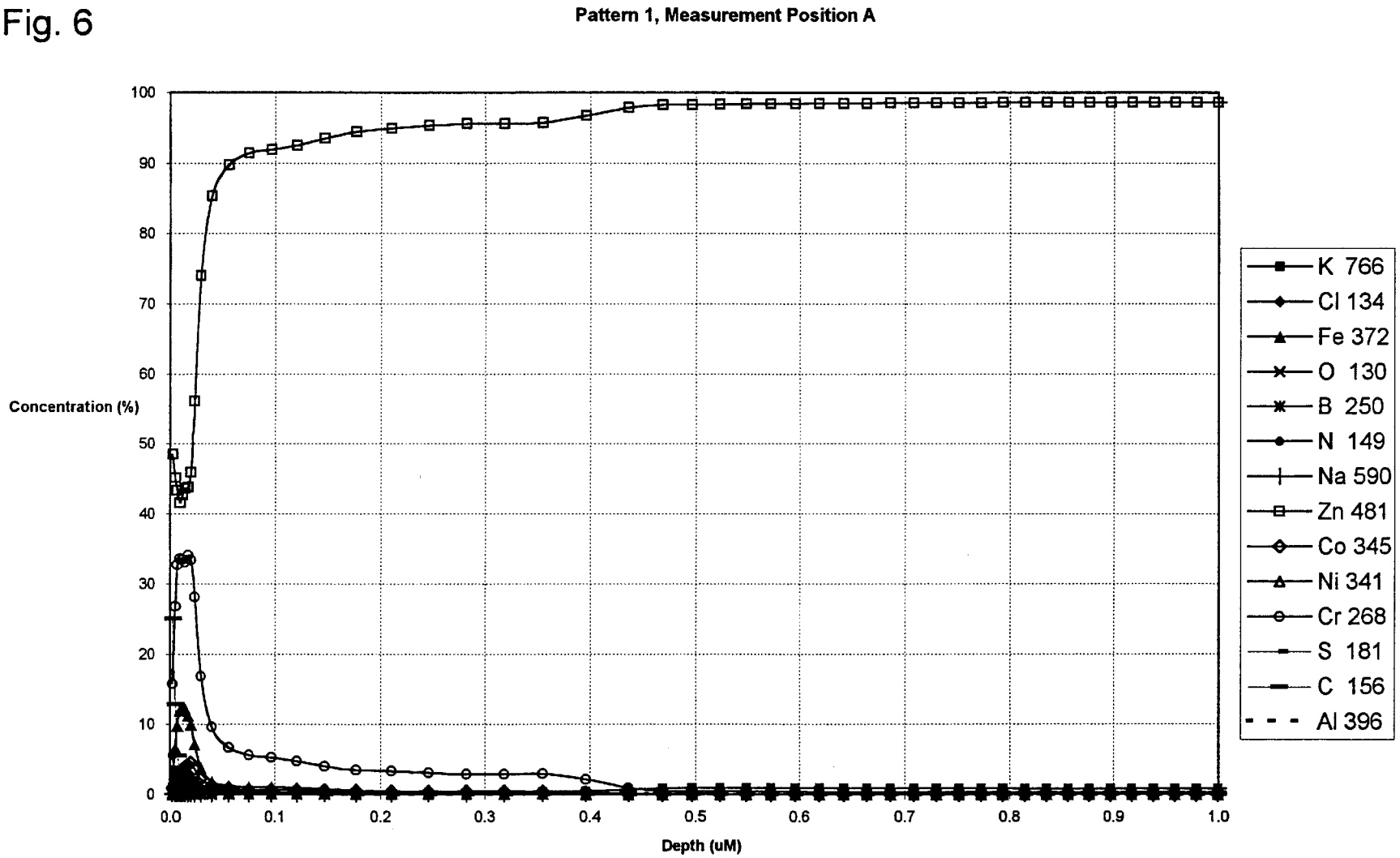
Figure 7:
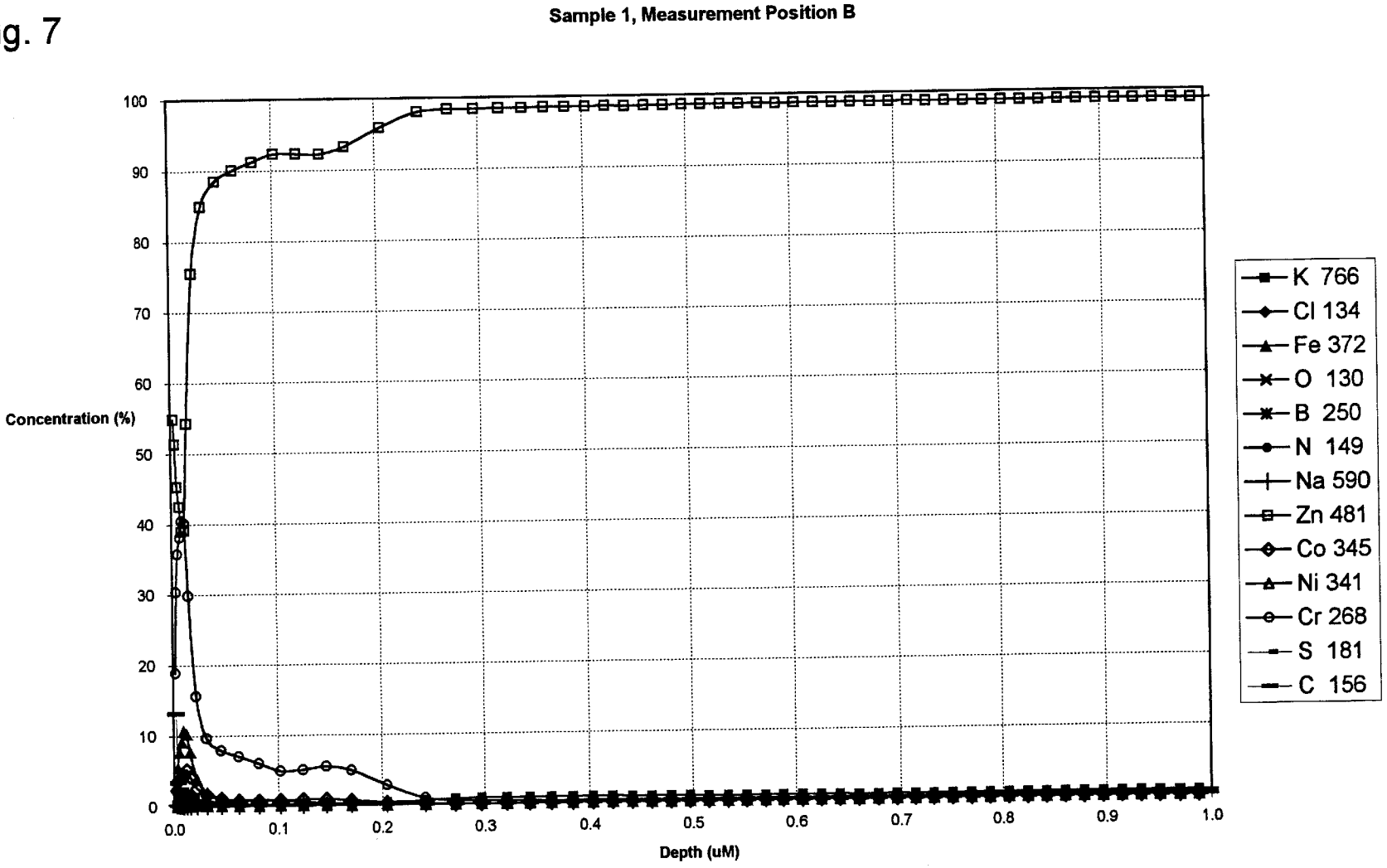
Figure 8:
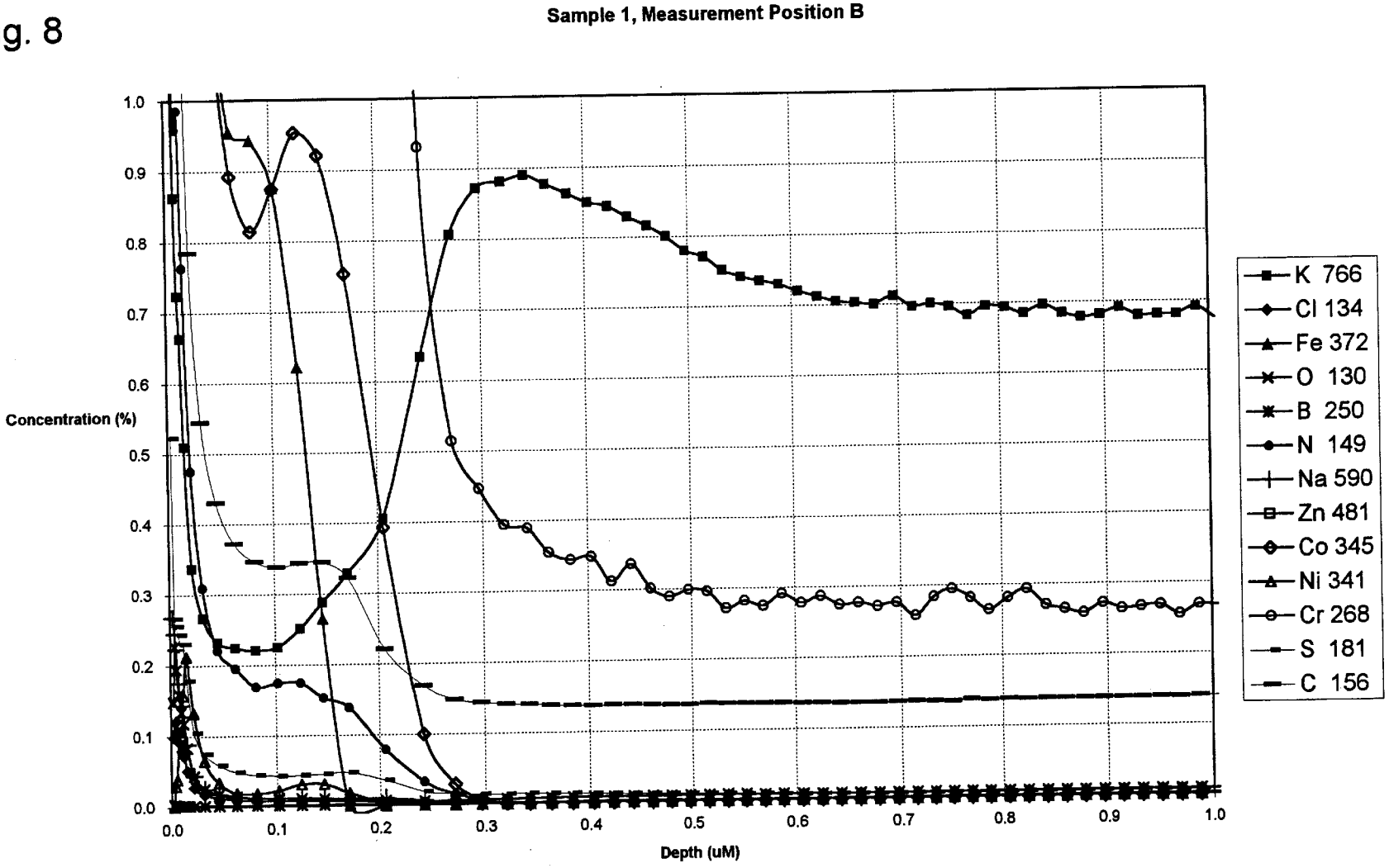
Figure 9:
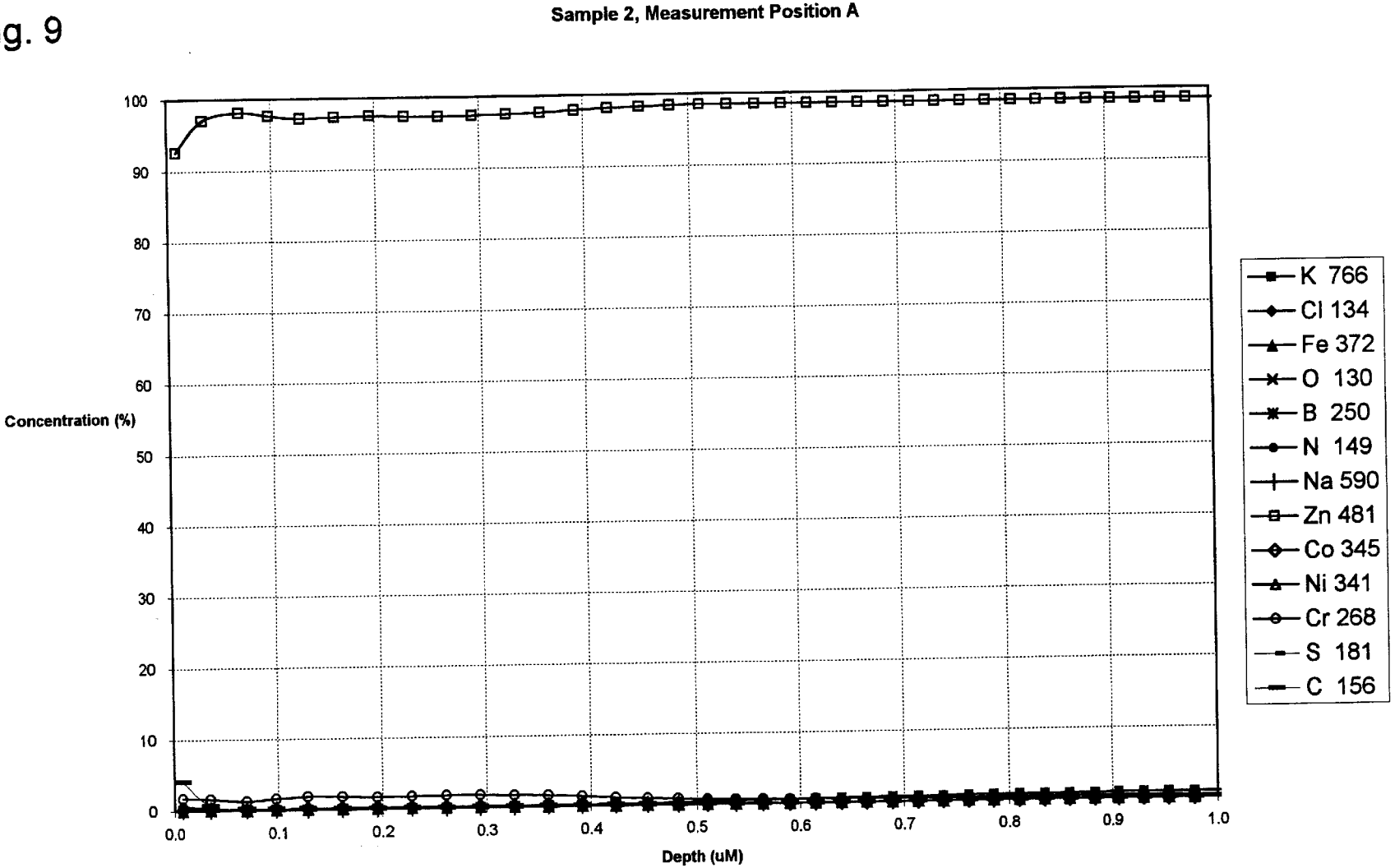
Figure 10:
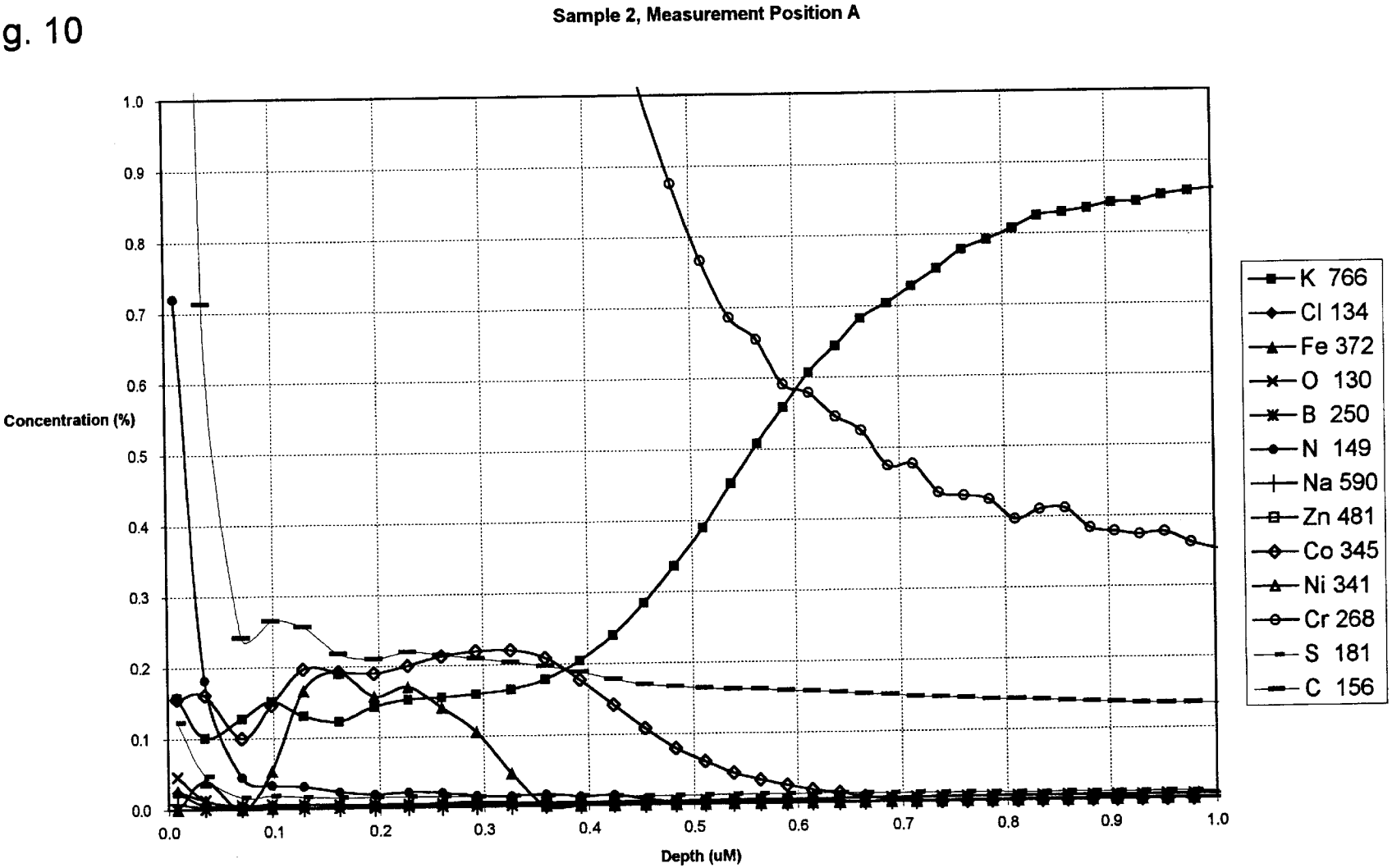
Figure 11:
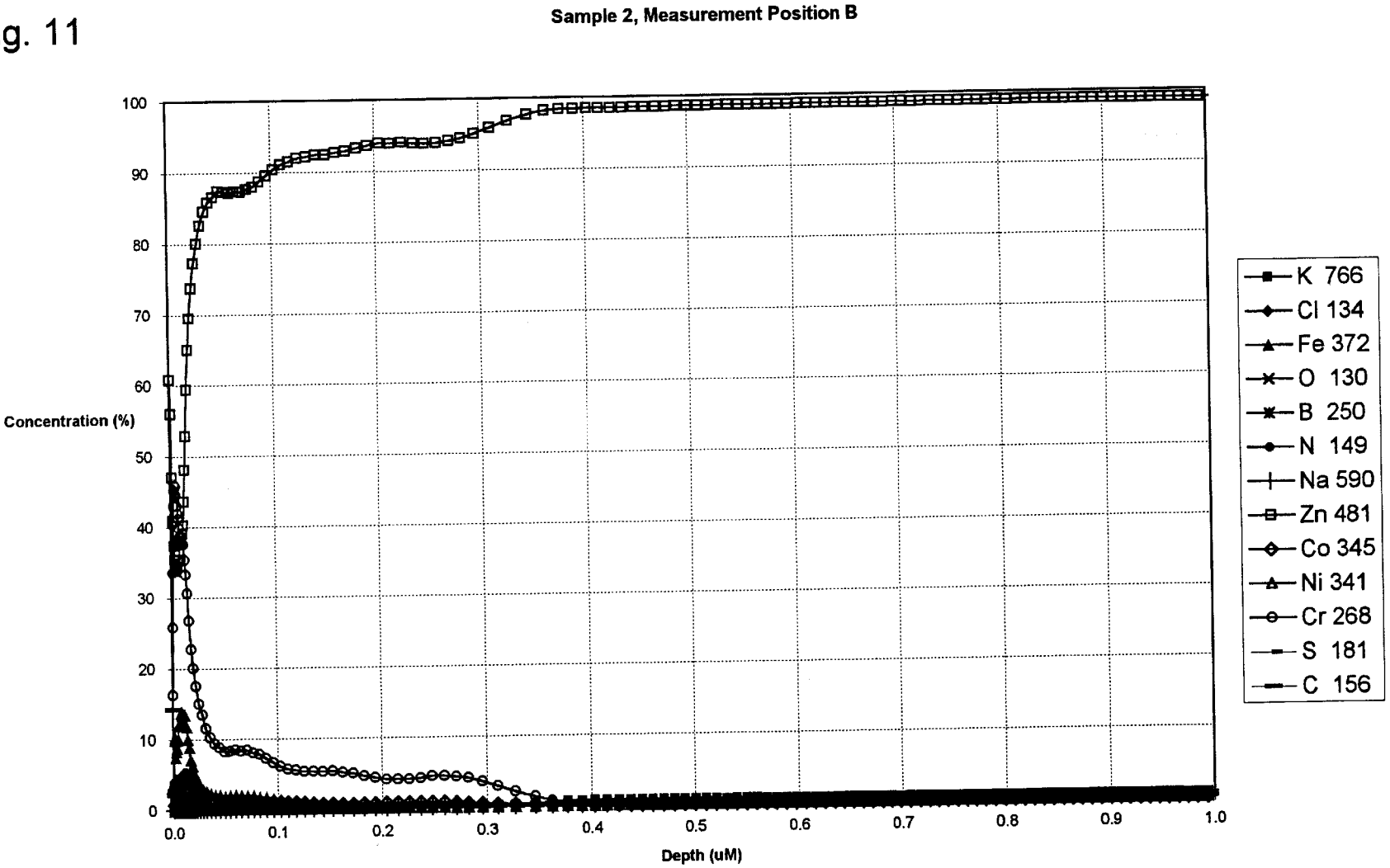
Figure 12:
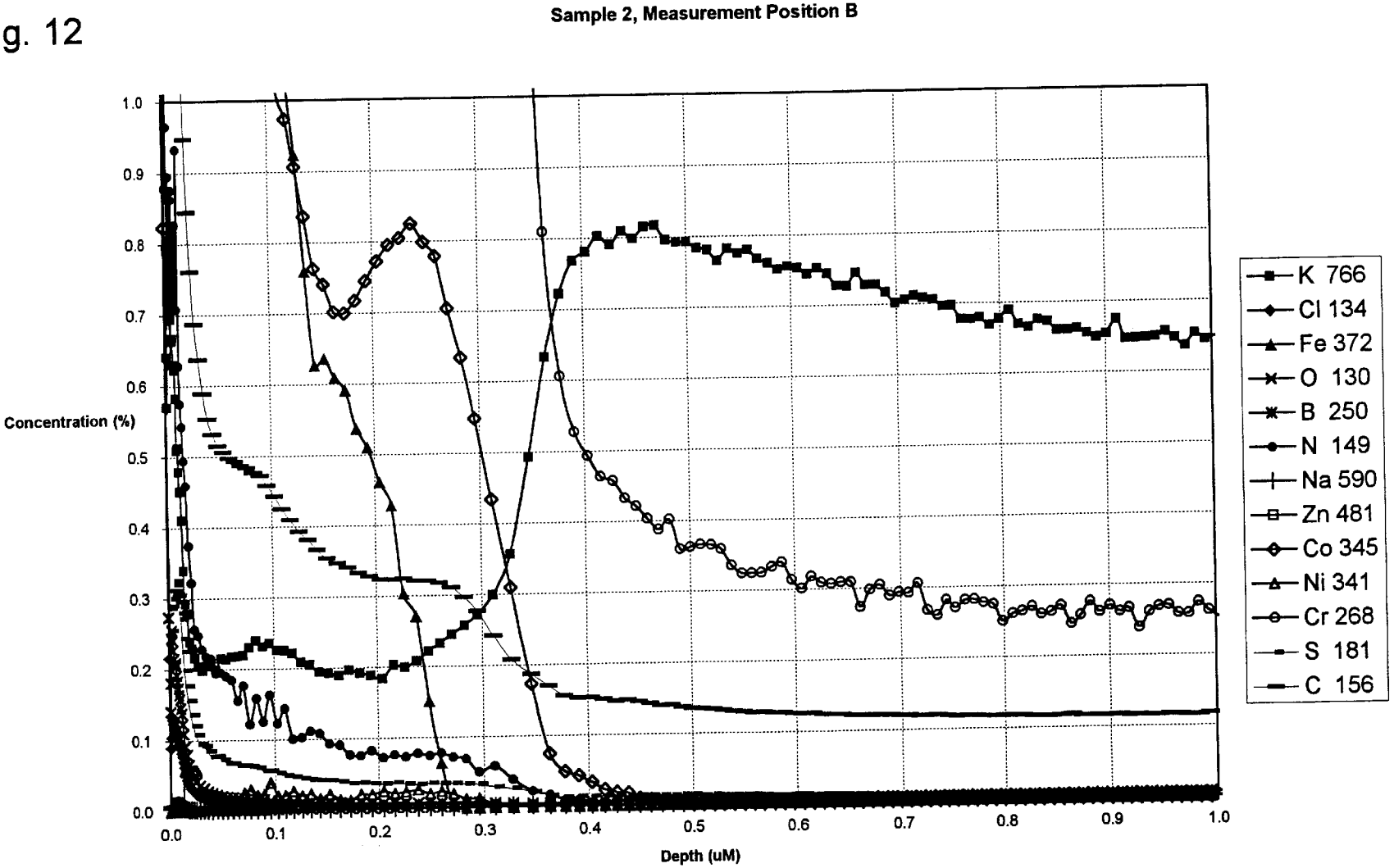
Figure 13:
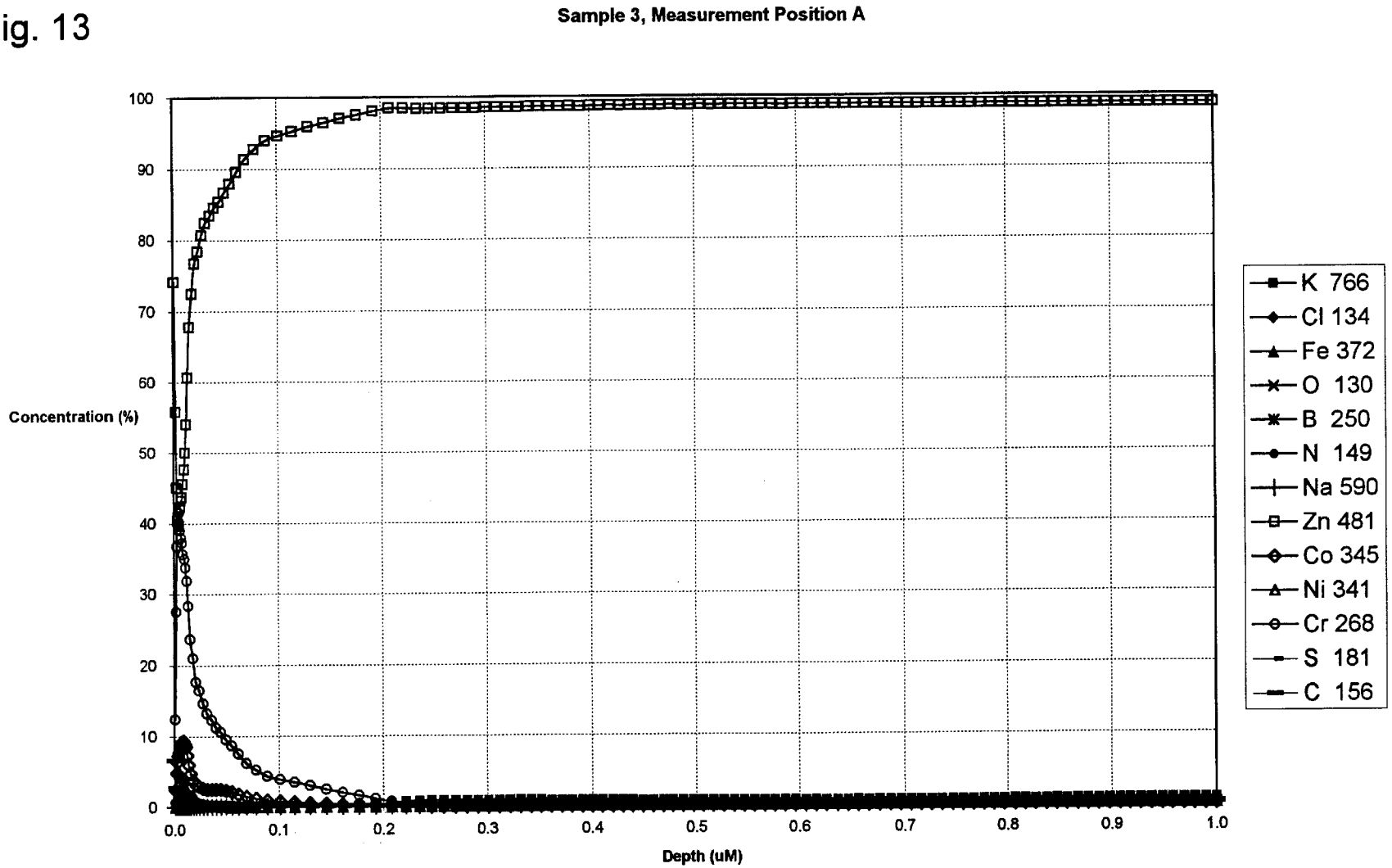
Figure 14:
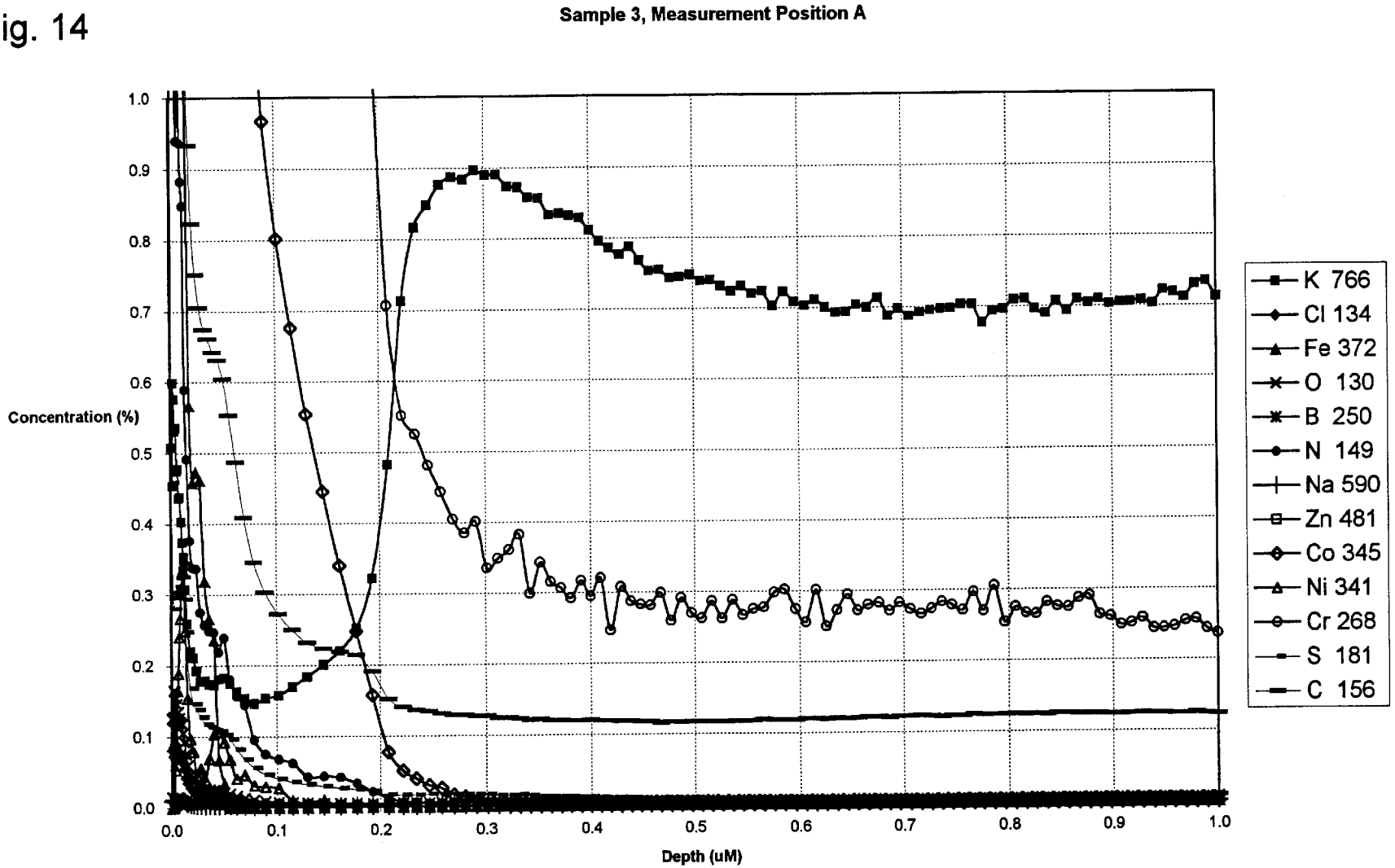
Figure 15:
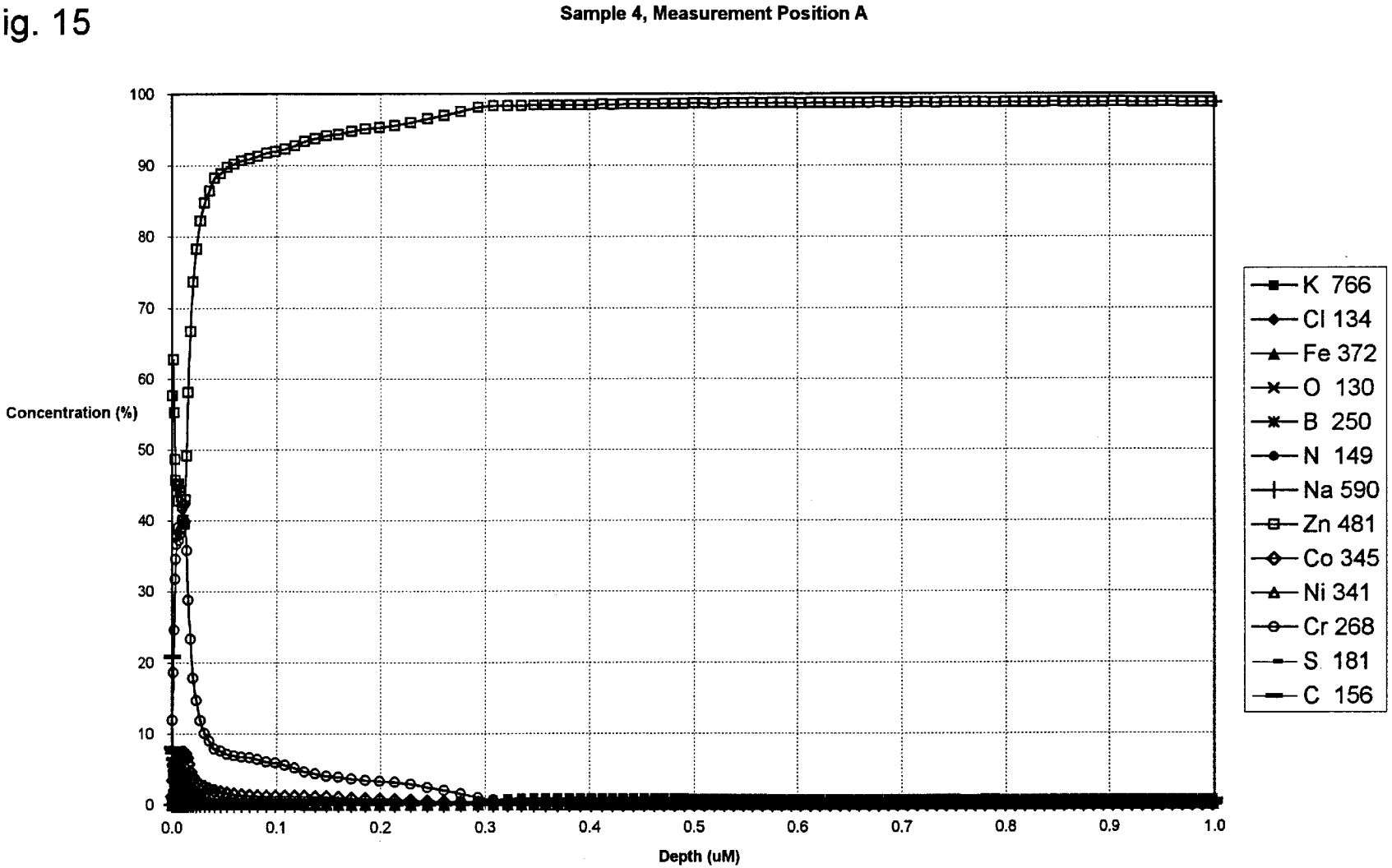
Figure 16:
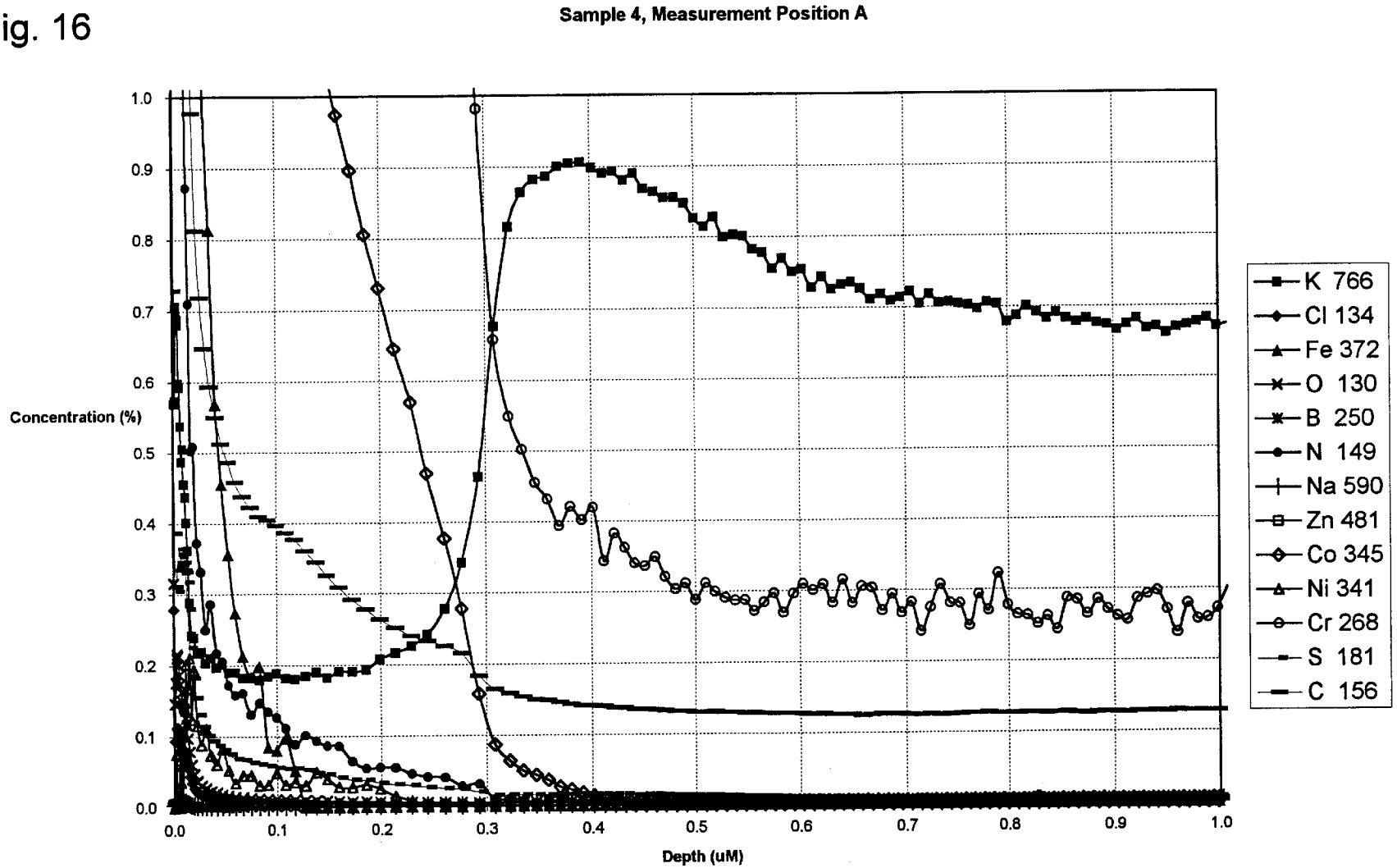
Figure 17:
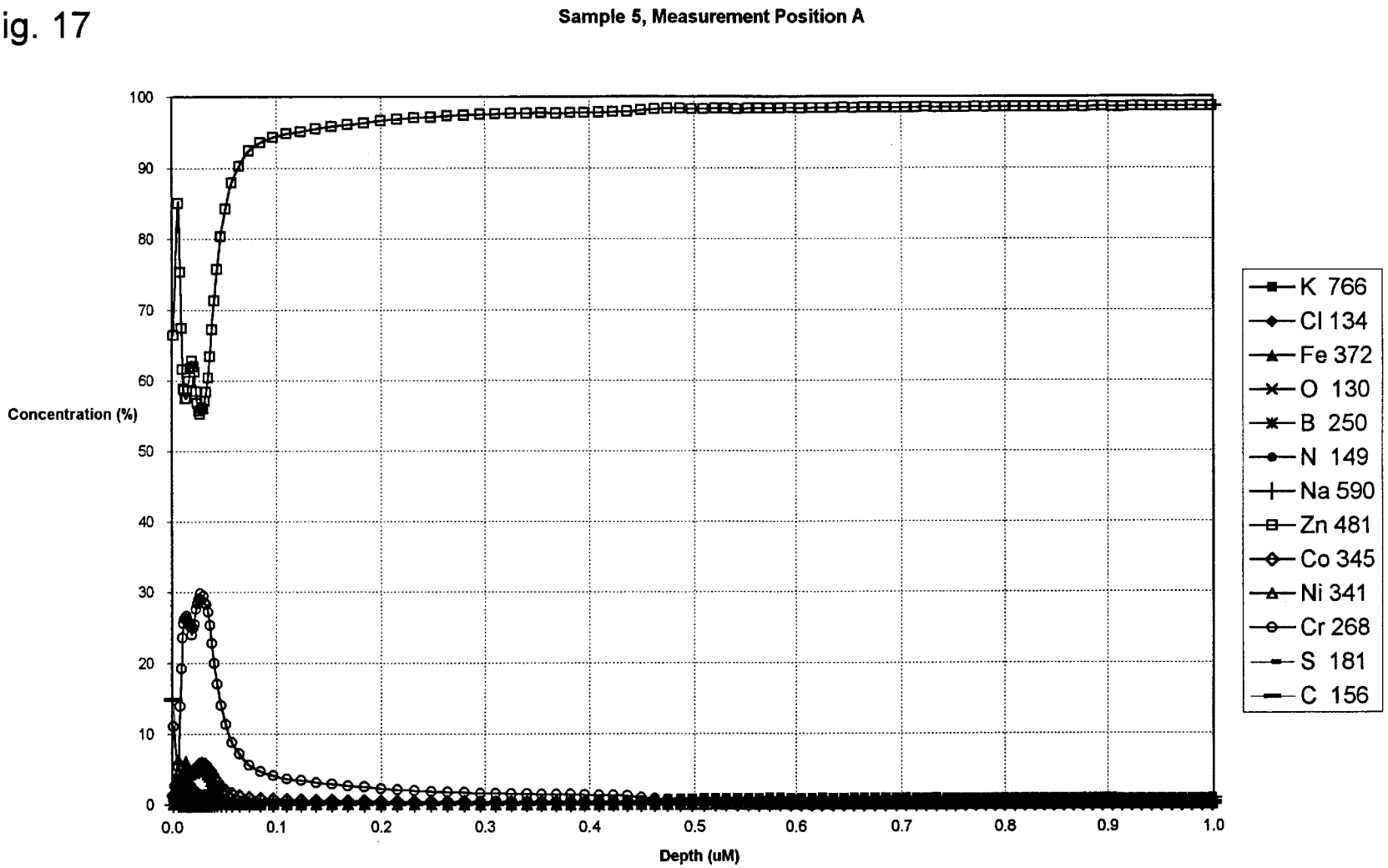
Figure 18:
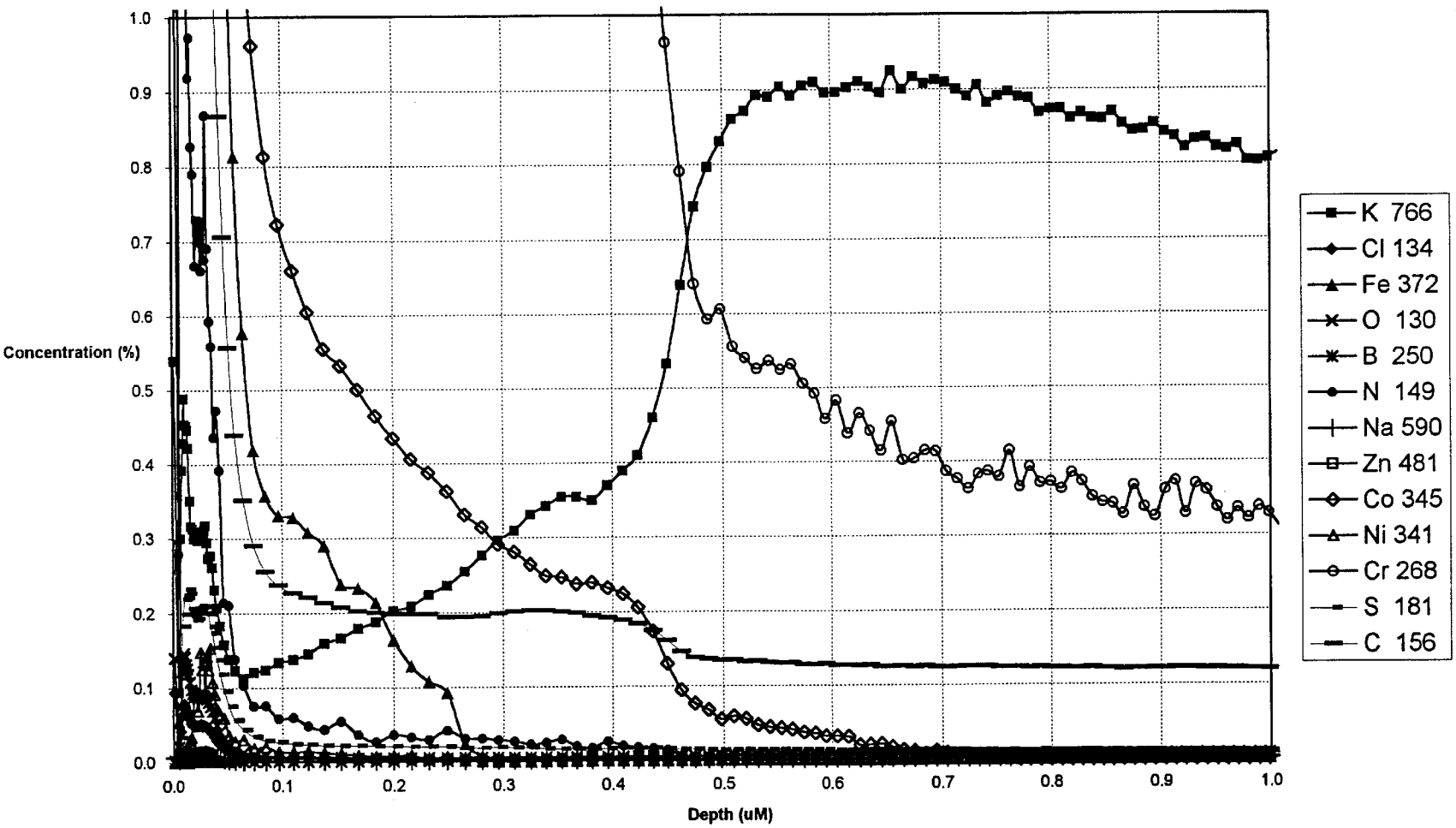
Figure 19:
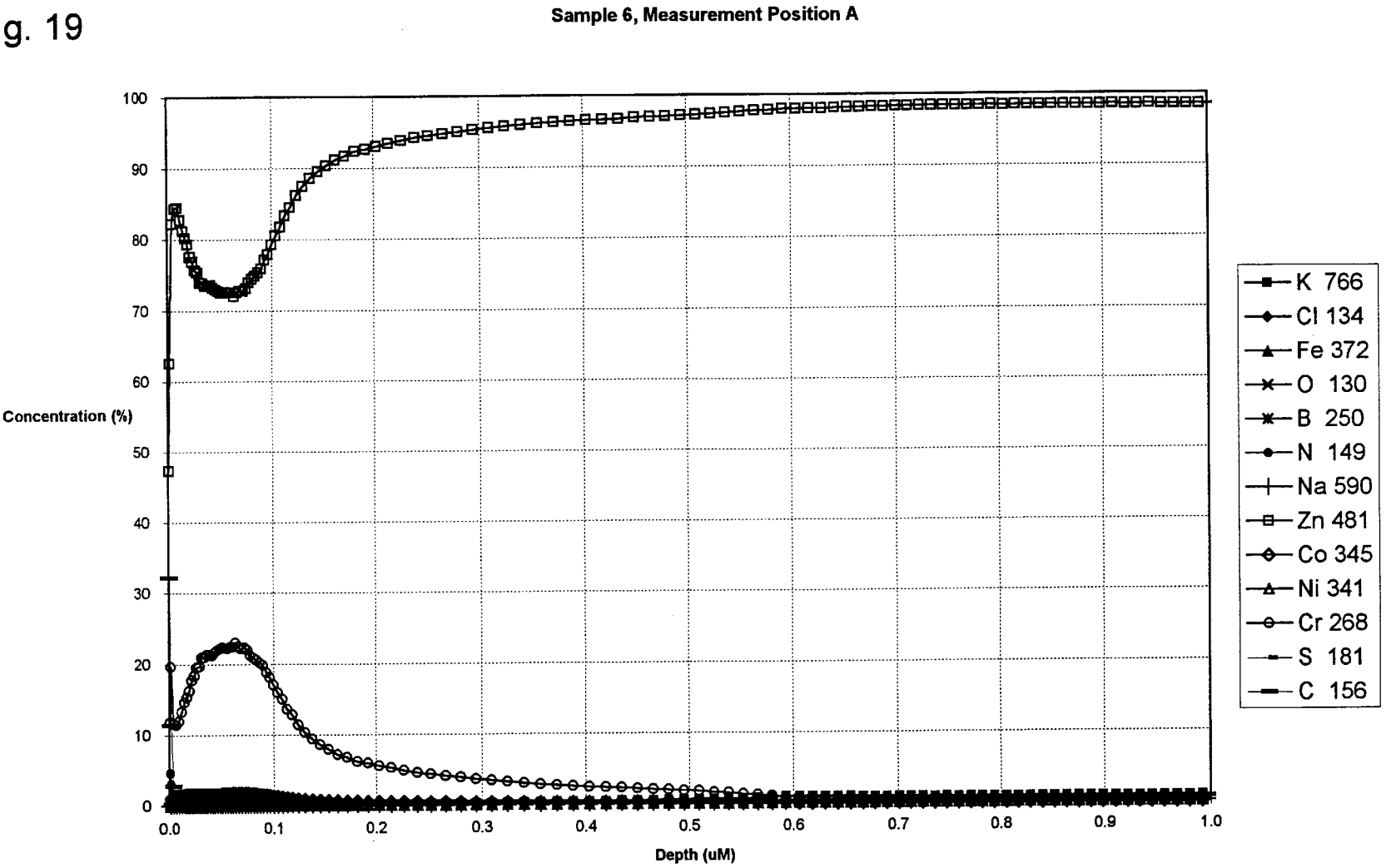
Figure 20:
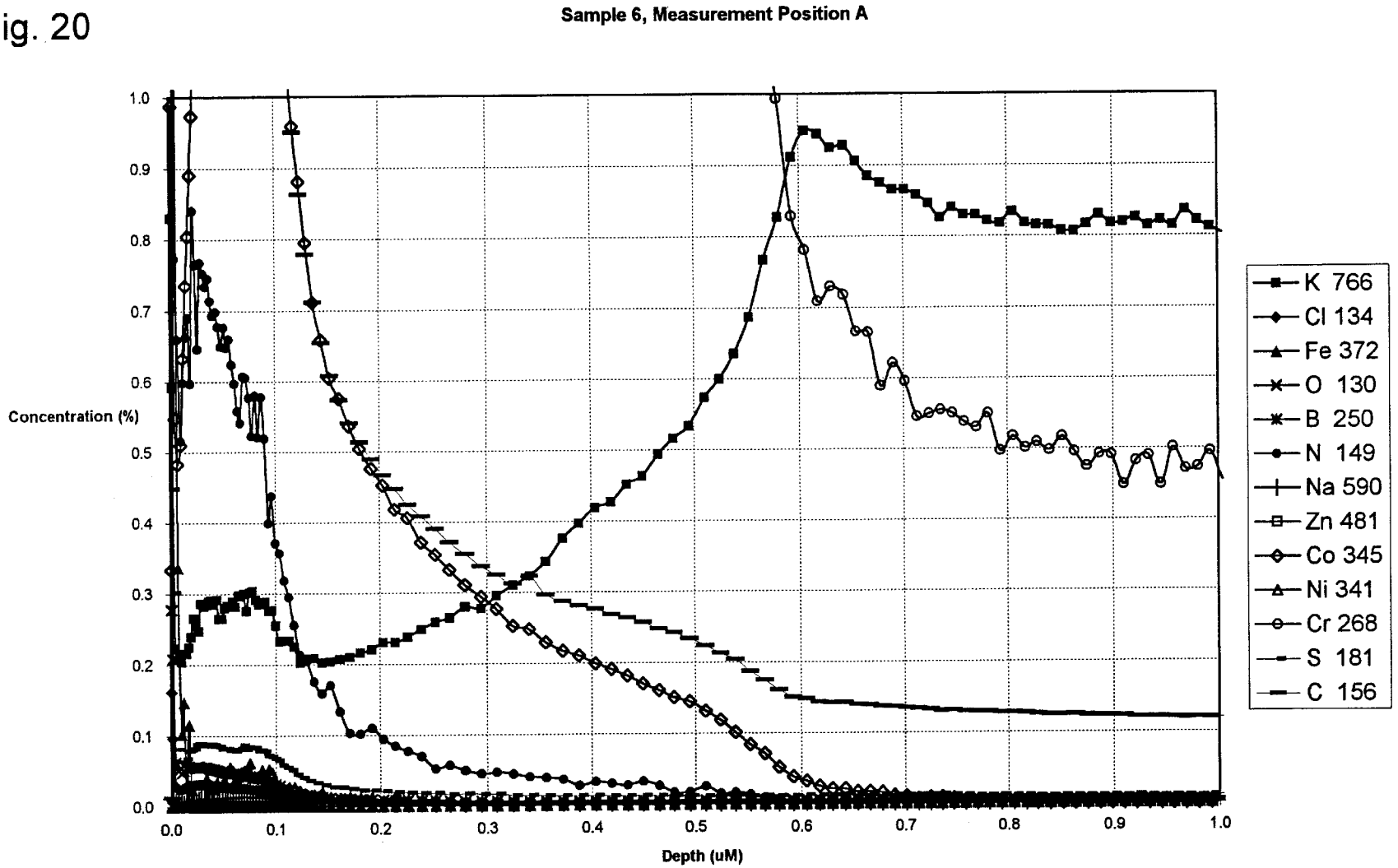
Figure 21:
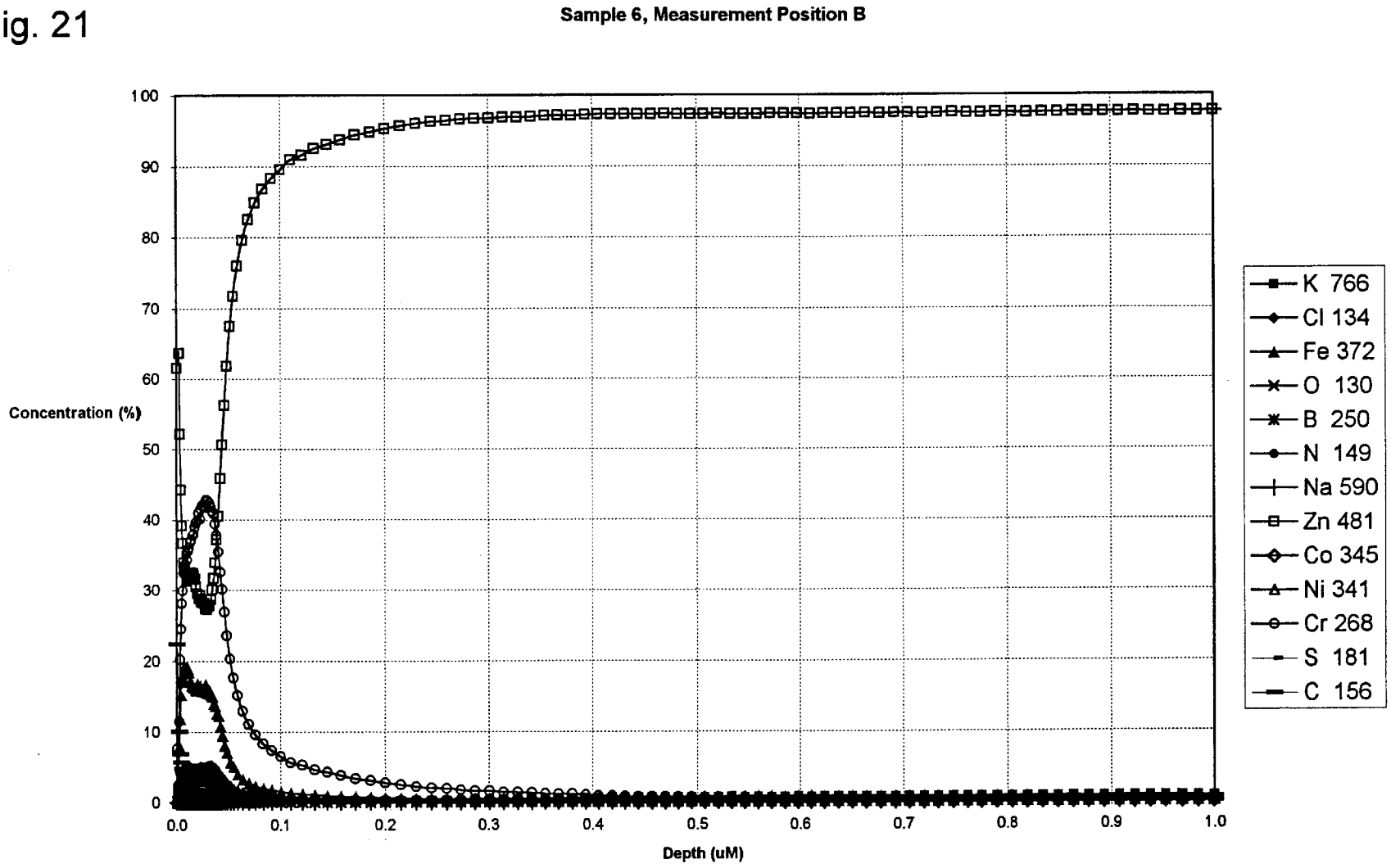
Figure 22:
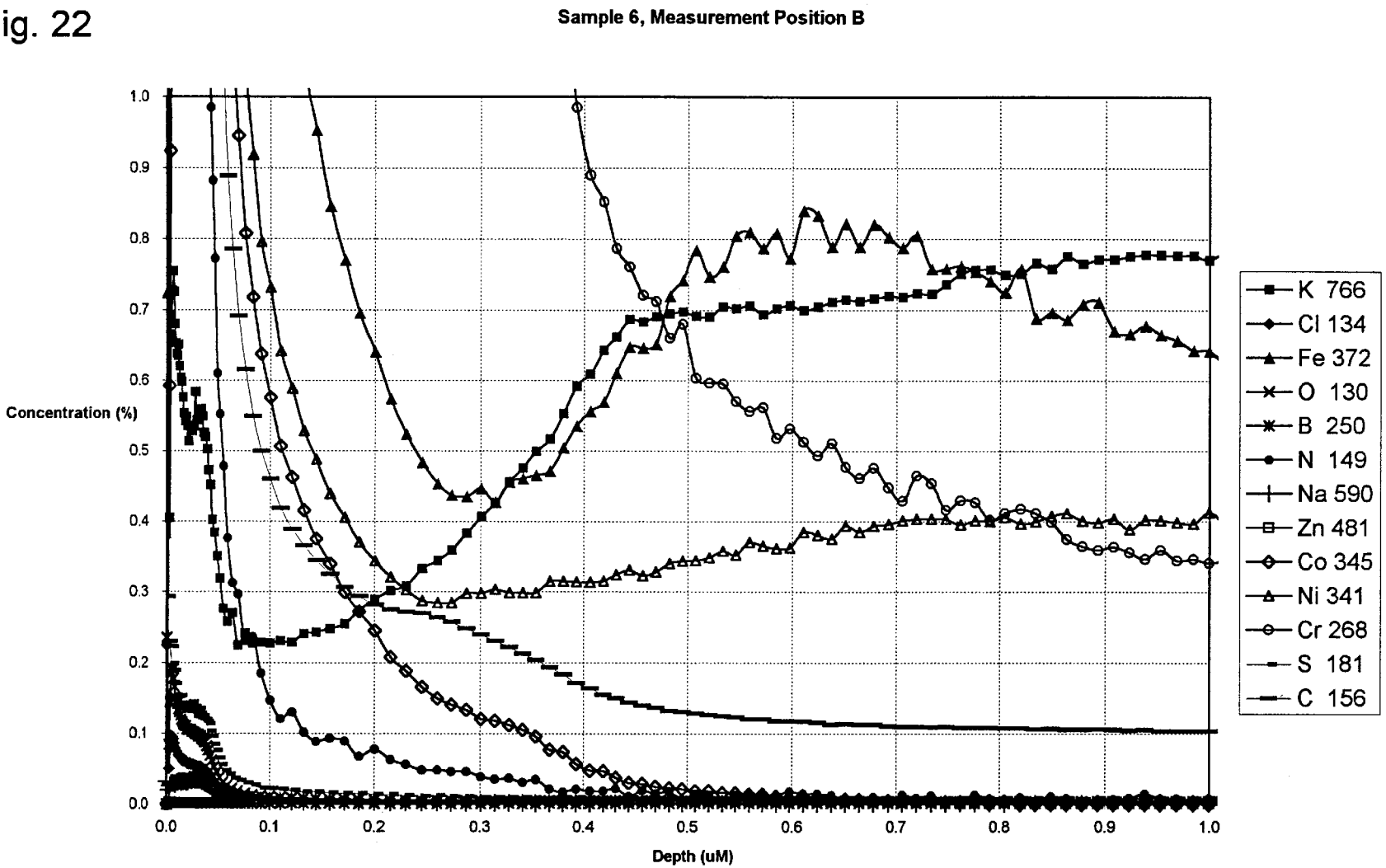
Figure 23:
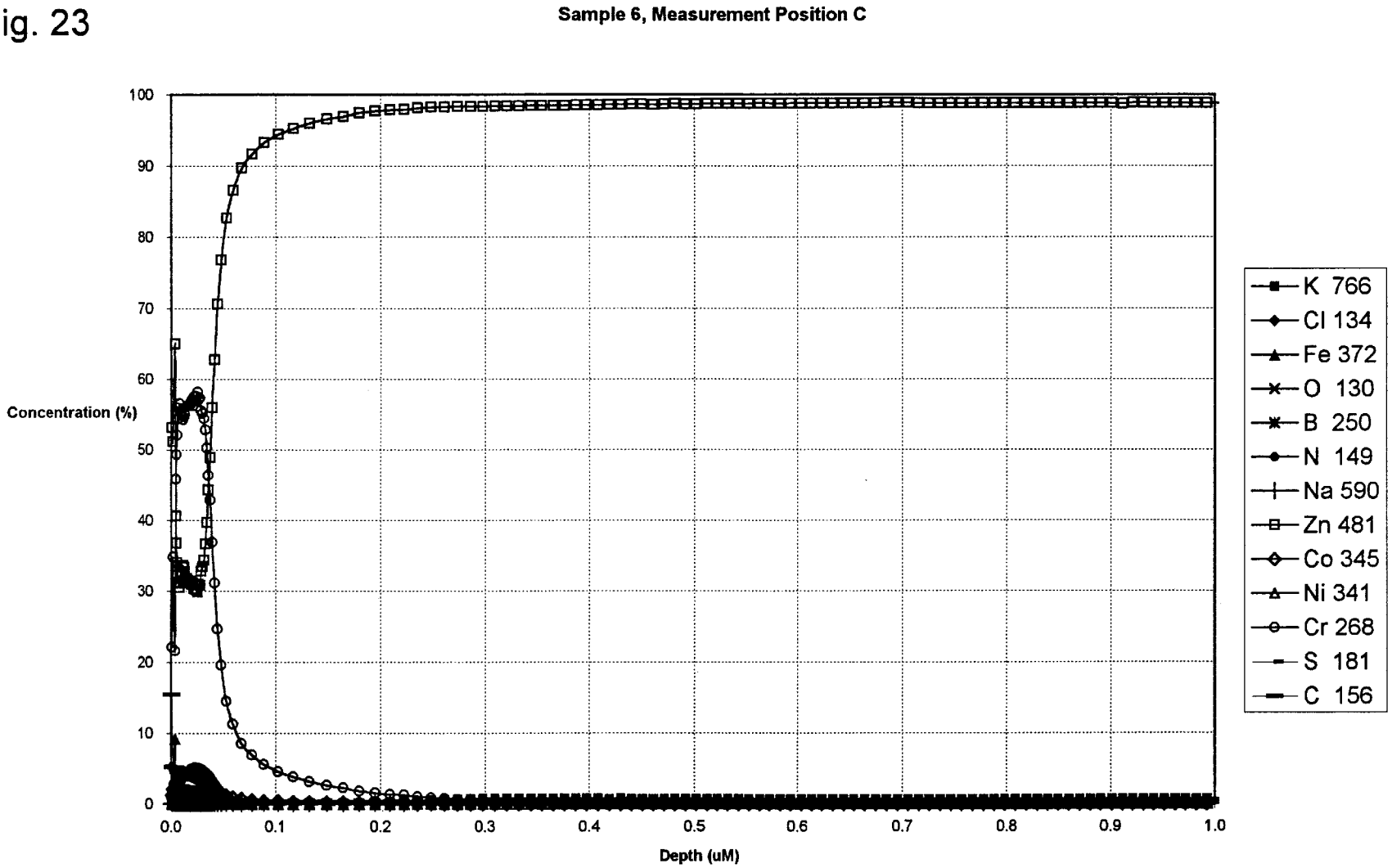
Figure 24:
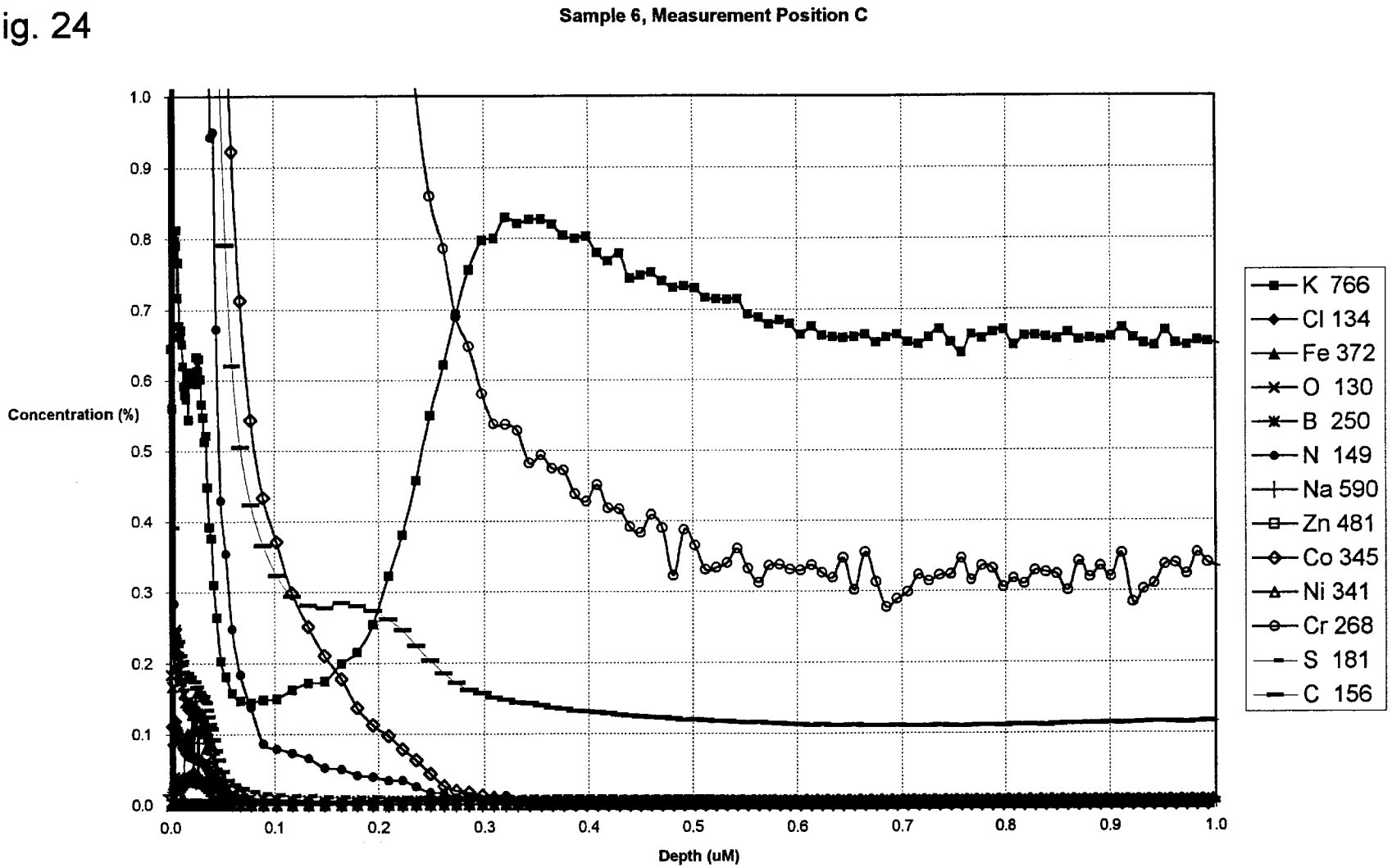
Figure 25:
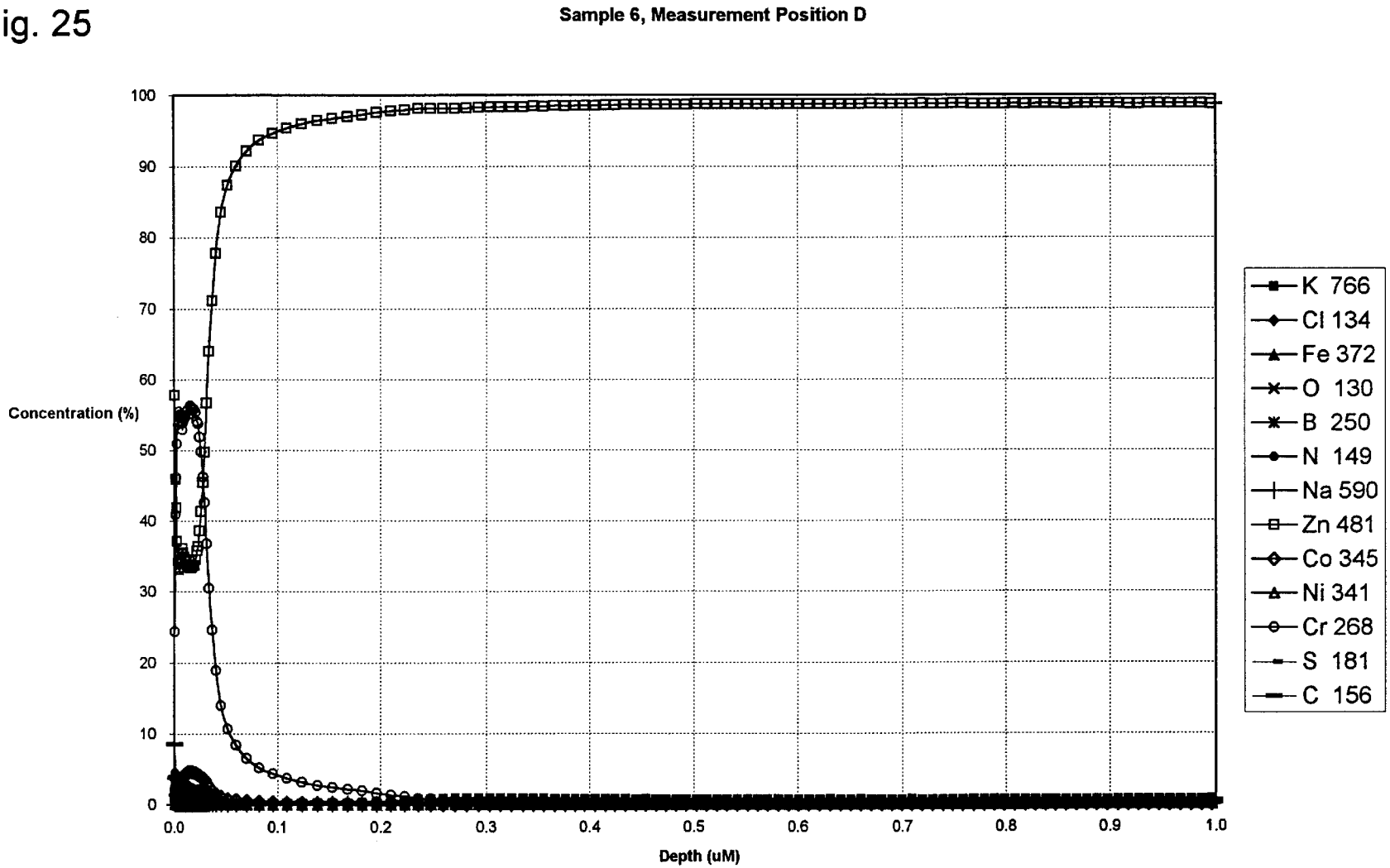
Figure 26:
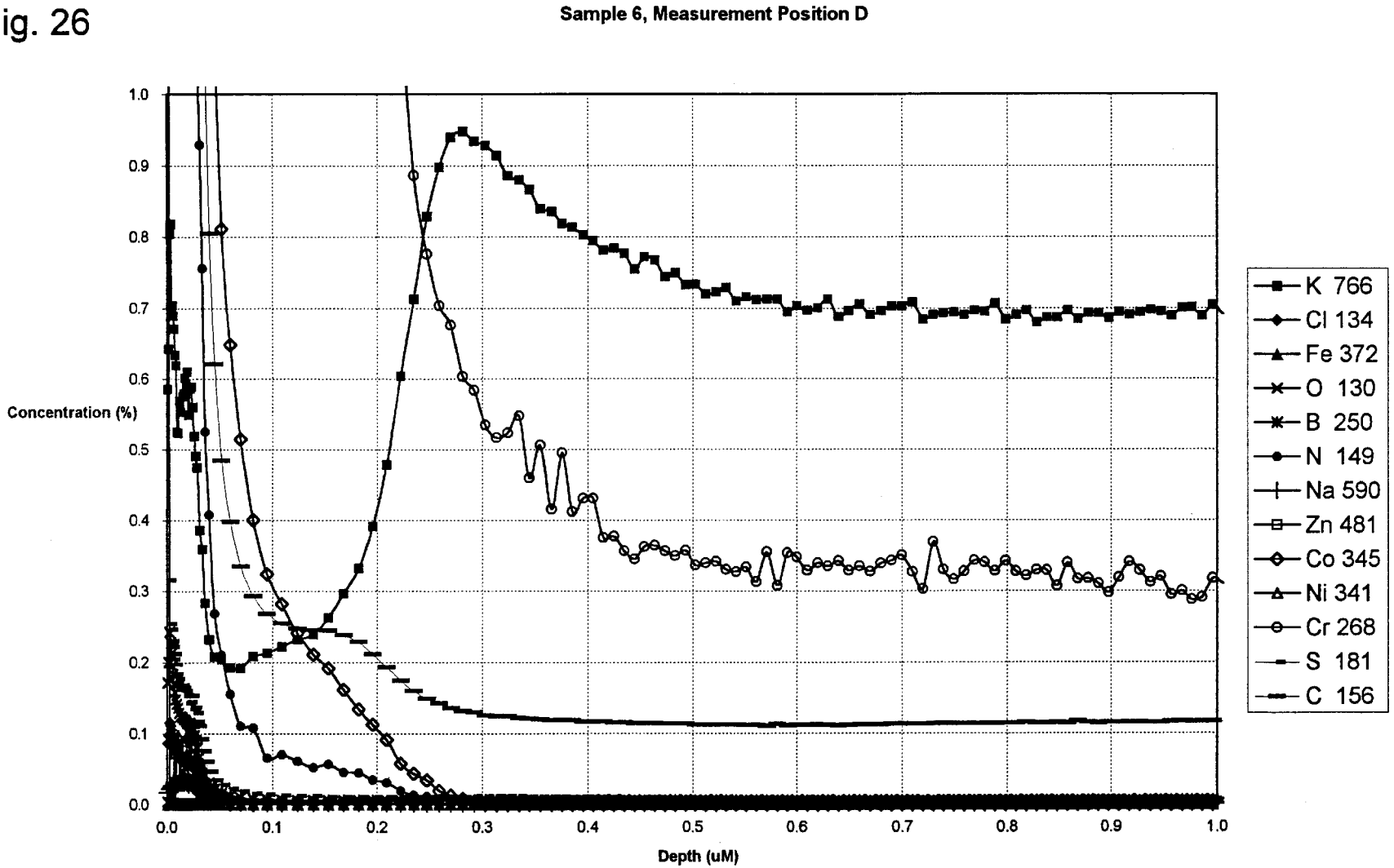
Figure 27:
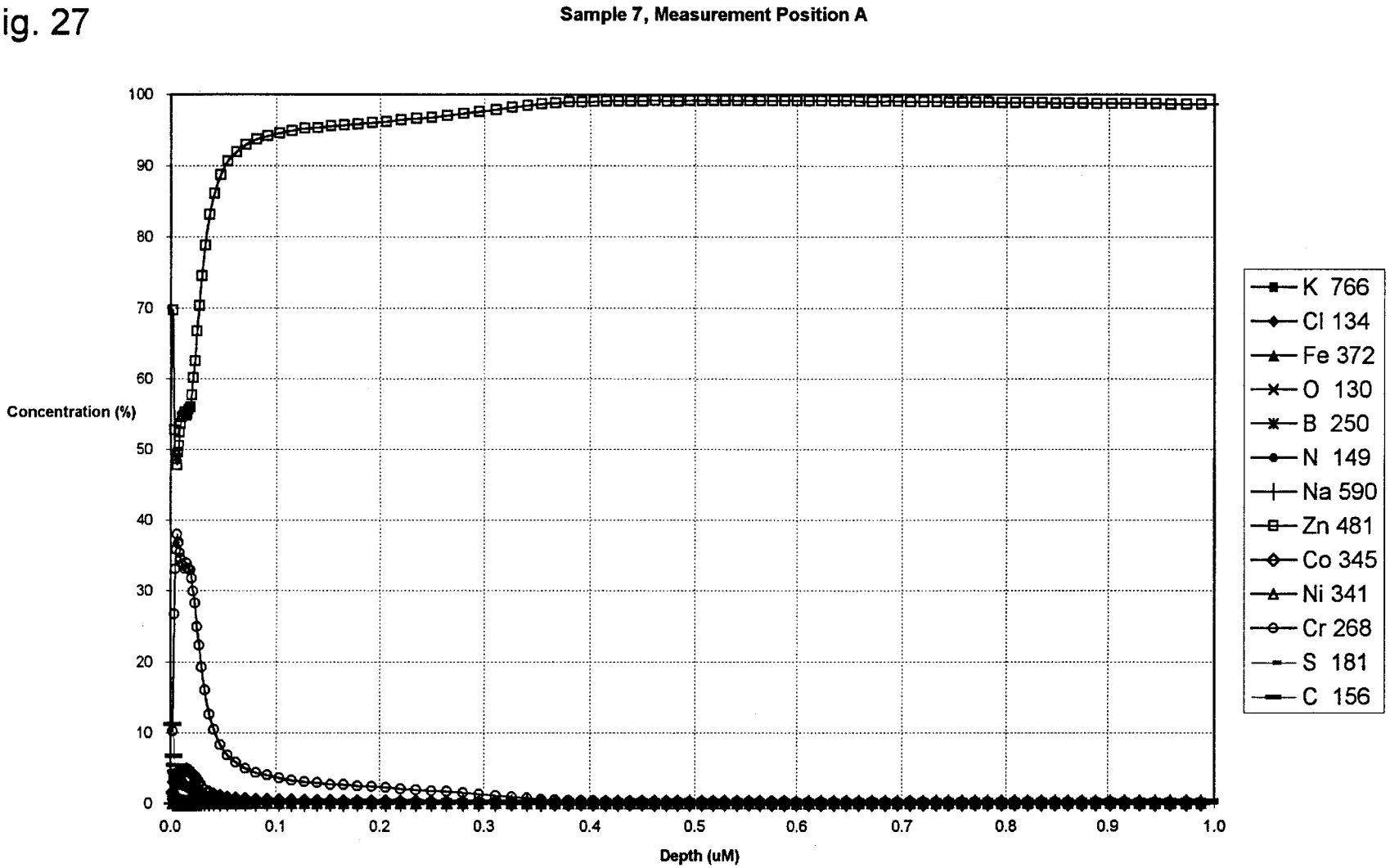
Figure 28:
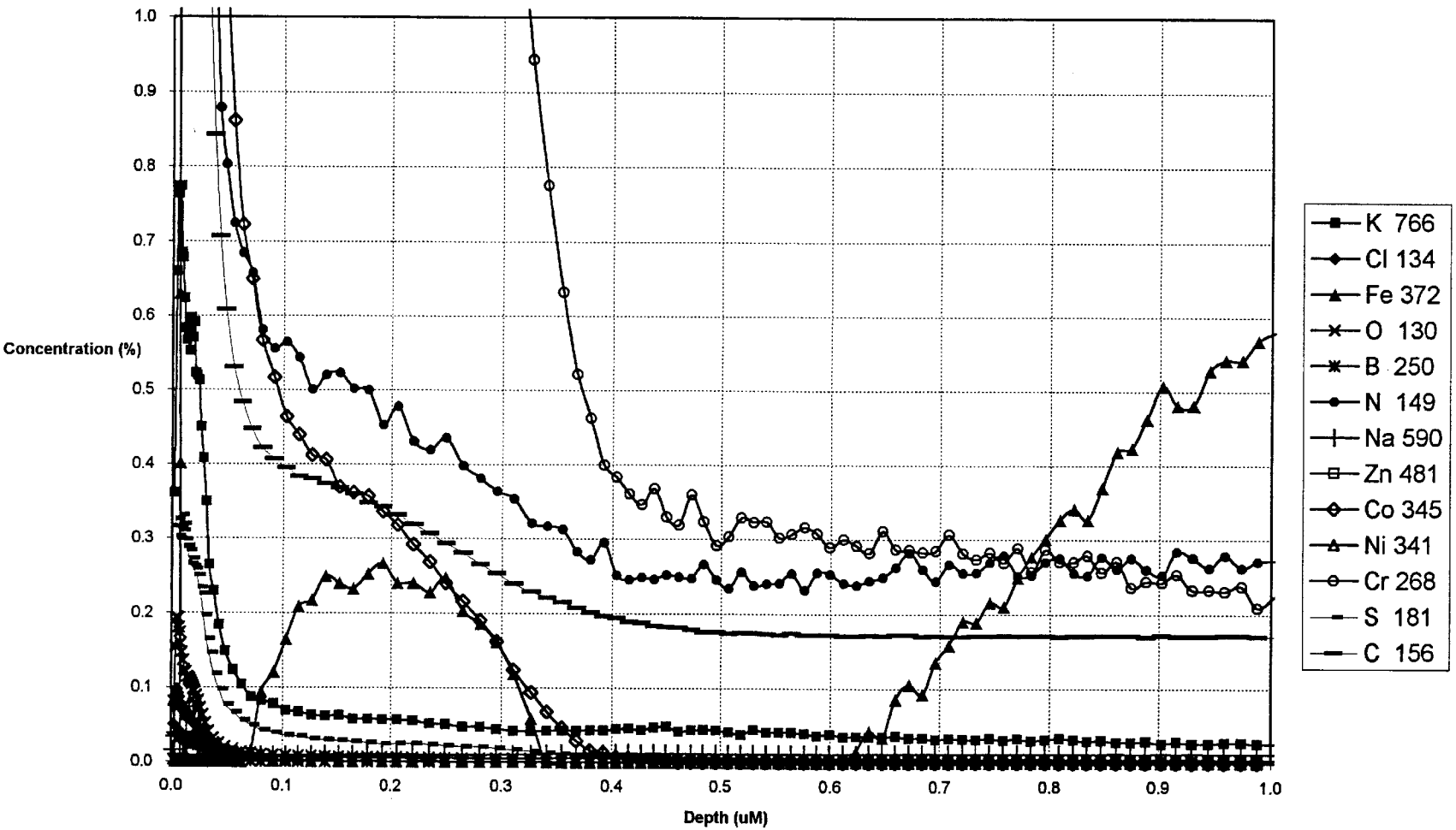
Figure 29:
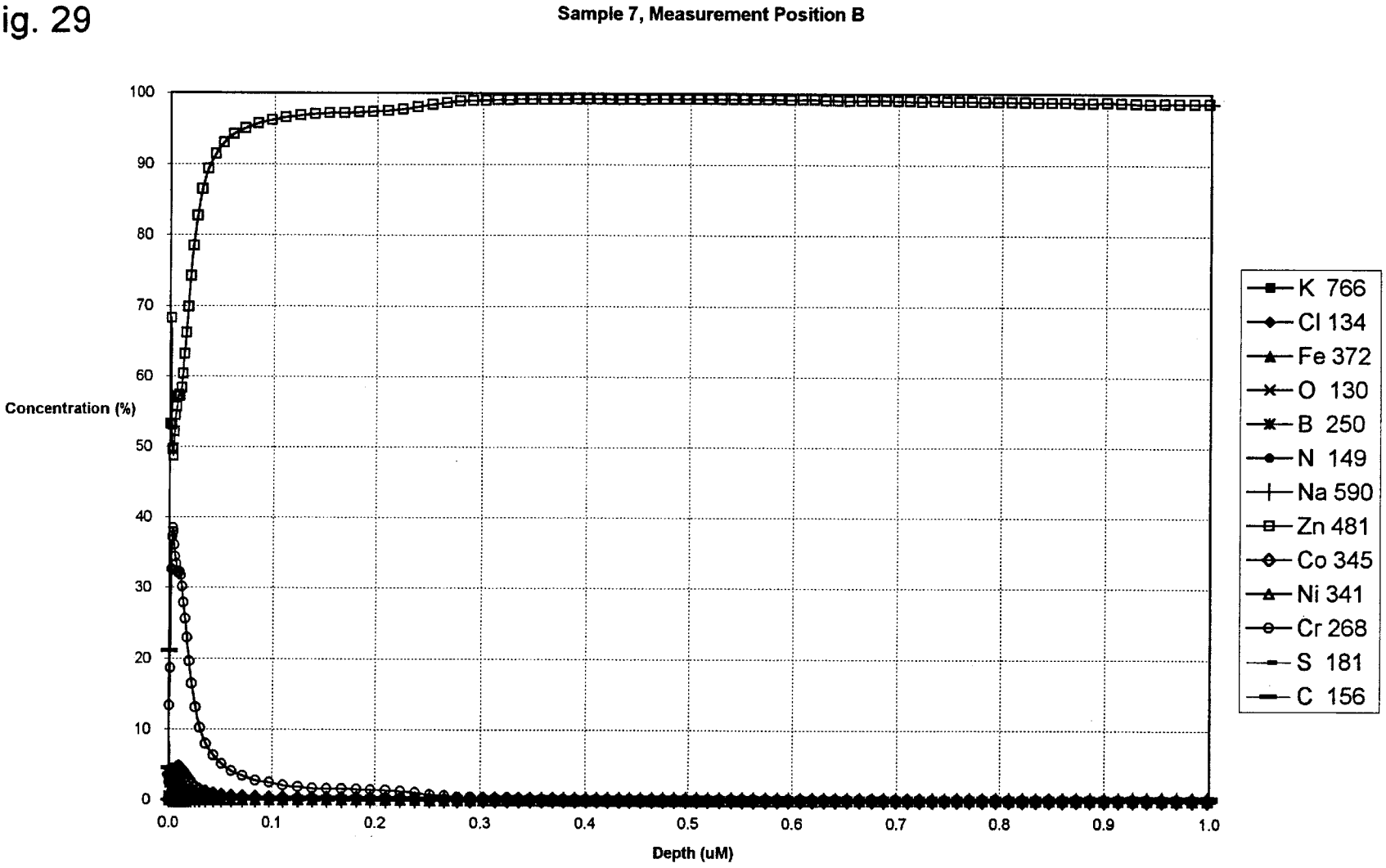
Figure 30:
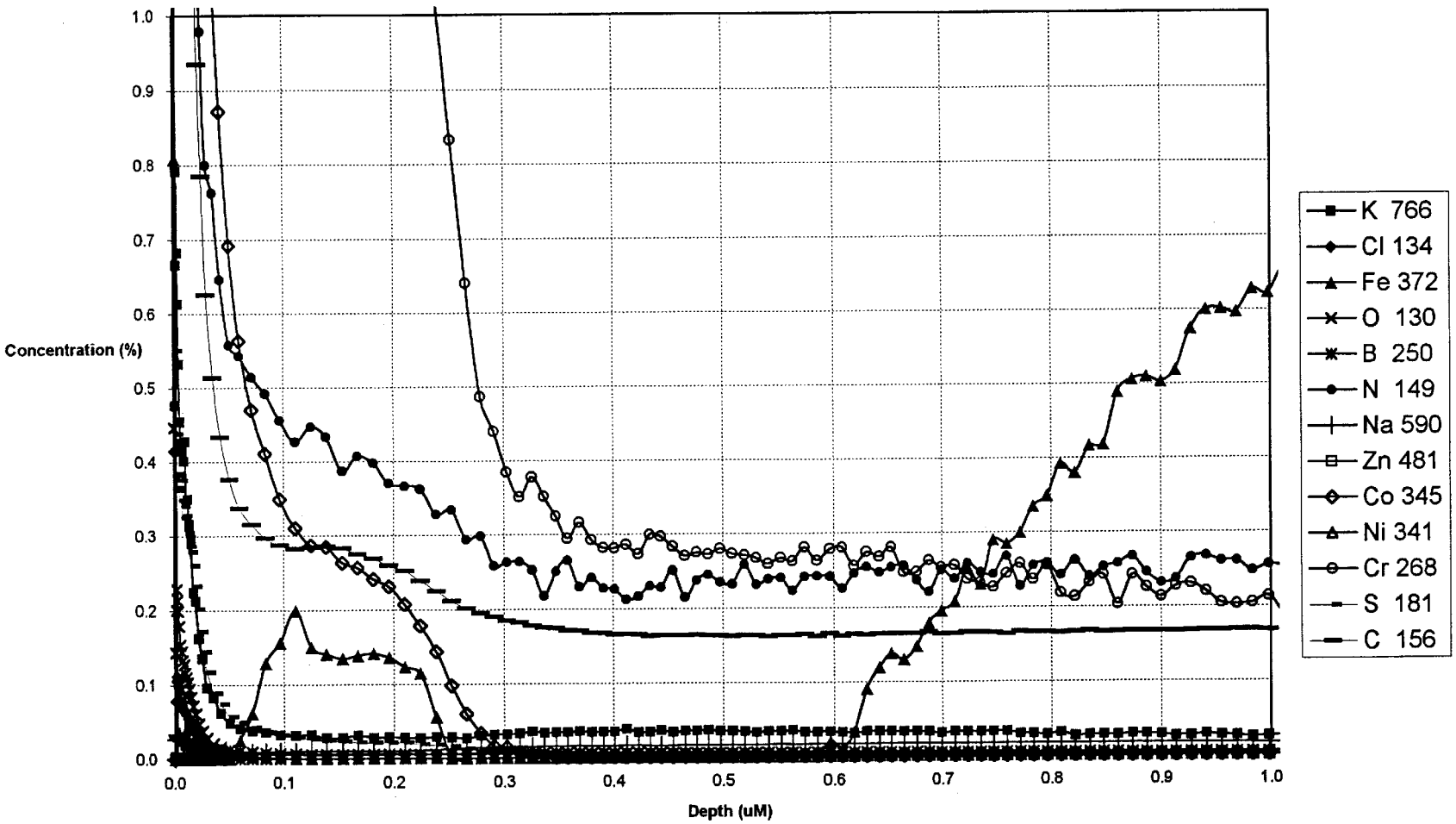
Figure 31:
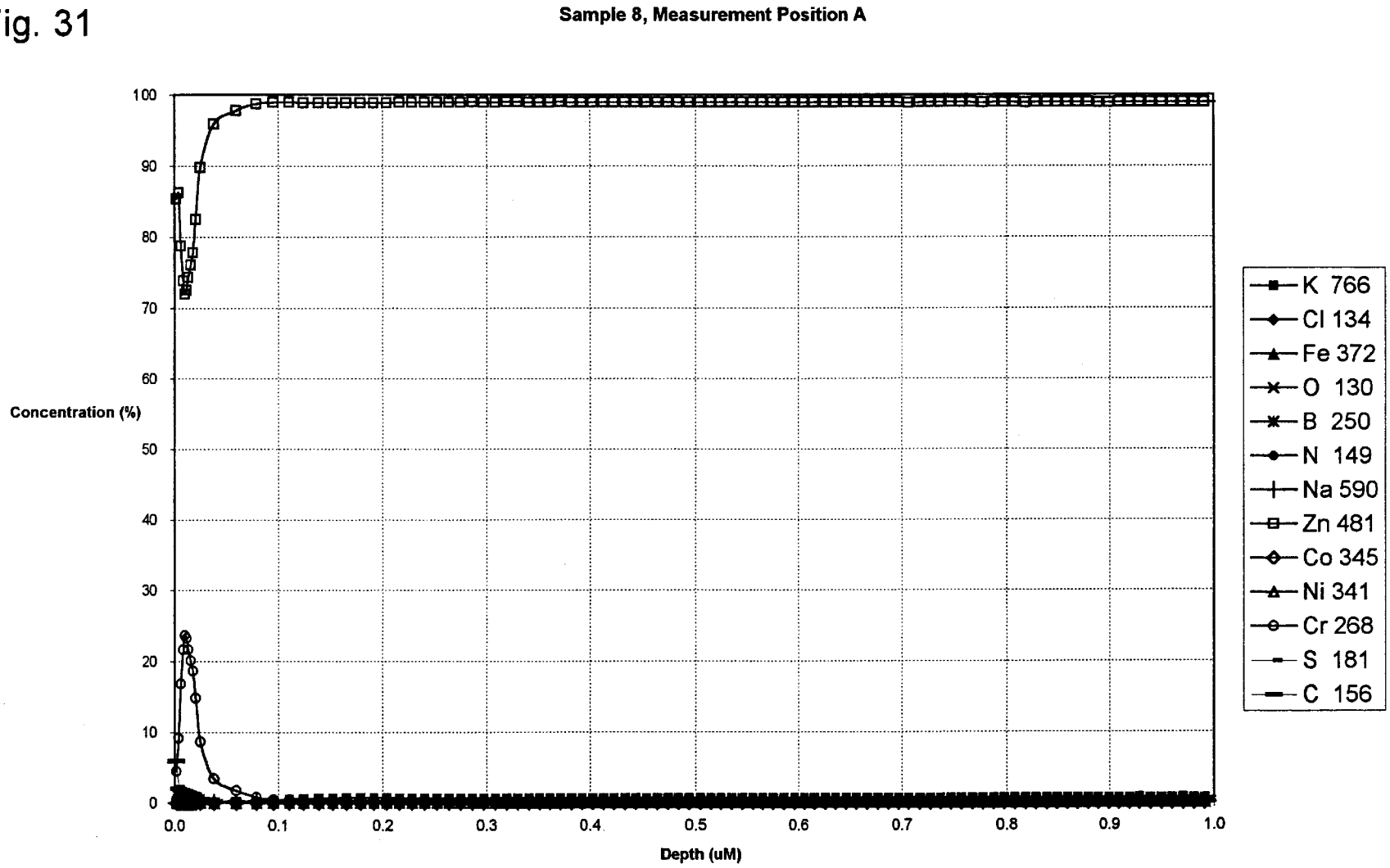
Figure 32:
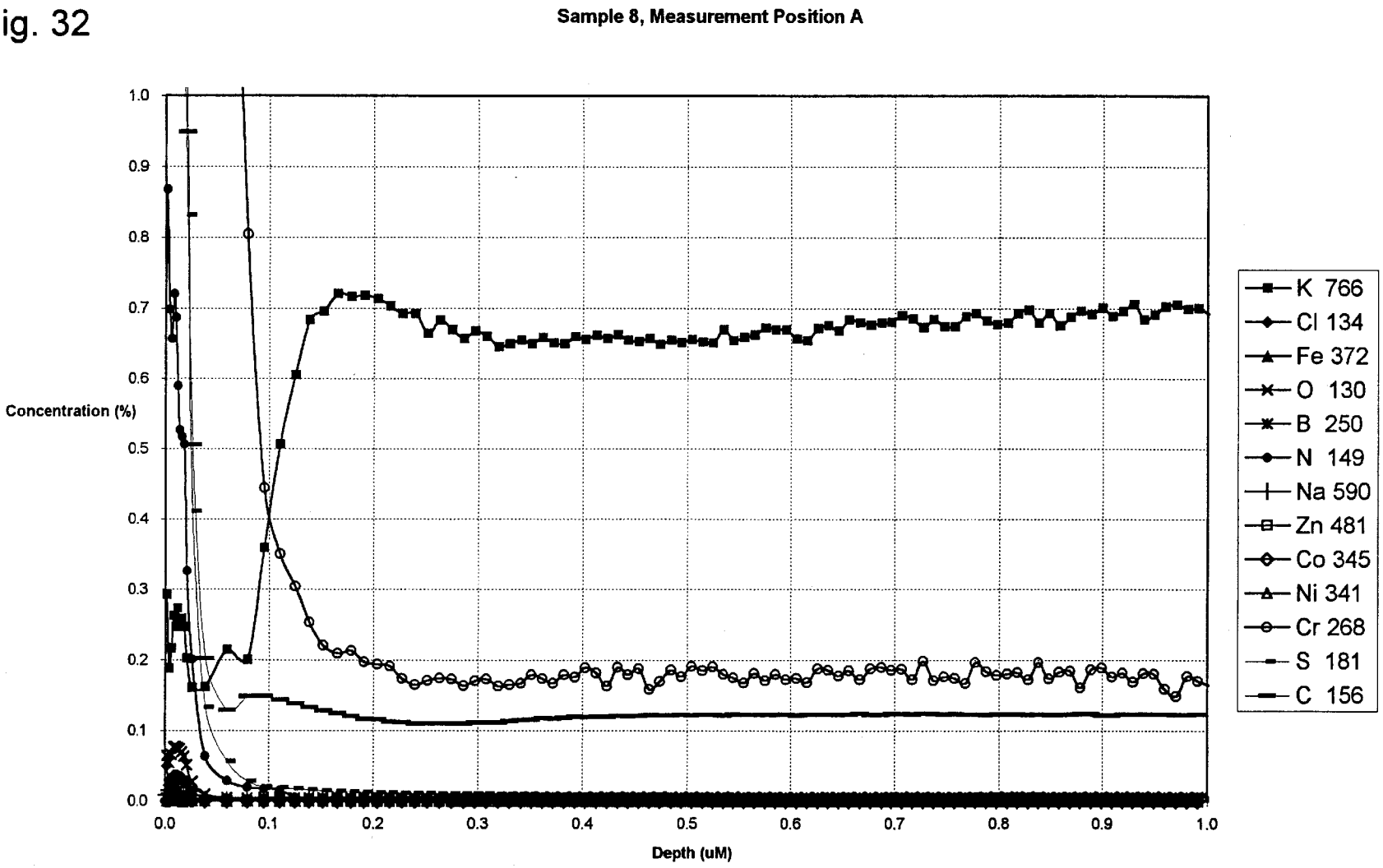
Figure 33:
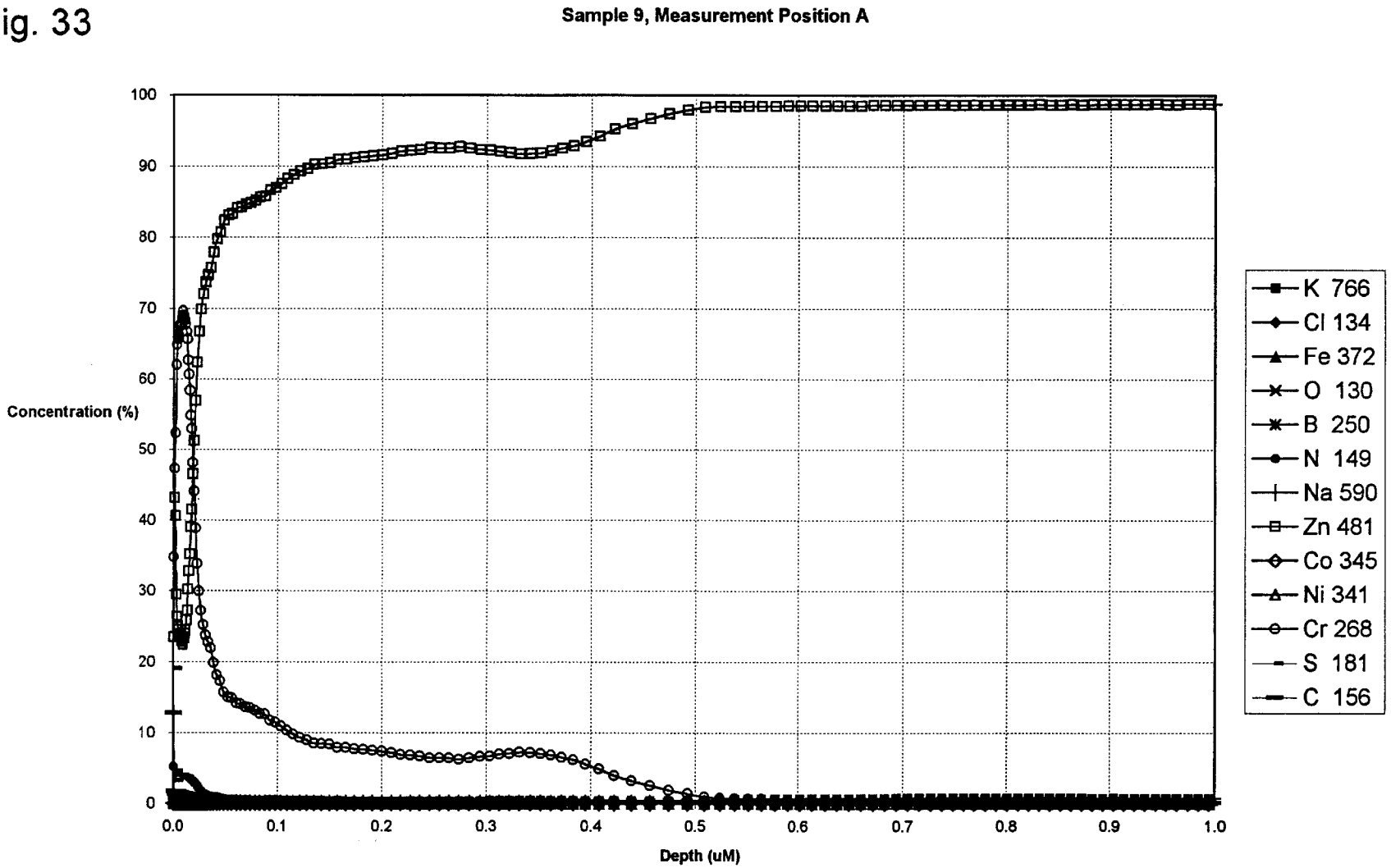
Figure 34:
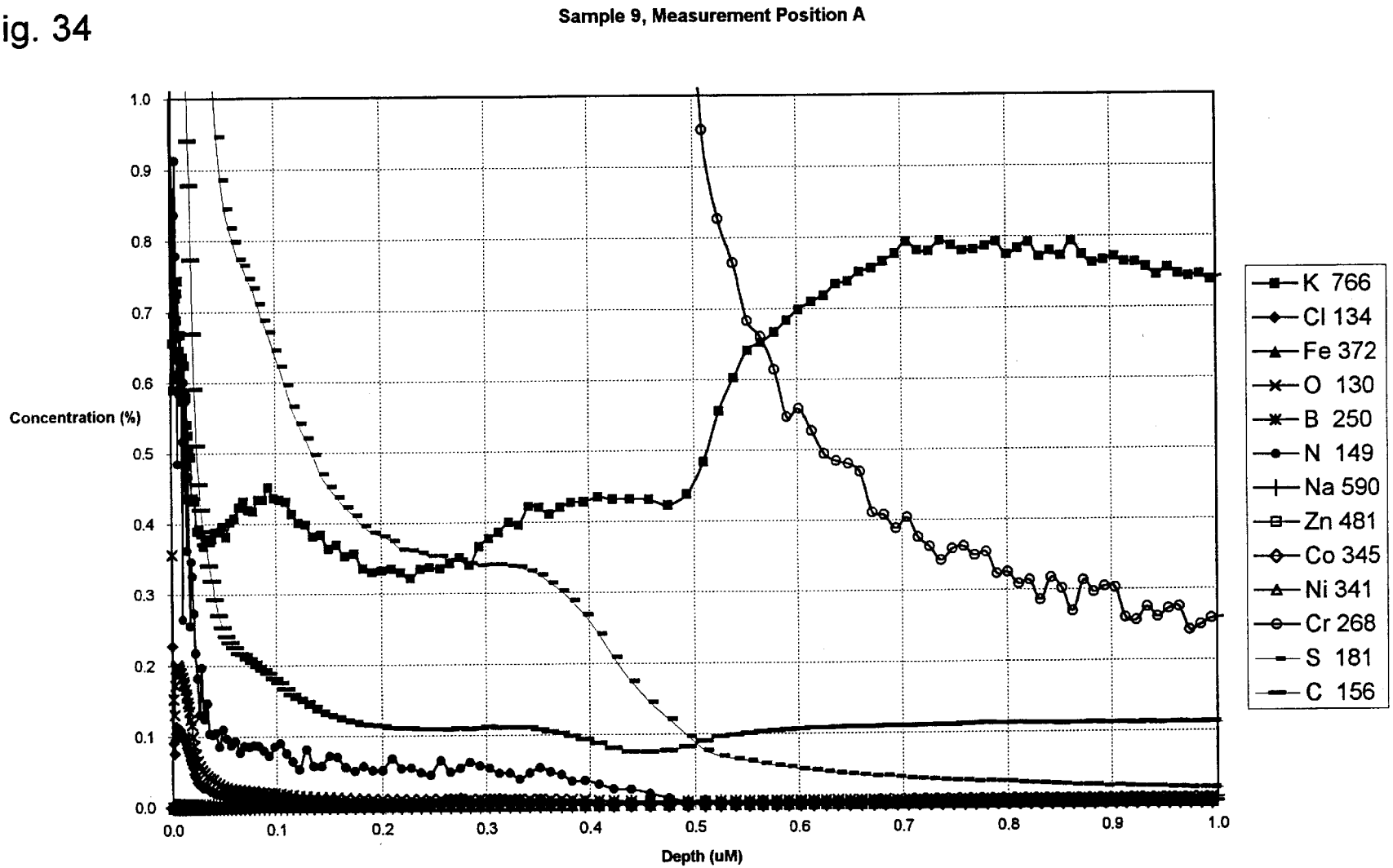
Figure 35:
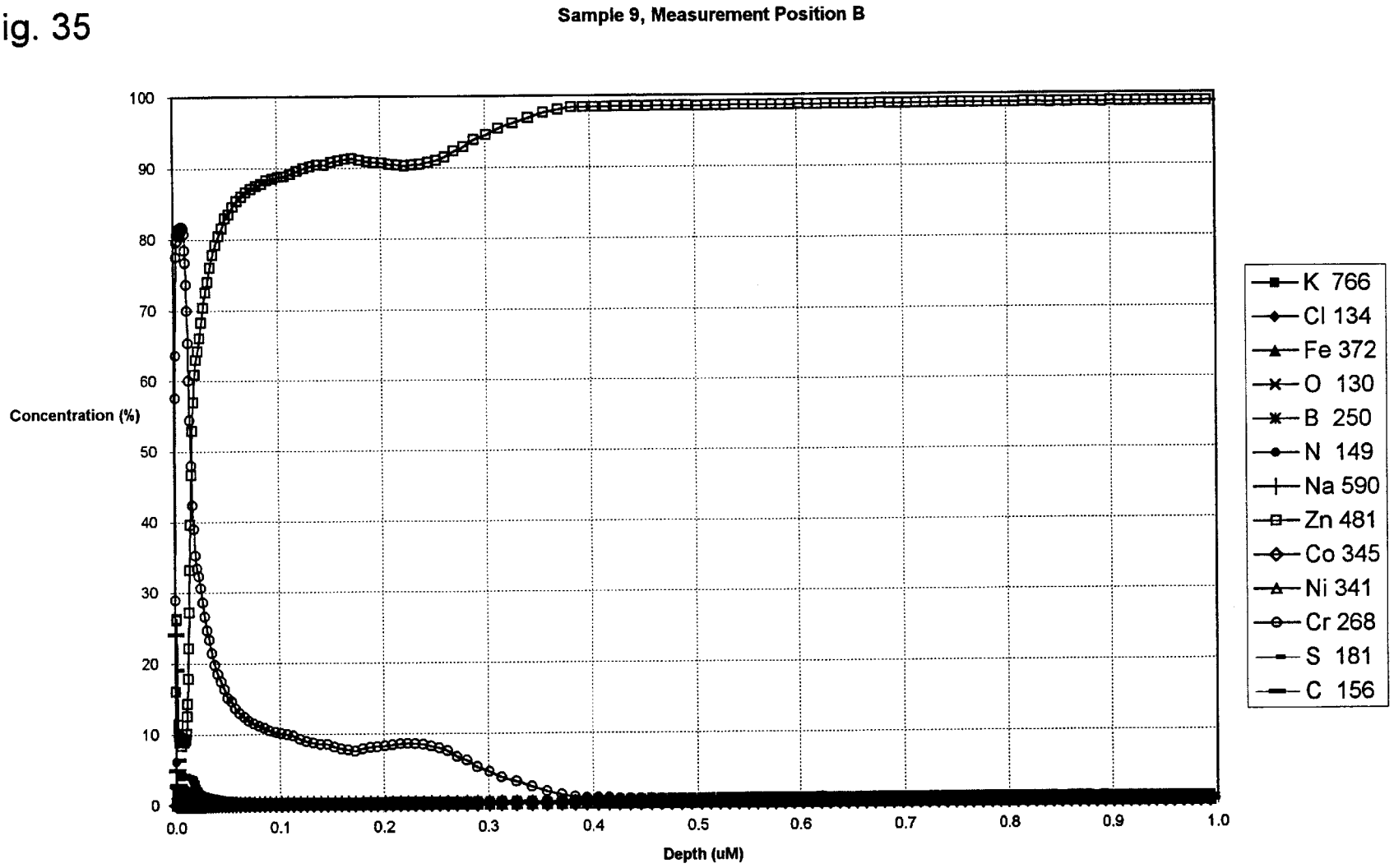
Figure 36:
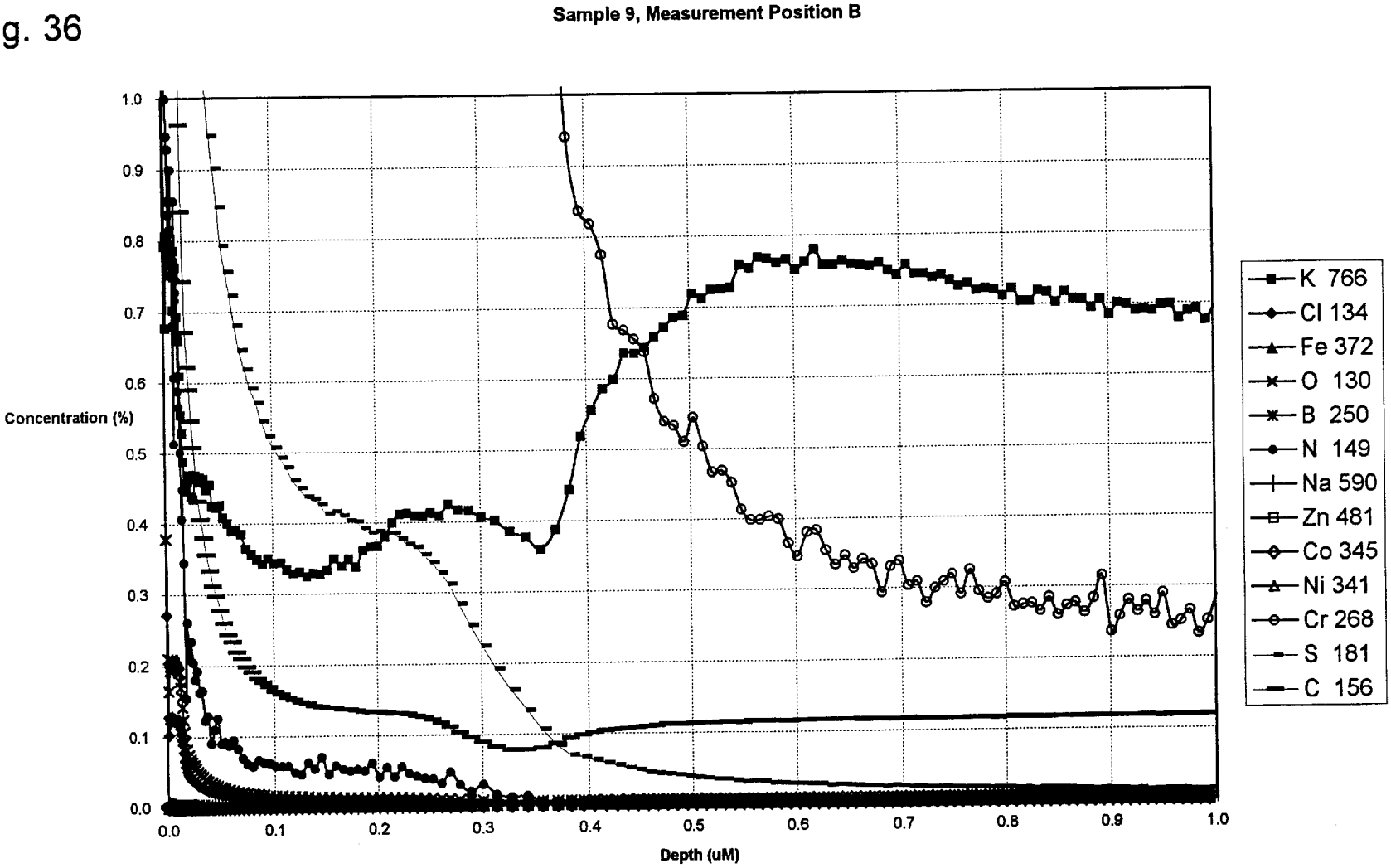

In FIG. 4, a photograph is shown as a comparison example. This photograph represents the result of comparison tests carried out by the applicant in comparison with EP 00 34 040. In particular the applicant reproduced the Examples 16 and 17 given in this prior art. Herein steel sheets were immersed into the solutions described in Examples 16 and 17 of EP 00 34 040 and the respective treatment times were observed. FIG. 4 shows the layers on the substrate surfaces obtained in accordance with the prior art, namely from the top to the bottom the first and second sheets successively treated by immersion.

The photograph of FIG. 4 shows from the left to the right in the top half of the illustration a cloth whereby the layer produced in accordance with Example 16—prior art—was wiped, a zinc-plated steel sheet treated in accordance with Example 16, beside it a zinc-plated steel sheet treated in accordance with Example 17—prior art—and on the extreme right also a cloth whereby the layer of Example 17 was wiped. In the second line on the left side—beside the indication of Example 16 and beside it to the right (beside the indication of Example 17) a respective zinc-plated steel sheet coated in accordance with the prior art is shown.

What is visible is a milky, white-greenish powdery coating which already comes off when wiped with a soft cloth even without application of particular pressure (see FIG. 4, top half of illustration). The prior art itself suggests that this layer is not a compact oxide zinc-/chromium conversion layer firmly adhering to the substrate sheet but a loosely overlying coating substantially consisting of chromium hydroxide. The pH for this coating must be so high that the precipitation limit for chromium hydroxides is already exceeded (page 26, line 12 of EP 0034 040). Precipitation of chromium hydroxide is kinetically inihibited and is favored by immersion of a more or less rough surface. The fact that the layer formation mechanism has to be a different one from the other examples may also be seen from the circumstance that with (Example 16 prior art) or without (Example 17) complexing agents more or less the same result was achieved. In practical reproduction of Examples 16 and 17 of the prior art it was moreover found that the layer became thicker, softer and more powdery with an increasing number of metal sheets coated in the solution. In addition, more and more chromium hydroxide precipitated, whereby the useful life of such a coating solution is limited to a few hours. The layer according to the invention, on the other hand, is produced only from suitable "rapid" complexes and furthermore in a distinctly acidic pH range. The solution is stable over months, presumably even years.

The measurements underlying FIGS. 5 to 36 were performed with a glow-discharge spectrometer.

The element F and die anions could not be analysed by this method. O H, Cl and K could not be quantified.

The following Table shows the concentration ranges for which calibration is valid:

| Element | Concentration min. in | Concentration max. in |
|---|---|---|
| C | 0.0067 | 3.48 |
| S | 0.0055 | 0.168 |
| Cr | 0.0001 | 99.99 |
| Ni | 0.0001 | 99.99 |
| Co | 0.0001 | 7.00 |
| Zn | 0.0001 | 99.99 |
| Na | 0.0001 | 0.0068 |
| N | 0.0001 | 6.90 |
| B | 0.0001 | 0.040 |
| Fe | 0.0005 | 99.91 |

Sample allocation in FIGS. 5 to 36 results from the following Table:

| Sample No. | Coating | Conditions | Measurement point |
|---|---|---|---|
| 1 | Chromitation on Zn (invention) | 60° C., 1 min, pH 2 | A |
| | | | B |
| 2 | | 60° C., 2 min, pH 2 | A |
| | | | B |
| 3 | | 60° C., 1 min, pH 2.5 | A |
| 4 | | 60° C., 1.5 min, pH 2.5 | A |
| 5 | | 60° C., 2 min, pH 2.5 | A |
| 6 | | 100° C., 1 min, pH 2 | A |
| | | | B |
| | | | C |
| | | | D |
| 7 | Chromitation on Zn/Fe | 60° C., 1 min, pH 2 | A |
| | | | B |
| 8 | Blue chromation on Zn | 20° C., 30s, pH 1.8 | A |

-continued

| Sample No. | Coating | Conditions | Measurement point |
|---|---|---|---|
| 9 | Yellow chromation on Zn | 20° C., 45s, pH 1.8 | A |
| | | | B |

FIG. 37 shows a Table containing the evaluations of the depth profile measurements, which indicates that all of the (chromitation) layers of the invention have thicknesses exceeding 100 nm.

What is claimed is:

1. A conversion layer comprising chromium(III), said conversion layer being chromium(VI)-free, said conversion layer being a substantially coherent conversion layer on zinc or a zinc alloy, wherein even in the absence of silicate, cerium, aluminum and borate said conversion layer presents a corrosion protection of about 100 to 1000 h in the salt spray test according to DIN 50021 SS or ASTM B 117-73 until first attack according to DIN 50961 Chapter 10, said conversion layer having a layer thickness of about 100 nm to 1000 nm, said conversion layer having across the conversion layer thickness a chromium content of greater than 1% based upon zinc and chromium, said conversion layer having an average chromium content of more than approximately 5% based on zinc and chromium, said conversion layer having a chromium index greater than approximately 10, wherein the chromium index is defined as said average chromium content (chromium/(chromium+zinc)) in the layer greater than 1% Cr, multiplied by the layer thickness in nm.

2. A conversion layer according to claim 1, wherein said conversion layer has a chromium-rich zone greater than approximately 20% chromium, based upon zinc and chromium in the conversion layer, of more than approximately 15 nm.

3. A conversion layer according to claim 1, wherein said layer is transparent.

4. A conversion layer according to claim 1, wherein said layer is clear.

5. A conversion layer according to claim 1, wherein said layer is substantially colorless.

6. A conversion layer according to claim 1, wherein said layer is iridescent.

7. A conversion layer according to claim 1, wherein said layer presents multi-colored iridescence.

8. A conversion layer according to claim 1, wherein said layer is hard.

9. A conversion layer according to claim 1, wherein said layer is resistant to wiping.

10. A conversion layer according to claim 1, wherein said layer adheres well.

11. A conversion layer according to claim 1, wherein said layer contains, for further enhanced corrosion protection, one or more components selected from the group consisting of silicate, cerium, aluminum and borate.

12. A conversion layer according to claim 1, wherein said layer further comprises cobalt.

13. A conversion layer according to claim 1, wherein said layer further comprises one or more metal compounds selected from the group consisting of 1- to 6-valent metal compounds.

14. A conversion layer according to claim 1, wherein said layer further comprises one or more metal compounds selected from the group consisting of Na, Ag, Al, Co, Ni, Fe, Ga, In, Lanthanides, Zr, Sc, Ti, V, Cr, Mn, Cu, Zn, Y, Nb, Mo, Hf, Ta and W.

15. A conversion layer according to claim 1, wherein said layer further comprises one or more ions selected from the group consisting of anions.

16. A conversion layer according to claim 1, wherein said layer further comprises one or more ions selected from the group consisting of halide ions, sulfurous ions, nitrate ions, phosphorus-containing ions, carboxylic acid anions and silicon-containing anions.

17. A conversion layer according to claim 1, wherein said layer further comprises one or more ions selected from the group consisting of chloride ions, sulfate ions, phosphate ions, diphosphate ions, linear and cyclic oligophosphate ions, linear and cyclic polyphosphate ions, hydrogen phosphate ions, and silicate anions.

18. A conversion layer according to claim 1, wherein said layer further comprises one or more materials selected from the group consisting of polymers, corrosion inhibitors, silicic acids, surfactants, polyols, organic acids, amines, plastics dispersions, dyes, pigments, chromogenic agents, amino acids, siccatives, and dispersing agents.

19. A conversion layer according to claim 1, wherein said layer further comprises one or more materials selected from the group consisting of organic polymers, colloidal or disperse silicic acids, diols, triols, monocarboxylic acids, carbon black, metal chromogenic agents, glycin, and cobalt siccatives.

20. A conversion layer according to claim 1, wherein said layer further comprises one or more materials selected from the group consisting of dyes and color pigments.

21. A method for producing a chromium(VI)-free conversion layer affording at least the corrosion protection of conventional chromium(VI)-containing yellow chromations, said method comprising the step of treating a metallic surface with a solution of at least one chromium(III) complex and at least one salt, wherein chromium(III) is present in said solution in a concentration of approx. 5 to 100 g/l; and said chromium(III) complex has ligand replacement kinetics more rapid than the fluoride replacement kinetics in chromium(III)-fluorocomplexes, said method producing a chromium(VI)-free conversion layer affording at least the corrosion protection of conventional chromium(VI)-containing yellow chromations.

22. A method according to claim 21, wherein said metallic surface is zinc or zinc alloy.

23. A method according to claim 21, wherein said metallic surface is zinc or zinc alloy with iron.

24. A method according to claim 21, wherein said treating is carried out at an elevated temperature.

25. A method according to claim 21, wherein said treating is carried out at a temperature of 20 to 100° C.

26. A method according to claim 21, wherein said treating is carried out at a temperature of 20 to 80° C.

27. A method according to claim 21, wherein said treating is carried out at a temperature of 30 to 60° C.

28. A method according to claim 21, wherein said treating is carried out at a temperature of 40 to 60° C.

29. A method according to claim 21, wherein said chromium(III) complex has chelate ligands which are selected from the group consisting of dicarboxylic acids, tricarboxylic acids, hydroxycarboxylic acids, acetylacetone, urea, urea derivatives, mixtures thereof, among each other as well as in mixed complexes with inorganic anions and $H_2O$.

30. A method according to claim 21, wherein said chromium(III) complex has chelate ligands which are selected from the group consisting of oxalic, malonic, succinic, glutaric, adipic, pimelic, suberic, azelaic and sebacic acids, mixtures thereof, and in mixed complexes with inorganic anions and $H_2O$.

31. A method according to claim 21, wherein said chromium(III) complex has chelate ligands which are selected from the group consisting of maleic acid, phthalic acid, terephthalic acid, tartaric acid, citric acid, malic acid, ascorbic acid, mixtures thereof, and in mixed complexes with inorganic anions and $H_2O$.

32. A method according to claim 21, wherein said chromium(III) complex has chelate ligands which are selected from the group consisting of malonic acid and malonic acid in mixed complexes with inorganic anions and $H_2O$.

33. A method according to claim 21, wherein said method is performed repeatedly on said metallic surface.

34. A method according to claim 21, wherein said treating is carried out at a temperature of 20 to 100° C. with rinsing water recycling over at least 2 cascaded rinsing stages.

35. A method according to claim 34, wherein a blue chromation is performed in one of the rinsing stages.

36. A method according to claim 21, wherein said method includes an immersion period of between approx. 15 and 200 seconds.

37. A method according to claim 21, wherein said method includes an immersion period of between approx. 15 and 100 seconds.

38. A method according to claim 21, wherein said method includes an immersion period of approx. 30 seconds.

39. A passivation bath for passivating a metal surface, said bath comprising chromium(III) in a concentration of approx. 5 to 100 g/l, chromium(III) being present in said bath in the form of at least one chromium(III) complex having ligand replacement kinetics more rapid than the fluoride replacement kinetics in chromium(III)-fluorocomplexes, said bath substantially containing chromium(III) as a passivating component.

40. A passivation bath according to claim 39, wherein said metal surface is zinc or zinc alloy.

41. A passivation bath according to claim 39, wherein said chromium(III) complex is selected from complexes with chromium(III) and at least one chelate ligand selected from the group consisting of dicarboxylic acids, tricarboxylic acids, hydroxycarboxylic acids, acetylacetone, urea, urea derivatives, mixtures thereof, among each other as well as in mixed complexes with inorganic anions and $H_2O$.

42. A passivation bath according to claim 39, wherein said chromium(III) complex is selected from complexes with chromium(III) and at least one chelate ligand selected from the group consisting of oxalic, malonic, succinic, glutaric, adipic, pimelic, suberic, azelaic and sebacic acids, mixtures thereof, and in mixed complexes with inorganic anions and $H_2O$.

43. A passivation bath according to claim 39, wherein said chromium(III) complex is selected from complexes with chromium(III) and at least one chelate ligand selected from the group consisting of maleic acid, phthalic acid, terephthalic acid, tartaric acid, citric acid, malic acid, ascorbic acid, mixtures thereof, and in mixed complexes with inorganic anions and $H_2O$.

44. A passivation bath according to claim 39, wherein said chromium(III) complex is selected from complexes with chromium(III) and at least one chelate ligand selected from the group consisting of malonic acid and malonic acid in mixed complexes with inorganic anions and $H_2O$.

45. A passivation bath according to claim 39, wherein said bath further comprises one or more components selected from the group consisting of sealers, dewatering fluids, additional metal compounds, anions, polymers, corrosion inhibitors, silicic acids, surfactants, polyols, organic acids, amines, plastics dispersions, dyes, pigments, chromogenic agents, amino acids, siccatives and dispersing agents.

46. A passivation bath according to claim 39, wherein said bath further comprises one or more components selected from the group consisting of 1- to 6-valent metal compounds, halide ions, sulfurous ions, nitrate ions, phosphoric ions, carboxylic acid anions, silicon-containing anions, organic polymers, colloidal or disperse silicilic acids, diols, triols, monocarboxylic acids, carbon black, metallic chromogenic agents, glycin, and cobalt siccatives.

47. A passivation bath according to claim 39, wherein said bath further comprises one or more components selected from the group consisting of metal compounds of Na, Ag, Al, Co, Ni, Fe, Ga, In, Lanthanides, Zr, Sc, Ti, V, Mn, Cu, Zn, Y, Nb, Mo, Hf, Ta and W, chloride ions, sulfate ions, phosphate ions, diphosphate ions, linear and cyclic oligophosphate ions, linear and cyclic polyphosphate ions, hydrogen phosphate ions and silicate anions.

48. A passivation bath according to claim 39, wherein chromium(III) is present in a concentration of approx. 5 g/l to 80 g/l.

49. A passivation bath according to claim 39, wherein chromium(III) is present in a concentration of approx. 5 g/l to 60 g/l.

50. A passivation bath according to claim 39, wherein chromium(III) is present in a concentration of approx. 10 g/l to 30 g/l.

51. A passivation bath according to claim 39, wherein chromium(III) is present in a concentration of approx. 20 g/l.

52. A passivation bath according to claim 39, wherein said bath has a pH between approx. 1.5 and 3.

53. A passivation bath according to claim 39, wherein said bath contains approx. 20 g/l chromium(III) and has a pH of approx. 2 to 2.5.

54. A passivation bath according to claim 39, wherein said bath has a bath temperature of approx. 20 to 100° C.

55. A passivation bath according to claim 39, wherein said bath has a bath temperature of approx. 20 to 80° C.

56. A passivation bath according to claim 39, wherein said bath has a bath temperature of approx. 30 to 60° C.

57. A passivation bath according to claim 39, wherein said bath has a bath temperature of approx. 40 to 60° C.

58. A concentrate for producing a passivation solution for passivating a metal surface, said concentrate substantially containing chromium(III) for a passivating component, wherein said chromium(III) is present in the form of at least one complex having ligand replacement kinetics more rapid than the fluoride replacement kinetics in chromium(III)-fluorocomplexes.

59. A concentrate according to claim 58, wherein said concentrate is present in liquid form.

60. A concentrate according to claim 58, wherein said concentrate is present in solid form.

61. A concentrate according to claim 58, wherein said metal surface is zinc or zinc alloy.

62. A concentrate according to claim 58, wherein said metal surface is selected from the group consisting of zinc, cadmium, aluminum and alloys of these metals among each other and/or with iron or other metals.

* * * * *

UNITED STATES PATENT AND TRADEMARK OFFICE

CERTIFICATE OF CORRECTION

PATENT NO. : 6,287,704 B1 
DATED : September 11, 2001
INVENTOR(S) : Patricia Preikschat et al.

It is certified that error appears in the above-identified patent and that said Letters Patent is hereby corrected as shown below:

Title page, Item [54] and Column 1, lines 1-3,
Delete "CHROMATE-FREE CONVERSION LAYER AND PROCESS FOR PRODUCING THE SAME" and insert therefore -- CHROMIUM (VI)-FREE CONVERSION LAYER AND METHOD FOR PRODUCING IT --.
Item [56], OTHER PUBLICATIONS, second reference, after "London, GB;" insert -- Class E31, --.

Column 2,
Line 22, delete "1.5.$\mu$m" and insert therefor -- 1.5 $\mu$m --.

Column 3,
Line 2, delete "protection>100" and insert therefor -- protection > 100 --.
Line 58, after "FIG. 4" insert -- , --.

Column 4,
Line 57, delete "layer>1%" and insert therefor -- layer > 1% --.

Column 6,
Line 61, delete "chromium (III)" and insert therefor -- chromium(III) --.

Column 7,
Line 18, before "Chromium (III)" begin a new paragraph.
Line 51, delete "$CrCl_3 .6H_2O$" and insert therefor -- $CrCl_3 \bullet 6\ H_2O$ --.

Column 8,
Line 42, delete "$K_1$" and insert therefor -- $k_1$ --.
Line 48, delete "$Zn^{2+} + xCr^{(III)} + yH_2O \rightarrow ZnCr_xO_y + 2y\ H^+$" and insert therefor -- $Zn^{2+} + xCr^{(III)} + yH_2O \rightarrow ZnCr_xO_y + 2y\ H^+$ --.
Line 51, delete "$H^{+,\ Cr(III)}$" and insert therefor -- $H^+, Cr^{(III)}$ --.
Line 54, delete "$1/(1+p_1 \bullet m_{ZnCrO})^2$" and insert therefor -- $1/(1+p_1 \bullet m_{ZnCrO})^2$ --.
Line 59, delete "$k_1$ x $c_H$ + / $a$ + $p_1$ x $m_{ZnCrO})^2$-" and insert therefor -- $k_1$ x$c_H$ + / (1+ $p_1$ x $m_{ZnCrO})^2$ --.
Line 60, before "$k_2$" insert -- - --.
Lines 60, after "x tanh($p_2$ x$m_{ZnCrO}$)" delete "+".
Line 61, before "$k_T$" insert -- + --.
Line 62, delete "$a$" and insert therefor -- (1 --.
Line 62, after "$p_1$ x $m_{ZnCrO})^2$" delete "+".
Line 63, before "$2yk_2$" insert -- + --.
Line 63, delete "x $3_{H+}$" and insert therefor -- x$c_H$ + --.
Line 63, after "x tanh($p_2$ x $m_{ZnCrO}$)" delete "+".

UNITED STATES PATENT AND TRADEMARK OFFICE

CERTIFICATE OF CORRECTION

PATENT NO. : 6,287,704 B1 
DATED : September 11, 2001
INVENTOR(S) : Patricia Preikschat et al.

It is certified that error appears in the above-identified patent and that said Letters Patent is hereby corrected as shown below:

Column 9,
Lines 2 and 6, before "$k_T$" insert -- + --.
Line 4, after "x tanh($p_2$ x $m_{ZnCrO}$)" delete "+".
Line 6, delete second occurrence of "-$c_{Cr}^{(III)}$"
Line 12, delete "tan h ($p_2$•$m_{ZnCrO}$)" and insert therefor -- tanh($p_2$•$m_{ZnCrO}$) --.
Line 13, after "reaction II" insert -- , --.
Line 14, delete "tan h" and insert therefor -- tanh --.
Line 29, delete "kj" and insert therefor -- *kj* --.

Column 10,
Line 60, delete "$CrCl_3$.6" and insert therefor -- $CrCl_3$ • 6 --.

Column 11,
Line 12, delete "$CrCl_3$.6" and insert therefor -- $CrCl_3$ • 6 --.

Column 12,
Lines 2 and 17, delete "60 s." and insert therefor -- 60s. --.
Lines 37-38, delete "chromium (VI)" and insert therefor -- chromium(VI) --.

Column 13,
Line 12, delete "0.00" and insert therefor -- .00 --.

Column 15,
Line 28, after "O" insert -- , --.

Signed and Sealed this

Fifteenth Day of April, 2003

JAMES E. ROGAN
*Director of the United States Patent and Trademark Office*

US006287704C1

(12) EX PARTE REEXAMINATION CERTIFICATE (5032nd)

United States Patent

Preikschat et al.

(10) Number: US 6,287,704 C1

(45) Certificate Issued: Nov. 30, 2004

(54) CHROMIUM(VI)-FREE CONVERSION LAYER AND METHOD FOR PRODUCING IT

(75) Inventors: Patricia Preikschat, Trebur (DE); Rolf Jansen, Trebur (DE); Peter Hulser, Trebur (DE)

(73) Assignee: Surtec Produkte und System fur die Oberflachenbehandlung GmbH, Trebur (DE)

Reexamination Request:
No. 90/006,211, Jan. 25, 2002
No. 90/006,672, Jun. 20, 2003

Reexamination Certificate for:

| | |
|---|---|
| Patent No.: | **6,287,704** |
| Issued: | **Sep. 11, 2001** |
| Appl. No.: | **09/171,558** |
| Filed: | **Mar. 29, 1999** |

Certificate of Correction issued Apr. 15, 2003.

(22) PCT Filed: Apr. 18, 1997

(86) PCT No.: PCT/DE97/00800

§ 371 (c)(1),
(2), (4) Date: Mar. 29, 1999

(87) PCT Pub. No.: WO97/40208

PCT Pub. Date: Oct. 30, 1997

(30) Foreign Application Priority Data

Apr. 19, 1996 (DE) ..... 196 15 664

(51) Int. Cl.[7] ..... B32B 15/04; C23C 22/00

(52) U.S. Cl. ..... 428/472.1; 106/14.21; 148/251; 148/258; 148/247; 148/265; 148/267; 148/268; 148/273; 148/274; 148/283; 148/284; 427/430.1; 427/435; 428/628; 428/629; 428/632; 428/658; 428/659

(58) Field of Search ..... 148/247, 251, 148/258, 259, 261, 262, 264, 265, 267, 268, 273, 274, 283, 284; 428/472.1, 628, 629, 632, 658, 659; 427/430.1, 435; 106/14.21

(56) References Cited

U.S. PATENT DOCUMENTS

| | | | |
|---|---|---|---|
| 2,035,380 | A | 3/1936 | Wilhelm |
| 2,035,385 | A | 3/1936 | McLean |
| 2,106,904 | A | 2/1938 | Wilhelm |
| 2,559,878 | A | 7/1951 | Johnson |
| 2,563,431 | A | 8/1951 | Spruance, Jr. |
| 2,620,265 | A | 12/1952 | Hesch |
| 2,904,413 | A | 9/1959 | Hampel |

(List continued on next page.)

FOREIGN PATENT DOCUMENTS

| | | |
|---|---|---|
| DE | 21 66 737 A1 | 6/1975 |
| DE | 29 00 099 A1 | 10/1979 |
| DE | 30 38 699 A1 | 7/1981 |

(List continued on next page.)

OTHER PUBLICATIONS

"Electrodeposited Coatings of Zinc on Iron of Steel: Concepts, Corrosion Testing and Corrosion Resistance," DIN 50961; Sep. 2000; pp. 1–6 (translation).
DIN 50 961, Ch. 10, "Prüfung des Chromatierüberzuges" (English Title "Testing of Chromate Conversion Coatings"), Jun. 1987 (with English translation).
"Chromate Coating From Trivalent Solution," Products Finishing, Aug., 1983, pp. 64–65.

(List continued on next page.)

*Primary Examiner*—Scott Kastler

(57) ABSTRACT

A chromium(VI)-free, chromium(III)-containing and substantially coherent conversion layer on zinc or zinc alloys presenting, even in the absence of further components such as silicate, cerium, aluminum and borate, a corrosion protection of approx. 100 to 1000 h in the salt spray test according to DIN 50021 SS or ASTM B 117-73 until first attack according to DIN 50961 Chapter 10; being clear, transparent and substantially colorless and presenting multicolored iridescence; having a layer thickness of approx. 100 nm to 1000 nm; and being hard, adhering well and being resistant to wiping.

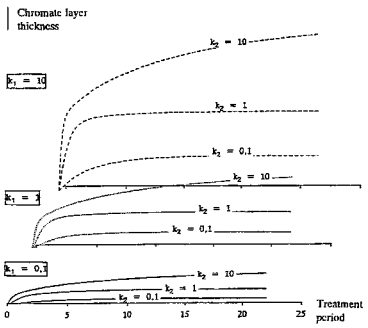

Computer simulation of the kinetic model of chromate coating of zinc for various rate constants

U.S. PATENT DOCUMENTS

| | | | |
|---|---|---|---|
| 3,072,516 | A | 1/1963 | Bellinger et al. |
| RE26,130 | E | 12/1966 | Bellinger et al. |
| 3,382,111 | A | 5/1968 | Tongyai et al. |
| 3,477,882 | A | 11/1969 | Coulman |
| 3,553,034 | A | 1/1971 | Harvey et al. |
| 3,556,868 | A | 1/1971 | Ziemba |
| 3,787,326 | A | 1/1974 | Deyrup |
| 3,843,430 | A | 10/1974 | Kinder |
| 3,857,739 | A | 12/1974 | Prust et al. |
| 3,900,689 | A | 8/1975 | Deyrup |
| 3,932,198 | A | 1/1976 | Schneider |
| 4,126,490 | A | 11/1978 | Aoki |
| 4,141,758 | A | 2/1979 | Glassman et al. |
| 4,169,741 | A | 10/1979 | Lampatzer et al. |
| 4,171,231 | A | 10/1979 | Bishop et al. |
| 4,263,059 | A | 4/1981 | Guhde et al. |
| 4,298,404 | A | 11/1981 | Greene |
| 4,349,392 | A | 9/1982 | Huvar |
| 4,359,345 | A | 11/1982 | DaFonte, Jr. |
| 4,359,346 | A | 11/1982 | DaFonte, Jr. |
| 4,359,347 | A | 11/1982 | DaFonte, Jr. |
| 4,359,348 | A | 11/1982 | Crotty |
| 4,367,099 | A | 1/1983 | Lash et al. |
| 4,384,902 | A | 5/1983 | Crotty et al. |
| 4,444,601 | A | 4/1984 | Greene |
| 4,539,348 | A | 9/1985 | Gajria et al. |
| 4,578,122 | A | 3/1986 | Crotty |
| 4,705,576 | A | 11/1987 | Klos et al. |
| 4,749,418 | A | 6/1988 | Saeki et al. |
| 4,801,337 | A | 1/1989 | Higgins |
| 5,091,023 | A | 2/1992 | Saeki et al. |
| 5,141,575 | A | 8/1992 | Yoshitake et al. |
| 5,230,750 | A | 7/1993 | Shindou et al. |
| 5,368,655 | A | 11/1994 | Klos |
| 5,393,354 | A | 2/1995 | Bishop |
| 5,407,749 | A | 4/1995 | Bishop |
| 5,415,702 | A | 5/1995 | Bishop et al. |
| 5,807,442 | A | 9/1998 | Goodreau |
| 5,820,741 | A | 10/1998 | Bibber |
| 5,876,517 | A | 3/1999 | Jeannier |
| 6,375,726 | B1 | 4/2002 | Matzdorf et al. |

FOREIGN PATENT DOCUMENTS

| | | | |
|---|---|---|---|
| DE | 32 13 384 | A1 | 12/1982 |
| DE | 34 23 990 | A1 | 1/1985 |
| DE | 41 35 524 | A1 | 4/1993 |
| EP | 0034040 | A1 * | 8/1981 |
| EP | 0 337 411 | B1 | 10/1989 |
| EP | 0 337 411 | A2 | 10/1989 |
| GB | 1 461 244 | | 1/1977 |
| GB | 2097024 | | 10/1982 |
| GB | 2 144 773 | A | 3/1985 |
| JP | 50-1934 | | 10/1975 |
| JP | 61-587 | | 6/1986 |
| SU | 1781316 | A1 | 12/1992 |

OTHER PUBLICATIONS

Barnes, et al., "Non–Chromate Passivation Treatments For Zinc," Transactions of the Institute of Metal Finishing, 1982, pp. 45–48, vol. 60, (no month data available).

Klos, "Clear Chromates: Theory and Practice," Products Finishing, Jun., 1988, pp. 72–78.

Dr.–Ing. Uka Handreg and Dipl.–Ing. Stefen Piepenstock, Prüfbericht–Untersuchungen an Blauchromatierungen, Jan. 8, 2002, pp. 1–4.

Dipl.–Ing. Britta Schlüter, Prüfbericht–Untersuchungen an Blauchromatierungen, Jun. 19, 2002, pp. 1–3.

Von. W. Stechelbach, Chromatierungstechnik an Verzinkten Oberflächen, Galvanotechnik, D–7968 Saulgau, 82 (1991) Nr. 8, pp. 2669–2672, (no month data).

Zusammenstellung der Experimentellen Daten, Jul. 17, 2002, 9 pages.

SurTec® 660 Dreiwertige Blauchromatierung, SurTec GmbH, Feb. 1994, 2 pages.

SurTec® 662 Dreiwertige Temperbeständige Blauchromatierung, SurTec GmbH, Feb. 1994, 2 pages.

SurTec® 664 Dreiwertige, Temperbeständige Blauchromatierung mit Eiseninhibitor, SurTec GmbH, Feb. 1994, 2 pages.

Optische Defizite der Surtec Beispiele 2 und 3 aus dem Patent EP 0 907 762, at least as early as Jul. 17, 2002, 1 page.

Chemisch erzeugte Schultzschichten, pp. 470–473, at least as early as Jul. 22, 2002.

Coventya, Internal Note, Subject: Opposition au brevet EP 907762, Jul. 1, 2002, 4 pages.

Peter Hülser, et al., Chromitierung, Mo Metalloberfläche Beschichten von Metall Und Kunststoff, Oct. 1996, 5 pages.

PCT International Search Report for PCT International Appl. PCT/DE97/00800, Sep. 5, 1997.

Clayton F. Callis, et al., "Some Metal Derivatives of Azo and Azomethine Dyes", Journal of the American Chemical Society, vol. 74, No. 14, Jul. 23, 1952, pp. 3461–3464.

Archie S. Wilson, et al., "The Affinities of Chromic Ion and Gallium Ion for Fluoride Ion", Journal of the American Chemical Society, vol. 74, No. 14, Jul. 20, 1952, pp. 3509–3512.

"Kinetics of Formation and Dissociation of $[Cr_3O(O_2CCH_3)_6(urea)_3]^+$: An Example of Statistically Controlled Kinetics and Equilibrium," John P. Bourke, et al., Inorganic Chemistry; vol. 35, No. 6, Mar. 13, 1996; pp. 1577–1581.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 is confirmed.

Claims 39–62 are cancelled.

Claims 21 and 35 are determined to be patentable as amended.

Claims 22–34 and 36–38, dependent on an amended claim, are determined to be patentable.

21. A method for producing a chromium(VI)-free conversion layer affording at least the corrosion protection of conventional chromium(VI)-containing yellow chromations, said method comprising the step of treating a metallic surface with a solution of at least one chromium(III) complex and at least one salt, wherein chromium(III) is present in said solution in a concentration of approx. 5 to 100 g/l; and said chromium(III) complex has ligand replacement kinetics more rapid than the fluoride replacement kinetics in chromium(III)-fluorocomplexes, said method producing a *substantially coherent* chromium(VI)-free conversion layer [affording at least the corrosion protection of conventional chromium(VI)-containing yellow chromations] *presenting a corrosion protection of about 100 to 1000 h in the salt spray test according to DIN 50021 SS or ASTM B 117-73 until first attack according to DIN 50961 Chapter 10, and having a layer thickness of about 100 nm to 1000 nm.*

35. A method [according to claim 34] *for producing a chromium(VI)-free conversion layer affording at least the corrosion protection of conventional chromium(VI)-containing yellow chromations, said method comprising the step or treating a metallic surface with a solution of at least one chromium(III) complex and at least one salt, wherein chromium(III) is present in said solution in a concentration of approx. 5 to 100 g/l; and said chromium(III) complex has ligand replacement kinetics more rapid than the fluoride replacement kinetics in chromium(III)-fluorocomplexes, said method producing a chromium(VI)-free conversion layer affording at least the corrosion protection of conventional chromium(VI)-containing yellow chromations, said treating being carried out at a temperature of 20 to 100° C. with rinsing water recycling over at least 2 cascaded rinsing stages*, wherein a blue chromation is performed in one of the rinsing stages.

* * * * *

US006287704C2

(12) EX PARTE REEXAMINATION CERTIFICATE (5811st)

United States Patent

Preikschat et al.

(10) Number: US 6,287,704 C2

(45) Certificate Issued: Jul. 10, 2007

(54) CHROMIUM(VI)-FREE CONVERSION LAYER AND METHOD FOR PRODUCING IT

(75) Inventors: Patricia Preikschat, Trebur (DE); Rolf Jansen, Trebur (DE); Peter Hulser, Trebur (DE)

(73) Assignee: Surtec International GmbH, Zwingenberg (DE)

Reexamination Request:
No. 90/007,777, Oct. 25, 2005

Reexamination Certificate for:

| | |
|---|---|
| Patent No.: | **6,287,704** |
| Issued: | **Sep. 11, 2001** |
| Appl. No.: | **09/171,558** |
| Filed: | **Mar. 29, 1999** |

Reexamination Certificate B1 6,287,704 issued Nov. 30, 2004

Certificate of Correction issued Apr. 15, 2003.

(22) PCT Filed: Apr. 18, 1997

(86) PCT No.: PCT/DE97/00800

§ 371 (c)(1),
(2), (4) Date: Mar. 29, 1999

(87) PCT Pub. No.: WO97/40208

PCT Pub. Date: Oct. 30, 1997

(30) Foreign Application Priority Data

Apr. 19, 1996 (DE) ..... 196 15 664

(51) Int. Cl.
*C23C 22/05* (2006.01)
*C23C 22/53* (2006.01)

(52) U.S. Cl. ..... 428/472.1; 428/628; 428/629; 428/632; 428/658; 148/247; 148/251; 148/258; 148/265; 148/273; 148/274; 148/283; 148/284; 427/430.1; 427/435; 106/14.21

(58) Field of Classification Search ..... None

See application file for complete search history.

(56) References Cited

U.S. PATENT DOCUMENTS

| | | | |
|---|---|---|---|
| 2,035,380 | A | 3/1936 | Wilhelm |
| 2,035,385 | A | 3/1936 | McLean |
| 2,106,904 | A | 2/1938 | Wilhelm |
| 2,559,878 | A | 7/1951 | Johnson |
| 2,563,431 | A | 8/1951 | Spruance, Jr. |
| 2,626,265 | A | 1/1953 | Hesch |
| 2,904,413 | A | 9/1959 | Hampel |
| 3,072,516 | A | 1/1963 | Bellinger et al. |
| RE26,130 | E | 12/1966 | Bellinger et al. |
| 3,382,111 | A | 5/1968 | Tongyai et al. |
| 3,477,882 | A | 11/1969 | Coulman |
| 3,553,034 | A | 1/1971 | Harvey et al. |
| 3,556,868 | A | 1/1971 | Ziemba |
| 3,787,326 | A | 1/1974 | Deyrup |
| 3,843,430 | A | 10/1974 | Kinder |
| 3,857,739 | A | 12/1974 | Prust et al. |
| 3,900,689 | A | 8/1975 | Deyrup |
| 3,932,198 | A | 1/1976 | Schneider |
| 4,126,490 | A | 11/1978 | Aoki |
| 4,141,758 | A | 2/1979 | Glassman et al. |
| 4,169,741 | A | 10/1979 | Lampazer et al. |
| 4,171,231 | A | 10/1979 | Bishop et al. |
| 4,263,059 | A | 4/1981 | Guhde et al. |
| 4,298,404 | A | 11/1981 | Greene |
| 4,349,392 | A | 9/1982 | Huvar |
| 4,359,345 | A | 11/1982 | Da Fonte, Jr. |
| 4,359,346 | A | 11/1982 | Da Fonte, Jr. |
| 4,359,347 | A | 11/1982 | Da Fonte, Jr. |
| 4,359,348 | A | 11/1982 | Crotty |
| 4,367,099 | A | 1/1983 | Lash et al. |
| 4,384,902 | A | 5/1983 | Crotty et al. |
| 4,444,601 | A | 4/1984 | Greene |
| 4,539,348 | A | 9/1985 | Gajria et al. |
| 4,578,122 | A | 3/1986 | Crotty |
| 4,702,802 | A | 10/1987 | Umino et al. |
| 4,705,576 | A | 11/1987 | Klos et al. |
| 4,749,418 | A | 6/1988 | Saeki et al. |
| 4,801,337 | A | 1/1989 | Higgins |
| 5,091,023 | A | 2/1992 | Saeki et al. |
| 5,141,575 | A | 8/1992 | Yoshitake et al. |
| 5,230,750 | A | 7/1993 | Shindou et al. |
| 5,294,266 | A | 3/1994 | Haufe et al. |
| 5,368,655 | A | 11/1994 | Klos |

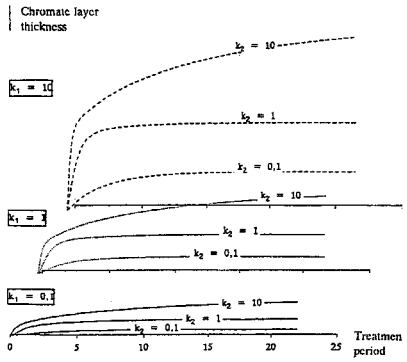

Computer simulation of the kinetic model of chromate coating of zinc for various rate constants

| | | | |
|---|---|---|---|
| 5,393,354 | A | 2/1995 | Bishop |
| 5,407,749 | A | 4/1995 | Bishop |
| 5,415,702 | A | 5/1995 | Bishop et al. |
| 5,807,442 | A | 9/1998 | Goodreau |
| 5,820,741 | A | 10/1998 | Bibber |
| 5,876,517 | A | 3/1999 | Jeannier |
| 6,224,657 | B1 | 5/2001 | Myers et al. |
| 6,287,704 | B1 | 9/2001 | Preikschat et al. |
| 6,375,726 | B1 | 4/2002 | Matzdorf et al. |

FOREIGN PATENT DOCUMENTS

| | | |
|---|---|---|
| DE | 2166737 | 6/1975 |
| DE | 2900099 | 10/1979 |
| DE | 3038699 | 7/1981 |
| DE | 3423990 | 1/1985 |
| DE | 3213384 | 1/1991 |
| DE | 4135524 | 4/1993 |
| EP | 034040 | 8/1981 |
| EP | 337411 | 10/1989 |
| GB | 1461244 | 1/1977 |
| GB | 2097024 | 10/1982 |
| GB | 2144773 | 3/1985 |
| JP | 50-1934 | 1/1975 |
| JP | 61-587 | 1/1986 |
| RU | 1781316 | 12/1992 |

OTHER PUBLICATIONS

DIN 50 961, Ch. 10, "Prüfung des Chromatierüberzuges" (English Title "Testing of Chromate Conversion Coatings"), Jun. 1987 (with English translation).

"Some Metal Derivatives of Azo and Azomethine Dyes," Journal of the American Chemical Society, vol. 74, No. 14, pp. 3461and 3509–3512, Jul. 20, 1952.

PCT International Search Report for PCT International Appication PCT/DE97/00800, Sep. 5, 1997.

Dr.–Ing. Uka Handreg and Dipl.–Ing. Stefen Piepenstock, Prüfbericht–Untersuchungen an Blauchromatierungen, pp. 1–4, Jan. 8, 2002.

Von W. Stechelbach, Chromatierungstechnik an Verzinkten Oberflächen, Galvanotechnik, D–7968 Saulgau, 82 Nr. 8, pp. 2669–2672, 1991.

Zusammenstellung der Experimentellen Daten, Jul. 17, 2002, 9 pages.

Surtec® 660 Dreiwertige Blauchromatierung, SurTec GmbH, Feb. 1994.

SurTec® 662 Dreiwertige Temperbestandige Blauchromatierung, SurTec GmbH, Feb. 1994.

Arthur Schaier, First Request for Reexamination of U.S. Patent No. 6,287,704 (granted as re–exam U.S. Appl. No. 90/006,211), Request filed in U.S. Patent Office on Jan. 25, 2002, pp. 1–118.

Arthur Schaier, Submission of Prior Art Under 37 CFR 1.501 filed in re–exam proceeding U.S. Appl. No. 90/006, 211, filed in U.S. Patent Office on Mar. 11, 2002, pp. 1–4.

Patricia Preikschat, Declaration of Patricia Preikschat Under Rule 1.132 filed in re–exam proceeding U.S. Appl. No. 90/006,211, dated Dec. 28, 2002, pp. 1–10.

Arthur Schaier, Second Request for Reexamination of U.S. Patent No. 6,287,704 (granted as re–exam U.S. Appl. No. 90/006,672), filed in U.S. Patent Office on Jun. 20, 2003, pp. 1–25.

Sudha Damji, Declaration of Sudha Damji and attached Exhibit A, dated Jun. 18, 2003 (submitted with the second request for reexamination of U.S. Patent No. 6,287,704) filed in re–exam proceeding U.S. Appl. No. 90/006,672 on Jun. 20, 2003, pp. 1–33.

"Chromate Coating From Trivalent Solution", Products Finishing, Aug. 1983, pp. 64–65.

Barnes, et al., "Non–Chromate Passivation Treatments for Zinc," Transactions of the Institute of Metal Finishing, Summer, 1982, pp. 45–48, vol. 60.

Klos, "Clear Chromates: Theory and Practice", Products Finishing, Jun. 1988, pp. 72–78.

"Kinetics of Formation and Dissociation of [Cr3O(O2CCH3)6(urea)3]+: An Example of Statistically Controlled Kinetics and Equilibrium," John P. Bourke, et al., Inorganic Chemistry; vol. 35, No. 6, Mar. 13, 1996; pp. 1577–1581.

SurTec® 664 Dreiwertige, Temperbestandige Blauchromatierung mit Eiseninhibitor, SurTec GmbH, Feb. 1994.

Optische Defizite der Surtec Beispiele 2 und 3 aus dem Patent EP 0907762, at least as early as Jul. 17, 2002.

Chemisch erzeugte Schultzchichten, pp. 470–473, at least as early as Jul. 22, 2002.

Coventya, *Internal Note,* Subject: Opposition au brevet EP 907762, Jul. 1, 2002, 4 pages.

Peter Hülser, et al., CHROMITIERUNG, Mo Metalloberfläche Beschinchten von Metall Und Kunststoff, Oct. 1996, 5 pages.

*Primary Examiner*—Stephen Stein

(57) ABSTRACT

A chromium(VI)-free, chromium(III)-containing and substantially coherent conversion layer on zinc or zinc alloys presenting, even in the absence of further components such as silicate, cerium, aluminum and borate, a corrosion protection of approx. 100 to 1000 h in the salt spray test according to DIN 50021 SS or ASTM B 117-73 until first attack according to DIN 50961 Chapter 10; being clear, transparent and substantially colorless and presenting multicolored iridescence; having a layer thickness of approx. 100 nm to 1000 nm; and being hard, adhering well and being resistant to wiping.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–38 is confirmed.

Claims 39–62 were previously cancelled.

* * * * *